US011672326B2

(12) United States Patent
Zwimpfer

(10) Patent No.: US 11,672,326 B2
(45) Date of Patent: Jun. 13, 2023

(54) APPLICATOR DEVICE

(71) Applicant: TRISA HOLDING AG, Triengen (CH)

(72) Inventor: Martin Zwimpfer, Lucerne (CH)

(73) Assignee: TRISA HOLDING AG, Triengen (CH)

( * ) Notice: Subject to any disclaimer, the term of this patent is extended or adjusted under 35 U.S.C. 154(b) by 493 days.

(21) Appl. No.: 16/649,086

(22) PCT Filed: Sep. 6, 2018

(86) PCT No.: PCT/EP2018/074060
§ 371 (c)(1),
(2) Date: Mar. 19, 2020

(87) PCT Pub. No.: WO2019/057516
PCT Pub. Date: Mar. 28, 2019

(65) Prior Publication Data

US 2020/0260853 A1 Aug. 20, 2020

(30) Foreign Application Priority Data

Sep. 19, 2017 (EP) ..... 17191836

(51) Int. Cl.
*A46B 1/00* (2006.01)
*A46B 5/02* (2006.01)
(Continued)

(52) U.S. Cl.
CPC ..... *A46B 1/00* (2013.01); *A46B 5/026* (2013.01); *A46B 9/021* (2013.01); *A46B 9/026* (2013.01);
(Continued)

(58) Field of Classification Search
CPC ..... A46B 3/005; A46B 17/04; A46B 1/00; A61C 15/02; A61C 15/00
See application file for complete search history.

(56) References Cited

U.S. PATENT DOCUMENTS 4,589,159 A * 5/1986 Streibel ..... A46B 15/0085 40/314
6,085,761 A 7/2000 Inaba
(Continued)

FOREIGN PATENT DOCUMENTS

DE 11 2013 002 612 T5 3/2015
EP 2897488 A1 * 7/2015 ..... A45D 40/267
(Continued)

OTHER PUBLICATIONS

Nov. 7, 2018 Search Report issued in International Patent Application No. PCT/EP2018/074060.
(Continued)

*Primary Examiner* — Shay Karls
(74) *Attorney, Agent, or Firm* — Oliff PLC

(57) ABSTRACT

An applicator device including at least one holding section, at least one working tip, and a neck section connecting the holding section and the working tip, the device also includes a base body formed at least partially from a first plastic component, the base body being at least partially overmolded by at least one second plastic component that is softer than the first plastic component. In the region of the working tip, the at least one second plastic component at least partially coats the base body, and the coating includes outwardly projecting, bristle-type cleaning elements.

27 Claims, 26 Drawing Sheets

Figure 1:
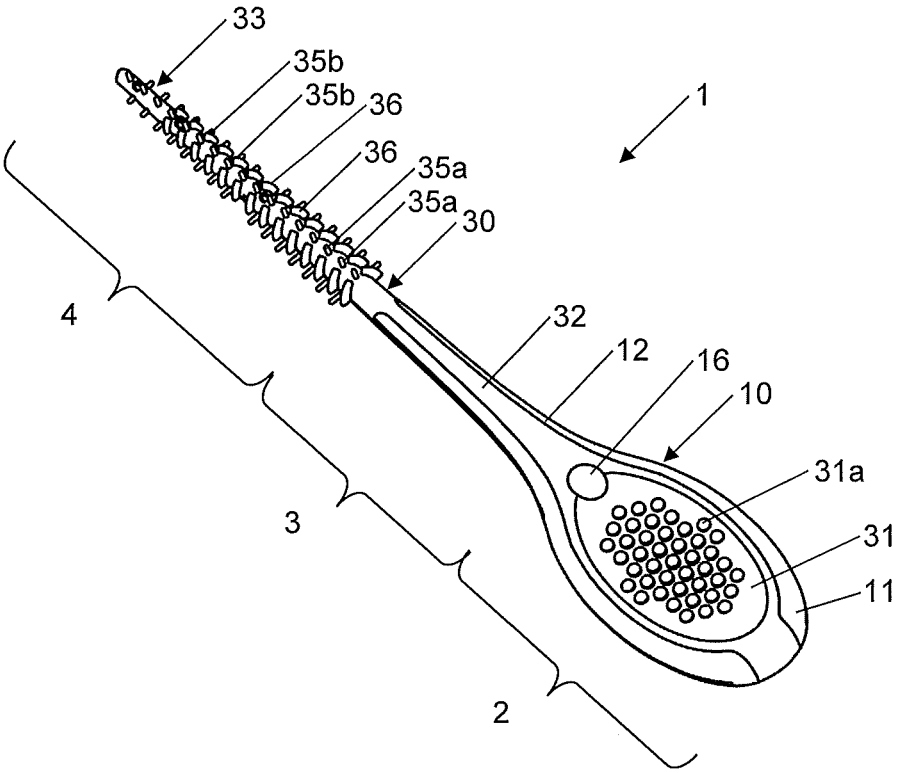

(51) Int. Cl.

| | |
|---|---|
| ***A46B 9/02*** | (2006.01) |
| ***A46B 15/00*** | (2006.01) |
| ***A46D 1/04*** | (2006.01) |
| ***A46D 3/00*** | (2006.01) |

(52) U.S. Cl.
CPC ..... *A46B 15/0016* (2013.01); *A46B 15/0038* (2013.01); *A46B 15/0085* (2013.01); *A46B 15/0087* (2013.01); *A46D 1/04* (2013.01); *A46D 3/005* (2013.01); *A46B 2200/108* (2013.01); *A46B 2200/1053* (2013.01)

(56) References Cited

U.S. PATENT DOCUMENTS

| | | | |
|---|---|---|---|
| 6,627,233 | B1 | 9/2003 | Wolf et al. |
| 9,173,479 | B2 | 11/2015 | Butz et al. |
| 2015/0257523 | A1 | 9/2015 | Butz et al. |
| 2015/0257861 | A1 | 9/2015 | Dishon |
| 2015/0282601 | A1 | 10/2015 | Butz et al. |
| 2016/0058531 | A1 | 3/2016 | Adriano et al. |
| 2016/0135932 | A1 | 5/2016 | Butz et al. |

FOREIGN PATENT DOCUMENTS

| | | | | |
|---|---|---|---|---|
| EP | 2 974 619 | A2 | | 1/2016 |
| JP | 3097244 | U | * | 1/2004 |
| WO | 2015/147076 | A1 | | 10/2015 |
| WO | 2016/113928 | A1 | | 7/2016 |
| WO | 2016/199834 | A1 | | 12/2016 |
| WO | 2016/199835 | A1 | | 12/2016 |

OTHER PUBLICATIONS

Nov. 7, 2018 Written Opinion of the International Searching Authority issued in International Patent Application No. PCT/EP2018/074060.

* cited by examiner

APPLICATOR DEVICE

The invention relates to cleaning or applicator devices manufactured by injection molding, such as interdental cleaners or mascara applicators, comprising at least one holding section, at least one working tip, and a neck section connecting the holding section and the working tip, and which comprise a base body which is at least partially formed from a first plastic component, the base body being at least partially overmolded by a second plastic component, a manufacturing method for such applicator devices and a corresponding tool.

Known interdental cleaners and applicators are described in US 2015/0282601 A1, WO 2015/147076 A1, US 2015/0257861 A1, US 2016/0135932 A1, US 2016/0058531 A1, US 2015/0257523 A1, U.S. Pat. No. 9,173,479 B2, WO 2016/113928 A1, WO 2016/199834 A1, WO 2016/199835 A1 and DE 11 2013 002 612 TS.

These products are sometimes disadvantageous in use. For example, due to anatomically unfavorable shapes of the working tips, injuries to the gums occur during use. In addition, the well-known products are often not very variable and are expensive to manufacture.

It is therefore the task of the present invention to provide an applicator device which is efficient and variable in use, in particular ensures a high cleaning effect while protecting the gums, and which can be cheaply manufactured—as well as a corresponding method and tool. Furthermore, such applicators can be supplemented with effective additional functions.

According to the invention, this task is solved by an applicator device with at least one holding section, at least one working tip, and a neck section connecting the holding section and the working tip, and a base body which is at least partially formed from a first plastic component, wherein the base body is at least partially overmolded by at least one second plastic component, which is softer than the first plastic component, wherein in the region of the working tip the at least one second plastic component at least partially coats the base body and wherein the coating comprises outwardly projecting cleaning elements, and by a method for producing an applicator device or a comb of applicator devices by injection molding, wherein the applicator device(s) has/have at least one holding section, at least one working tip and a neck section connecting the holding section and the working tip, wherein in a first step one or more base bodies is/are injection molded which is/are at least partially formed from a first plastic component and wherein, after a repositioning process, in a second step the base body or bodies is/are at least partially overmolded by at least one second plastic component, which is softer than the first plastic component, the second plastic component at least partially coats the base body in the region of the working tip(s), and wherein the coating forms outwardly projecting cleaning elements (or applicator elements), and by a tool for producing a comb of applicator devices by injection molding with at least one first cavity for coating the first plastic component for the base bodies and a second cavity for coating the base body with the second plastic component, wherein the first cavity for the first plastic component is modularly constructed from at least one rear section for at least the base body holding section and at least one front section for at least the tip of the base body, and wherein the second cavity for the second plastic component is modularly constructed from at least one rear section for at least the holding cover and at least one front section for at least the coating.

In the present case, the term applicator device includes in particular interdental cleaners and mascara applicators, but also toothbrushes and tongue cleaners. The holding section can also be shaped as a handle and the working tip as a head part or toothbrush head part or as a (pure) tongue cleaner. In addition to a bristle-shaped design, the cleaning elements may also include special tongue cleaner structures (e.g. nubs, lamellae, scraping edges etc.).

Modular means in this case that different embodiments of the base body holding section can be combined with different designs of the base body tips, and correspondingly different embodiments of the holding cover can be combined with different embodiments of the coating (the neck section is preferably fixed in each case—i.e. the same embodiment for all models—as it is specially designed for the repositioning function in the injection mold, from the first cavity to the second cavity). In this preferred embodiment of the tool, the base body of the applicator device and the corresponding sections are therefore made up of three sections:

(i) a modular, i.e. interchangeable base body holding section, (ii) a fixed (i.e. preferably for all modular models of the applicator device the same) neck section used during the repositioning to the second cavity, (iii) a modular, i.e. interchangeable base body tip section.

The same applies to possible further plastic components in a second (without repositioning) or third (with repositioning) and further cavities of the injection mold. In this preferred embodiment of the tool, the injection-molded body of the applicator device and the corresponding injection molding tool thus consist of three sections:

(i) a modular, i.e. interchangeable injection-molded body holding section, (ii) a fixed (i.e. preferably for all modular models of the applicator device the same) neck section, and (iii) a modular, i.e. exchangeable injection-molded body tip section.

Alternatively, the applicator device and the corresponding injection mold can also consist of only 2 sections. In this case, the neck section described above would occupy a part of the holding section and/or a part of the tip section, and the base body would have a fixed body holding section (i.e. preferably the same for all modular models of the applicator device) used during the repositioning to the second cavity, or a fixed body tip.

The separation of the modular parts of the injection-molded cavities is visible with a fine separating seam (or venting seam) on the base body and the covering (injection-molded body). The separation of the cavities is positioned so that venting takes place above it. The separating seam is preferably located between the holding section and the neck section and between the neck section and the working tip.

With regard to terminology, it should be noted that in the present case the injection-molded body comprises the entire second plastic component with which the base body is overmolded. The coating is that part of the injection-molded body which, together with the coated part of the base body (i.e. the tip of the base body), forms the working tip. Furthermore, the injection-molded body also includes the holding and neck covering, which together with the base body holding or the base body neck section form the holding and neck section of the applicator device.

The injection-molded body can be made of different materials and/or different colors of the same material, e.g. one material or one color for the holding cover and another material or color for the coating of the working tip. Of course, other combinations are possible, such as a holding cover made of two or more materials or colors and/or a coating of the working tip made of two or more materials or colors. The additional materials or colors can be processed in the second, third or further cavity of the injection mold.

According to a preferred embodiment of the present invention, the working tip is triangular in shape, the upper tip of the triangular shape being aligned with the upper side of the applicator device and being formed by a series of vertical, preferably bristle-shaped, cleaning elements, and the lower tips of the triangular shape being formed by a series of horizontal, preferably bristle-shaped, cleaning elements. Preferably, the working tip tapers towards the frontmost or free end, respectively, so that a conical triangular shape is formed overall.

The bristle-shaped cleaning elements may be provided with additional flat or flat-like plastic skins at or around the free end (to improve their cleaning action in use). These plastic skins are thinner than the bristle-shaped cleaning element. In appearance, they are designed like a spade, the bristle-shaped cleaning element forms the handle and the plastic skin or skins form the shovel.

This improves the cleaning effect of the bristle-shaped cleaning element, as the thin skins can penetrate even better into narrow interdental zones. The plastic skin is of minimal thickness, i.e. the thickness is less than 0.5 mm, preferably less than 0.2 mm. From the actual bristle-shaped cleaning element, the plastic skin protrudes 0.5 to 3 times, preferably 1-2 times perpendicular to the outer surface, in relation to the maximum diameter.

In this way, a cleaning arrangement is created which is ideally modelled on the natural interdental form and enables targeted cleaning of the problem areas. The vertical cleaning elements clean the proximal area and the horizontal cleaning elements clean along the gum line, thus helping to prevent gingival recession.

Preferably, the base body holding section and/or the holding cover is not symmetrical (in relation to the longitudinal center plane). This allows the user to recognize the orientation of the applicator device and thus the orientation of the triangular shape (or any other design deviating from the circular cross-section) of the working tip and thus the intended orientation for insertion into the interdental space.

Other cross-sectional shapes of the working tip are also conceivable, for example a 4-, 5-, 6- or n-angular shape, a circular shape, an elliptical shape, a closed free-form surface. The shapes can also be designed in such a way that they are only formed on half a side of the cross-section and the other half is designed as a flat surface.

As regards terminology, it should be noted that the upper surface of the applicator device in the present case is that side of the device on which the thumb is usually placed (i.e. with the studs or ribs). The underside of the applicator device is accordingly referred to as the opposite side of the applicator device. The left side of the applicator device is referred to as the side to the left of the thumb, when the tip is facing away from the user. Accordingly, the right side of the applicator device is referred to as the side to the right of the thumb placed as intended, when the tip is facing away from the user.

According to another preferred embodiment of the present invention, the underside of the base body in the area of the working tip is at least partially free of coating. In this way, a sliding zone is created, by means of which the gums are gently massaged and stimulated during cleaning.

According to a further preferred embodiment of the present invention, lamellar cleaning elements are arranged on the left and right side of the triangular shape, seen in a front view, between the vertical and horizontal, preferably bristle-shaped, cleaning elements, whereby preferably the vertical and horizontal, preferably bristle-shaped, cleaning elements project further outward than the lamellar cleaning elements. By means of such lamellae, a particularly effective and pleasant polishing effect can be achieved, which helps to thoroughly remove both food residues and discoloration.

In the present triangular shape, therefore, the vertical and horizontal cleaning elements and, where appropriate, the lamellar cleaning elements form an approximately triangular outline, the underside of the triangle preferably being at least partially free of soft components and having no cleaning elements. The underside of the triangle with the hard component thus offers a different coefficient of friction than the two lateral legs of the triangle whose surface consists of soft component.

According to a further preferred embodiment of the present invention, the vertical and horizontal, preferably bristle-shaped, cleaning elements are arranged offset to each other in the direction of the longitudinal axis of the working tip, wherein preferably the lamellar-shaped cleaning elements are arranged in a cross-sectional plane with the vertical, preferably bristle-shaped, cleaning elements and wherein further preferably the horizontal, preferably bristle-shaped, cleaning elements are arranged in pairs opposite each other. In this way, the cleaning effect of the applicator devices can be made even more long lasting. The two cross-sectional planes formed in this way preferably alternate.

According to another preferred embodiment of the present invention, several supports are provided in the area of the working tip, whereby the supports are preferably provided in the form of cut-outs on the upper side of the base body (resulting from the engagement of the holding elements or holding pins of the injection mold) and in the form of lateral (usually pin-shaped) projections of the base body (holding against the mold wall by the base body itself).

The supports of the base body are used as aids in the manufacture of the injection-molded body. It was found that a significant proportion of products without supports have missing lateral bristles. Therefore, for production and quality assurance, supports are necessary to position the body in the mold. In addition, the parts without supports show very high variations in the soft component skin thickness (which forms the injection-molded body), i.e. the base body may shine through the injection-molded body or even lie on the surface.

The corresponding free spots (i.e. those parts of the base body not covered with soft components due to the supports in the injection mold or open points in the injection-molded body of the working tip) are arranged around the working tip, especially at the sides and at the top. The open points (small, circular or elliptical point recesses) in the injection-molded body preferably have a round shape (circular or elliptical).

Preferably, the front two thirds of the length of the working tip are provided with lateral and/or upper supports. Seen in the direction of the longitudinal axis, the distances between the upper supports are preferably shorter towards the free end.

The lateral supports are preferably positioned in the central area (i.e. in the direction of the longitudinal axis of the working tip). The lateral supports are also preferably positioned opposite each other.

Preferably, the number of upper supports is greater than the number of lateral supports.

The lateral supports are overmolded with the soft component (the second plastic component) so that they are flush, i.e. the lateral supports are flush with the injection-molded body. The injection-molded body thus has corresponding openings for the lateral supports, through which the lateral projections (from the first plastic component) are visible. The lateral supports support the cleaning effect, since the soft component in the environment deforms more than the supports from the hard component when cleaning under pressure. This creates further cleaning and polishing agents from the material which forms the base body. The soft component in their environment supports a continuous, "soft" transition to the supports.

The upper supports of the base body in the area of the working tip are preferably formed flat on the base body with corresponding, preferably small point-shaped openings or holes in the injection-molded body. These blind holes consist of a hard component (which is formed from the base body) at their base and associated side walls of a soft component. The geometry of the openings or holes is determined by the geometry of the holding pins in the injection molding tool, which are overmolded with the soft plastic component. Preferably, a round or elliptical punctiform cross-section is provided.

Preferably, the base body has 1 to 6, preferably 2 to 4, upper supports in the area of the working tip.

Furthermore, the base body has 1 to 6, preferably 1 to 3 lateral supports in the area of the working tip (i.e. on each side).

The dimensions of the upper supports are as follows: The length (i.e. measured in the direction of the longitudinal axis) is from 0.2 mm to 1.5 mm, preferably from 0.3 mm to 0.7 mm, the width is from 0.1 mm to 1 mm, preferably from 0.15 mm to 0.4 mm.

The dimensions of the lateral supports are as follows: The length (i.e. measured in the direction of the longitudinal axis) is from 0.2 mm to 1.5 mm, preferably from 0.3 mm to 0.7 mm, the width (perpendicular to the longitudinal axis) is from 0.1 mm to 0.5 mm, preferably from 0.12 mm to 0.3 mm and the height (front to back on the axis) is from 0.1 mm to 0.8 mm, preferably from 0.2 mm to 0.5 mm.

In a further preferred embodiment of the present invention, a recess (several separate recesses are also conceivable in principle) is made in the underside of the base body in the area of the working tip. The recess serves to keep the tip of the base body centered after the tip has been repositioned (i.e. during overmolding with the second plastic component). In this respect, the recess is the counterpart to the aforementioned supports and interacts with them (i.e. in particular with the upper supports). The recess is usually shaped like a groove. The recess also makes cleaning easier, as there is less contact with the gums and less friction.

For easy insertion into the injection molding cavity of the injection-molded body, the grooved recesses in the base body have a radius at their outer edge which can vary in length due to the shape of the recess. This radius is between 0.01 mm and 1 mm, preferably between 0.03 mm and 0.2 mm.

The length of the recess (or groove) is between 10 mm to 25 mm, preferably between 12 mm to 20 mm (i.e. in each case matched to the total length of the working tip). The depth of the recess is from 0.03 mm to 0.8 mm, preferably from 0.05 mm to 0.2 mm. The width of the recess ranges from (a maximum of) 0.1 mm to 1 mm, preferably from 0.3 mm to 0.6 mm.

In another preferred embodiment of the present invention, an additional working tip is arranged at the end of the holding section opposite the working tip. This can increase the variability or the application possibilities of the applicator device. The additional working tip can also be used as a working tip for products such as twisted-in interdental brushes.

The additional working tip can comprise a pincer-shaped plastic element made of hard and/or soft material with two gripper jaws and one opening, whereby the gripper jaws can preferably have inwardly directed cleaning elements or bristles. This additional working tip can, for example, be inserted between the gum and the implant and is used to brush off the implant or its anchor, or it can be used as a different cleaning or application element.

In a further embodiment of the present invention, the additional working tip comprises a brush-shaped or fan-shaped cleaning element made of hard and/or soft components or of one or more bundles of bristles. The end of the fan-shaped working tip can be convex or concave. The fan can have a flat or 3-dimensional (e.g. accordion-like, curved, etc.) base body. This embodiment is especially useful as an additional means for cleaning the tooth margin or interdental spaces.

The bristle bundles (consisting of bristles) used in one embodiment may be conventionally extruded bristles or injection-molded bristles consisting of an injection-molded bristle material or soft component (e.g. the same soft component from which the injection-molded body is formed). One, two, three or more bundles may be used. The bundle(s) can be, for example, of a fan-shaped, cylindrical, or curved shape.

The additional working tip can further be provided in the shape of a toothpick or a polishing element. The toothpick or polishing element is preferably made of the hard component, but it can also be completely or only partially covered with the soft component or consist entirely of soft components. The polishing element can be designed with a blunt end as polishing surface. Especially for a polishing element, the soft material can be provided with abrasive particles. The polishing element may have a polishing edge that allows for precise application.

The polishing element can be molded onto the base body or mounted in a form-fitting and/or friction-locked manner, preferably without being detachable. The attachment of the polishing element can also be achieved by deforming the base body and creating a positive and/or frictional connection.

Instead of the additional working tip, a holding section extension can also be provided at the rear end of the holding section. This provides an enlarged grip surface and thus a higher gripping comfort for the user.

Instead of the additional working tip, a suction cup or stand can also be provided at the rear end of the holding section to allow the applicator device to be positioned vertically. The suction cup or stand is made of hard and/or soft material. The axes of symmetry of the stand or stand means are preferably parallel with the longitudinal axis of the working tip. The two axes can be congruent or slightly offset. In another embodiment, the axis of symmetry of the stand or stand means forms an obtuse angle with the longitudinal axis of the working tip.

In another preferred embodiment of the present invention, the holding section and/or the neck section is inscribed and/or printed. This can be used to provide a trademark notice, a visual effect or an operating instruction which makes the application easier for the user.

During injection-molding the inscription is preferably produced with a corresponding design of the injection mold (laser, inkjet or pad printing are also possible) and is raised or recessed in the base body and/or in the area around the second plastic component (injection-molded body), so that it is directly legible. Further preferably, a second component is injected around the actual lettering—which in this case was realized as a component of the base body—(i.e. the second component flows around the lettering), which improves readability.

If laser, inkjet or tampon printing is used as the inscription method, this is preferably applied to the base body holding section or the platform of the base body. The imprint is applied to one or both sides of the base body holding section. It is also conceivable to use these methods for inscribing the injection-molded body. Hard and/or soft materials can be printed. Preferably, the printing is applied to the top side.

Preferably, the inscription and/or printing has a length of 5 mm to 20 mm, preferably 7 mm to 12 mm, and a width of 2 mm to 15 mm, preferably 3 mm to 8 mm.

In another preferred embodiment of the present invention, a color pattern is printed on the area (injection-molded body) overmolded with the second plastic component, preferably on the holding section. In this way, certain elements in the holding section area can be highlighted.

Generally, products with several components can also be printed. This creates an optic with several components. The printing can be applied in one or more work steps on different materials on the base and injection-molded body.

Preferably, the printing medium is provided with an additional function besides the color. For example, the printing medium can have a taste or a material that is effective for oral hygiene. In this case, the printing is preferably applied in the area of the application and cleaning elements of the injection-molded body and/or on the base body.

The printing is preferably applied directly at the injection molding machine. The processes are coupled via the cycle time, i.e. the injection-molded cleaning or applicator devices are printed inline, preferably without buffer aids.

In another preferred embodiment of the present invention, the working tip has a multi-zone structure ($Z_1$-$Z_n$). Thus, the working tip may have one or more zones with abrasive elements (e.g. lateral lamella-shaped or vertical roof-shaped abrasive elements). In addition, zones with bulge-like profiles of the vertical and horizontal cleaning elements as well as the lamella-shaped cleaning elements can be provided. Zones with arrow or umbrella-like profiles of the vertical and horizontal cleaning elements as well as the lamella-shaped cleaning elements are also conceivable.

The zones can be ring-shaped or extend in the longitudinal direction of the working tip. Each zone can have different cleaning elements. Several zones can have the same cleaning elements. Preferably, the working tip is divided into possibly two, three, four or five such zones, whereby the zones which deviate from the usual triangular design are preferably arranged in the center area of the working tip. This means that with three zones Z1, Z2 and Z3, zone Z2 would preferably be the deviating zone. In the case of five zones Z1, Z2, Z3, Z4 and Z5, zones Z2, Z3 and Z4 would preferably be the deviating zones. Different soft or hard components can be used in different zones. Different colors of the plastic components can be used in different zones. In different zones, different agents can be added to the plastic components (e.g. abrasive agents, odorous substances or flavors, etc.). The different zones can be printed differently (e.g. different colors, additives, etc.), whereby zones without printing are also taken into account.

In another preferred embodiment of the present invention, the working tip has a shape that is not straight. The preferred shape of the working tip is slightly bent or curved in the side view with a slight inclination and with a stronger decreasing thickness approximately in the center area. Another preferred variant is a wave or snake-like shape of the working tip in top view, whereby the working tip tapers conically in side view, as before. The individual waves of the snake can reach an increasing size from the tip (the increase can be linear or at least in some areas with an increasing or growing gradient when viewed from the tip in the longitudinal direction). Also the distances between the wave crests can increase from the top.

In a preferred variant of the method according to the invention, a repositioning element of the tool engages in a recess of the neck section of the base body during repositioning, whereby preferably the recess is undercut. In this way, the base body can be held securely during the repositioning process. The recess also allows saving a material on the base body. Thanks to the essentially U-shaped cross-section in the neck section, stability in this zone can be maintained despite the recess. The recess can also take another shape. The recess and its associated edges can be used as an additional cleaning element for mouth, palate and tongue.

Alternatively, the outer geometry in the neck area can be undercut. This means that the shape separation is designed on the body in such a way that an undercut geometry is created on one side of the shape.

The undercut geometry has an angular deviation of 0.1° to 3° in the opening direction, preferably from 0.2° to 2°.

In a further preferred variant of the process according to the invention, the base body (bodies) is (are) held on the upper side and on the lower side by one or more holding elements of the tool when the second plastic component is overmolded.

Further preferably, the base body (bodies) are additionally held by lateral projections of the base body in relation to the tool.

Preferably, one injection point per comb is provided for the first plastic component (i.e. the hard component for the base body). A comb consists of several, preferably six, adjacent applicator devices. A comb may also consist of 2, 3, 4, 5, 7, 8 or more applicator devices. However, it is also possible to provide an injection point for each, every second or every third applicator device. Preferably, this injection point is positioned in the holding section area at the rear end. Preferably, the injection point is located on the upper side of the holding section, but it is also possible to position the injection point in the mold parting line or on the underside of the holding section. The hard component forms the connection between the individual applicator devices.

The injection point of the hard component is preferably covered later by the soft component of the injection-molded body.

For the second plastic component (i.e. the soft component) one injection point per applicator device is preferably provided. However, one injection point for the soft component may also be provided for the whole comb or for each, every second or every third applicator device.

The position of the injection point is preferably at the rear end of the holding section. The soft component preferably covers the injection point of the hard component (if present on the applicator device). In the preferred variant, the soft component does not extend beyond the connection between the individual applicator devices. Unless a separate injection point is provided for the soft component for each applicator device, it is suggested that the connection of the applicator device be made of hard and soft material.

Further general aspects and features of the invention are described below:

Holding Section

The holding section preferably has a two- or multi-component structure (consisting of two or more hard and/or soft materials). The base body in the holding section is formed from the first plastic component (i.e. the hard component). Particularly preferred, the holding section is to be rigid only where absolutely necessary. For this purpose, one or more recesses are provided in the base body, at least in the area of the holding section. The recesses are then at least partially filled with the soft component. However, especially in the holding section, additional concave zones may remain on the upper or lower side despite filling with soft components. In contrast to the zones filled with soft components, the concave zones in the hard material have no sharp edges. Furthermore, it is also possible that concave zones remain after the soft component has been applied. To save material, the holding section can have recesses in the base and in the injection-molded body. These recesses can take up a substantial part of the area of the holding section. For example, these recesses can occupy up to 25%, preferably up to 35% and especially preferably up to 70% of the area of the holding section. The soft component and/or the hard component can form the edges of the recesses. The corresponding material savings result in shorter cycle times. Further preferably, the entire base body is only designed as rigid as necessary. In addition to the material savings and the cycle time reduction, a particularly flexible product can also be obtained in this way. Flexible zones can be placed inside or at the front end of the holding section.

The second plastic component, in any case at least partially injected in the area of the holding section around the base body, is preferably formed from a soft component and forms the injection-molded body.

The soft component is preferably applied flat on one side (i.e. the upper or lower side) of the base body holding section and only partially on the other. Preferably, the upper side is provided flat with soft components, while the underside carries a smaller proportion of soft material, but has one or more concave zones in the hard component. Preferably, the soft component is only partially applied to the underside of the base body holding section. This can be in the form of a band, line or loop or with looping (e.g. of raised areas of the hard component). The application can be symmetrical in relation to the longitudinal axis—but not symmetrical in relation to the top and underside.

This type of soft component application (the upper side is easy to distinguish from the underside, i.e. the upper and lower sides are not symmetrical) allows the user to recognize the intended orientation, i.e. which side of the holding section should be at the top or bottom, etc. immediately. This is particularly advantageous if the working tip is not circularly oriented, e.g. has a triangular shape and not all three sides have the same friction or cleaning properties. In other words, the non-symmetrical design of the upper or lower side in relation to the longitudinal center plane of the product gives the user the orientation of a non-symmetrical working tip.

Further preferably, the holding section includes elements to improve the grip. These elements may be integrated in the hard and/or soft component.

Particularly preferred surface structures or elements include nubs, ribs (the ribs may be in the form of straight bars or they may be at an angle to each other, e.g. in the form of a boomerang etc.), grid structures (e.g. in the form of grids and/or interlocking structures, such as circles or polygons etc.) or lettering, which can also be used as elements to improve grip in the holding section. The elements are preferably arranged symmetrically in relation to the longitudinal axis of the holding section.

Preferred dimensions of the surface structures include a height of 0.2 mm to 2 mm, preferably 0.25 mm to 0.6 mm, a width of the structural surface of 2 mm to 10 mm, preferably 4 mm to 7 mm, and a length of the structural surface of 4 mm to 16 mm, preferably 6 mm to 10 mm.

The surface structures can be applied on one side (top or bottom) or on both sides (top and bottom). Preferably they are arranged on the top side.

The surface structures can be realized in the hard component and/or the soft component, for example in both components on one side or approximately at the top in the soft component and at the bottom in the hard component, or vice versa. Furthermore, surface structures can be incorporated in the hard component, which are only covered with a balancing, thin layer of soft component and only become noticeable/visible when held by the user.

The surface structures can be the same or different at the top and bottom. The individual elements, which are preferably arranged in element fields, can also be the same or different.

In terms of production, the surface structures or elements can be formed either directly in the hard and/or soft component (i.e. in the injection molding process) or by gluing (e.g. by sticking on sandpaper or the like) or by dusting on a layer of glue.

In addition, a cavity or concave bulge can be molded into the retaining section (preferably in the upper side, or also in the lower side). In this way, an ergonomically favorably shaped support for the thumb is created.

The center of the surface structures or element fields is preferably positioned in the center of the holding section.

Surface structures, edges and radii in the holding section or neck section can also serve as tongue cleaners.

The holding section may also have a bend as well as a generally enlarged holding surface, i.e. the entire holding area is bent and offers space for two fingers on at least one side—instead of just one. The bend is designed in such a way that it supports holding with the fingers. For example, that the device can be held with three fingers, allowing the tip to be inserted into the interdental space in the optimal direction. The bend is preferably designed perpendicular to the plane of the vertical cleaning elements, so that, for example, the thumb, when in use, lies in the bend or the resulting cavity and the other two fingers (for example, the index finger and middle finger) provide the counterpressure to hold it in the cavity.

In a preferred variant, the holding section can be formed entirely from the soft component and only the neck section and working tip from the hard component. In this way, a particularly high degree of flexibility can be achieved. Furthermore, only zones of soft component can be provided.

Furthermore, the holding section can also have a handle for an applicator device comprising an elongated handle body with a cavity surrounded by a wall, which is characterized in that the handle body is constructed in one piece and the wall has at least two recesses passing through it, which are arranged offset to one another and have openings into the cavity, i.e. the holding section is constructed relatively voluminously and consists of little material. Forming is preferably carried out in the hard component, whereby good stackability is achieved, since the structures can be inserted into one another. The cavities can be partially or completely filled with soft components. This design allows a particularly flexible holding section.

However, it is also conceivable that at least partial forming in the soft component is possible, which results in compressibility. This means that the structure of the holding section adapts to the gripping pressure of the user.

In another preferred design, the holding section has a hard core over which the soft structure is stretched The holding section can further be equipped with a very soft zone (continuous recess in the holding section in the hard component which is filled exclusively with soft component) in the center, i.e. the holding section is designed as a frame with a membrane-like soft center which adapts to the finger structure when gripping and can therefore absorb misdirected forces.

Further preferably, the retaining section may be convex in the center or at one end, i.e., for example, ball or spherical or ellipsoidal, whereby the ball or spherical or ellipsoidal shape may be formed from the hard component and/or from the soft component. In this way, a navigation element is created which ensures better maneuverability of the applicator during application. However, the entire holding section can also be formed as a ball, ellipsoid or ball or the like.

In another preferred embodiment, the retaining section can be designed to be foldable (stowable). This makes the product even smaller or less long. For example, the product is folded or unfolded for use and locked in an end position. A film hinge can be provided in the hard component in the longitudinal or transverse direction, which divides the applicator into two or more parts. The parts of the applicator thus created can preferably be locked together in their intended position of use. The advantage of this embodiment is a smaller package, while at the same time maintaining a good functional capability. The hinge zone can consist of hard and/or soft components.

The holding section can also have other functionalities. For example, a scraping edge can be provided, preferably at the rear end of the holding section—i.e. the end opposite the working tip. The scraping edge can be formed in the hard and/or soft component. Other oral hygiene functions may also be provided with the retaining section or at the rear end of the retaining section, such as a tongue cleaner or a cleaning lamella for the gum line (which is preferably designed like the tip of a slotted screwdriver). In addition, beauty functions, such as a cuticle slider, are also conceivable as functional parts at the rear end of the holding section.

In a further preferred embodiment of the present invention, an additional working tip with functionality is preferably provided at the rear end of the holding section (or within the holding section).

The additional working tip is formed in the hard and/or soft component. It can be designed so as to be detachable from the retaining section, to be folded out of the retaining section and/or to be lockable with the retaining section or to be permanently exposed on the retaining section (preferably at the rear end in each case).

The additional working tip can include as further functions, for example, a toothpick, floss, a polishing element or a navigation element (i.e. so that the retaining section can be better guided in the hand, as already described above).

The holding section or the neck section adjacent to the holding section may not be symmetrical with respect to the top and bottom. The retaining section or the neck section adjacent to the retaining section may be symmetrical with respect to the longitudinal axis.

Regularly arranged supports (depending on the shape and size of the hard and soft components) are provided as an aid during production. The supports preferably have a point-shaped or cylindrical geometry, which lies on the surface of the base body in the end product. Lateral supports are also preferably provided.

The lateral supports are preferably protruding, i.e. approximately pin-shaped. The supports create visibly flat surfaces in the end product. The design of the upper supports in particular is preferably planar in the base body, i.e. there are visible recesses in the injection-molded body or the casing. In addition, it is also conceivable that the supports are designed as groove-shaped recesses.

Neck Section

The neck section generally represents the connection element between the holding section and the working tip. It is particularly preferred that the neck section has at least one channel for the inflow of the soft component from the holding section to the working tip (i.e. from the corresponding injection point in the holding section).

The neck section also provides the geometry for the repositioning from the first cavity (where the base body is produced) to the second cavity (where the injection-molded body is produced) in the injection molding tool. This can be provided, for example, in the form of a preferably undercut recess (essentially U-shaped cross-section) in that part of the neck section in which no soft component is applied. Preferably, this zone is located on the opposite side of the channel with soft component. Another preferred feature of the cervical segment is its flexibility (i.e. in the cervical segment itself), with simultaneous stability. The whole neck section can also be elastic. To achieve the desired flexibility there are basically different possibilities.

On the one hand, the flexibility can be achieved over the respective material thicknesses. Film hinge-like structures can also be provided in the neck section. Furthermore, a resilient element can be provided in the neck section, for example in the form of an accordion-like structure. The flexible structures mentioned above are particularly preferred at the transition to the working tip, where they act in the form of a predetermined bending point. Another possibility are recesses in the hard component, which are filled with soft component. Here, recurring recesses can be provided (e.g. several recesses transverse to the longitudinal direction of the neck section).

Further preferably, with regard to an optional lip massage and/or gum massage at the neck section, various elements such as nubs, surface structures, surface roughness etc. can be arranged. When used, these elements "grind" the mouth tissue and massage it in the process.

Furthermore, it is possible to form a tongue cleaner in the neck section, at best partially into the working tip or even from the holding section to the working tip. The tongue cleaner can, for example, be designed in the form of protruding structures made of soft components such as lamellae, nubs or bristles, which are, for example, oriented in the same way as the horizontal cleaning and application elements. The tongue cleaner can also be designed as a scraping edge/lamella made of hard and/or soft components, which continues as mentioned above. With the curved shape of the applicator device, in particular the interdental cleaner, the lamella or even the tongue cleaner edge is preferably located in the bend or bulge inside. In addition, the scraping edge can also be provided with the above-mentioned structures such as lamellae, burls or bristles.

Working Tip

The working tip also preferably comprises functional elements or combinations thereof.

In one preferred embodiment, the base body tip (consisting of hard components) is covered only with an essentially smooth surface of soft component (coating), but has no cleaning or other structural elements. The working tip acts as a kind of toothpick with a soft surface (made of soft component).

In another preferred embodiment, nubs made of the soft component are formed on the working tip.

In addition to or independent of the nubs, bristles made of soft components on the working tip are particularly preferred. The preferred orientation and preferred cross-sectional shapes are discussed below.

In a further embodiment, the bristle ends can have a bouquet-like design (i.e. each bristle has several ends). Furthermore, lamellae are preferably arranged at the working tip (i.e. usually between the bristles as polishing lamellae to thoroughly remove both food debris and discoloration). The molded elements of the working tip can also have a different surface roughness than the soft component coating of the working tip. Preferably, the molded elements of the working tip have a higher surface roughness than the coating. The different surface properties result in different coefficients of friction.

Other general characteristics of the working tip are described below.

Preferably, for safety reasons, i.e. in particular to prevent injuries, the tip of the base body is covered with a soft component in the foremost area. The foremost area of the base body tip (foremost tip) in particular is covered all around with a soft component. The soft component forms a kind of cap over the hard component. The length of this foremost tip is preferably in the direction of the longitudinal axis from 0.1 mm to 3 mm, preferably from 0.2 mm to 1.5 mm.

The transverse cut of the working tip is in the base form (circular) round, elliptical or n-angular, preferably triangular. In the triangular form, an asymmetrical design is preferred, i.e. only two of the three sides have a surface made of soft component and cleaning elements made of soft component. The triangle formed becomes equilateral or at least isosceles. The third side defines an empty space (i.e. is not occupied by cleaning elements), which is advantageous for the insertion of the working tip, as the retraction can take place without resistance and the working tip can be turned without any problems, so that the cleaning effect can be optimized. For square cross-sections, it is preferable that the opposite sides are unoccupied. With five- and polygonal cross-sections, the empty spaces are preferably arranged alternately.

In principle, however, the cleaning elements can be arranged in all directions (and on all sides) of the preferably triangular-shaped working tip. However, even for round, oval or n-angular cross-sections, empty spaces may be provided for the abovementioned reasons, preferably at opposite positions or in an alternating manner. Preferably, empty spaces and occupied sides form a symmetry (point symmetric to the longitudinal axis or mirror-symmetrical with respect to a longitudinal center plane).

In the triangular shape, for example, the underside of the working tip may be hard (i.e. made of hard component—not enclosed by the injection-molded body) and have a different color and/or different coefficient of friction and/or a different surface condition/surface roughness than the other sides. The underside then forms approximately a sliding surface, e.g. in the form of an essentially flat surface. This surface rests on the gums when correctly inserted into the interdental space. However, massage nubs or a massage structure (for example in the form of ribs or waves) can also be applied to the underside of the working tip to stimulate the gums.

With regard to the long shape of the working tip, it is noted that the geometry of the base body tip may have a different geometry than the injection-molded body. For example, the tip of the base body may have a corrugated shape and the injection-molded body may have a straight longitudinal section. This automatically results in different hardnesses in the working tip, without this being visible from the outside. However, the base body tip can also be straight and the coating can have a wavy longitudinal cut, whereby the different zones are effectively visible. In principle, the layer thickness of the soft component (apart from the molded-on cleaning elements) can be different in the longitudinal direction, but also in the circumferential direction, thus forming softer and harder zones.

In principle, the work can also be uneven overall (i.e. not even). Thus, the working tip (i.e. base body tip plus coating) may be snake-shaped, spiral-shaped or sickle-shaped or curved.

Preferably, the working tip will show a conical long shape.

The conicity can increase linearly from the tip (constant gradient) or increase disproportionately with increasing distance from the tip (gradient increases with increasing distance from the tip).

This is due to ergonomic reasons, because it makes it easier to drive into interdental spaces and can effectively clean different sizes of interdental spaces. Preferably, the working tip shows structures standing transverse to the longitudinal direction and structures not standing longitudinally. Alternatively, however, also longitudinally standing elements such as lamellae, wedges etc. are conceivable. Further preferably, cleaning elements like lamellas or bristles are arranged spirally around the working tip, e.g. in shape of lamellae or bristles.

Preferred embodiments have combinations of bristles and lamellae. For example, lamellae and bristles are arranged alternately in the longitudinal direction of the working tip. The lamellae are preferably arranged between the bristles in the form of wiper blades.

In addition to a generally conical structure or course of the working tip, a threading aid or insertion aid in the form of a fine tip at the free end without cleaning elements can also be provided (the fine tip can, however, have a coating of soft component or consist exclusively of soft component). After the fine tip, the first cleaning elements or bristles are arranged in the direction of the neck section.

In another preferred embodiment, the working tip has a multi-zone structure. Here the bristles are arranged towards the free end of the brush. The bristles are followed, viewed in the direction of the neck section, by a surface with a frictional function (e.g. in the form of abrasive paper or an abrasive or polishing element or a zone with a different surface finish, etc.).

Furthermore, several different zones (i.e. with different functionalities) may be provided, viewed in the direction of the longitudinal axis. First of all, a threading aid without cleaning elements can be provided, which is followed by a zone with bristles, for example, which is in turn, for example, followed by a zone with lamellae or differently formed cleaning elements, etc. Zones without cleaning elements or with only one polishing surface can also be provided.

However, zones may also be provided where a particular characteristic, such as the height, changes (e.g. zone 1:

height 1, zone 2: height 2, zone 3: height 1, zone 4: height 2). This can be the height of the cleaning element and/or the cross-section of the coating.

In addition, the foremost tip may have (additional) backward folding cleaning elements, whereby these cleaning elements are arranged in the manner of arrowheads towards or against the free end, thus forming a kind of arrow or umbrella. When passing through the interdental area, the cleaning elements then fold back, whereby the corresponding areas are better cleaned, especially when entering and exiting. When exiting, these elements fold up and provide a better cleaning effect.

However, zones with different hardnesses can also be provided, viewed in the direction of the longitudinal axis, i.e. soft and hard cleaning elements are arranged in zones one behind the other. Different hardnesses can be produced with different designs and/or different materials and/or different additives in the material etc.

Other variants or additional features of the working tip may include bumpers (i.e. buffers or stops) located at the rear end of the working tip (i.e. towards or adjacent to the neck section). The bumpers may for example be in the form of a sphere, an ellipsoid, a membrane, a wall, etc. made of hard and/or soft components adjacent to the neck section.

The purpose of the bumpers is to ensure that the working tip is not retracted too far into the interdental space; the bumpers thus act as stoppers, buffers or stops. However, it is also possible to have a double function together with increased flexibility (i.e. due to the soft component of the ball, it can also act as a kind of joint together with the base body). The bumpers are characterized by the fact that they form a larger diameter than the rest of the working tip and thus act as a stopper.

Further preferably, the working tip includes cleaning elements, which are arranged on bridges. The bridges can be attached to the body in the front as well as in the rear area of the working tip. The bridges are preferably arched and adapt to the contour of the teeth when inserted into the interdental spaces. A small recess can be provided between the bridges and the working tip.

At the transition from the neck section to the working tip, a non-spherical predetermined bending point or flexibility function can also be provided (i.e. a flexible section in the otherwise standard hard base body). Such a flexibility function ensures free mobility in use. In addition, a permanent bending of the neck section and/or the working tip can also be provided.

Another preferred feature is a discoloration of the working tip during use. This is caused by taste, indicator and/or oral hygiene agents present on the working tip being dissolved (i.e. waterless properties) during use and released into the environment. For example, the agents have been applied to the surface of the soft component or they have been integrated into the soft component as an additive or have been sprayed separately. This can be used to indicate that the applicator device needs to be changed.

In an alternative embodiment of the working tip, the tip has in any case over part of its length dental floss (for example a riser floss, i.e. a swelling dental floss) integrated in the applicator device. In addition, a sufficiently long piece of dental floss can also be integrated into the working tip to enable effective floss application. This means that the floss has one free end that is gripped with the fingers and the other end is attached to the applicator device. This allows the floss to be used as a holding device with the applicator device. A preferred length is at least six centimeters, further preferably at least eight centimeters. The dental floss is preferably fixed at the foremost tip.

In another preferred embodiment, an additional or second working tip is located at the rear end of the holding section. The additional or second working tip generally comprises one to three bristle bundles, which can be formed from injection-molded bristles (of bristle material) or from conventional, extruded bristles. Instead of or in addition to the bristle bundles, a cleaning element (TPE) or another soft component made of a thermoplastic elastomer must be located at the rear end of the holding section.

For all embodiments, the two working tips are preferably equipped with different cleaning elements and/or different surface finishes. Different materials can also be used for this purpose.

In another preferred variant, the additional or second working tip at the rear end of the holding section has a fan-like or curtain-like geometry with a fan-like or brush-like bristle. The bristles can be formed by a single bristle bundle (consisting of conventional, extruded bristles) (single tuft) or by several (smaller) bristle bundles arranged correspondingly to each other, which are arranged alone or connected as compartments.

In this way, elements for cleaning the interdental spaces and/or the tooth margin can be provided or elements for cleaning implants.

Further preferably, the working tip also shows flexibility. This can be provided in the form of a multi-part working tip, for example in which one part is permanently connected to the neck section and another part is designed to be bendable. For this purpose, the base body can have a thinner area in the area of the working tip (e.g. in the form of a film hinge), which provides the desired flexibility.

With regard to the preferred size ratios of the molded-on cleaning elements made of soft components, it is noted that the lamellae are generally less high than the bristles, i.e. they project less outwardly. The increase in length of the cleaning elements (seen from the tip) can be linear (constant slope) or disproportionate (slope increases more and more with increasing distance from the working tip).

In a preferred embodiment of the invention, the underside of the working tip or base body tip has a recess for centering in the injection mold. The centering tip is thereby formed as a continuous line on the underside of the working tip, whereby further preferably the respective (imaginary) extension from the holding pins of the tool, which is preferably placed on the upper side of the working tip or the tip of the base body, cuts the centering line.

In addition, lateral and/or upper supports of the base body or on the base body are preferably used as aids in the production of the injection-molded body. It has been found that a significant portion of the products without supports have missing lateral bristles. Therefore, for production and quality assurance, supports are necessary. In addition, all parts without supports show very high variations in the centering of the working tip and thus variations in soft component skin thickness (coating), i.e. the color of the base body may shine through the injection-molded body.

In general, it is mainly the front two thirds of the length of the working tip that are provided with the lateral and/or upper supports. Viewed in the direction of the longitudinal axis, the distances between the upper supports are preferably shorter towards the free end. In this way, a particularly uniform thickness of the injection-molded body can be ensured.

The lateral supports are preferably positioned in the central area (i.e. in the direction of the longitudinal axis of the working tip).

The lateral supports of the base body in the area of the working tip are preferably designed as cylindrical or pin-shaped projections, i.e. the lateral supports are part of the base body made of hard component and project laterally from it. The lateral supports are overmolded flush with the surface of the soft component, i.e. the lateral supports are flush with the injection-molded body. The injection-molded body or the plastic component that forms the injection-molded body thus flows around the supports in the process, so that the injection-molded body has virtually corresponding openings for the lateral supports.

The upper supports of the base body in the area of the working tip are preferably flat with corresponding, preferably point-shaped openings or holes in the injection-molded body or the working tip. The geometry of the openings or holes ultimately depends on the geometry of the holding pins in the injection mold tool, which are overmolded with the soft plastic component. Preferably, openings or holes are designed circular, elliptical or n-angular.

In one variant, the injection of the soft component (possibly together with the geometry of the holding elements or holding pins of the tool) can be designed in such a way that the soft component film over the base body is continuously formed in the end product, i.e. that no empty spaces or openings or holes remain in the injection-molded body or at the working tip. The support points are thus covered with a soft component film. For this purpose, the support pins can be pulled (back) during the injection molding process and the support point can thus be covered with soft component with a slight delay.

Product Range

With regard to a variable design of the product portfolio, the applicator devices can be manufactured in a correspondingly modular tool in combs (preferably 6 pieces each) with the same holding and neck area in each case, whereby only the working tip changes. This has the advantage that in the neck section the repositioning system (in the tool from the hard component to the soft component) can be left for the production and only the (partial) cavities for the working tip have to be exchanged. Alternatively, of course, the holding section and/or the neck section can also be replaced. The three modules of the injection molding tool are detached by means of inserts. Ventilation is provided at the separation points. The separation or ventilation points (also called separation seam) are visible on the applicator devices in the hard component and/or soft component. They are each located in the area of the transition points from the holding section to the neck section and from the neck section to the working tip.

Only the soft component or only the hard component can be changed or both the hard and soft components.

Furthermore, different diameters related to the hard component and/or soft component and/or the cleaning elements and/or the length of the cleaning elements (at the same points of the working tip) can be achieved, whereby the different diameters can also result in different degrees of hardness for the working tip (e.g. "soft" or "medium").

Preferably, the working tips can also be of different lengths.

By using different (material) components (see below) different degrees of hardness can be achieved with the same shape of the working tip.

A preferred size includes examples of a smaller product ("size 1"):

Diameter of the working tip $D_1$ (measured on soft component, without cleaning elements) at the free end: 0.75 mm; diameter of the working tip $D_2$ in the area of the last cleaning elements on the neck side: 1.4 mm;

Outside diameter of the working tip $D_3$ (with cleaning elements) at the free end: 1.5 mm; Outer diameter of the working tip $D_4$ in the area of the last neck-side cleaning elements: 3 mm.

Another preferred size includes examples for a larger product ("size 2"):

Diameter of the working tip $D_1$ (measured on soft component, without cleaning elements) at the free end: 0.75 mm; diameter of the working tip $D_2$ in the range of the last neck-side cleaning elements: 1.4 mm;

Outer diameter of the working tip $D_3$ (measured on cleaning elements) at the free end: 2.4 mm;

outer diameter of the working tip $D_4$ in the area of the last neck-side cleaning elements: 4.2 mm.

The following table shows the hole diameters which can be passed with the working tip for several different sizes of interdental brushes (mass in mm):

| Brush size | Passable hole diameter |
|---|---|
| 0 | ≤0.6 |
| 1 | 0.7 to 0.8 |
| 2 | 0.9 to 1.0 |
| 3 | 1.1 to 1.2 |
| 4 | 1.3 to 1.5 |
| 5 | 1.6 to 1.8 |
| 6 | 1.9 to 2.3 |
| 7 | ≥2.4 |

The design can also include that the change of the mentioned characteristics for the design of a product range is identical per comb and for example combs with design 1 and separate combs with design 2 are produced.

Connection Area to Further Injection Molded Applicator Devices

The injection molded devices are usually manufactured in groups of several adjacent applicator devices ("combs"). The connection area between the individual applicator devices is preferably in the holding section of the applicator devices. The strength of the connection is preferably chosen in such a way that the connection area can be easily separated and on the other hand the products are securely held together (both during production/during the process and later on at the consumer's). The connection is designed and dimensioned so that no sharp edges are produced by applicator devices after separation. In addition, the hard component should not be greater than the proposed E-module.

Viewed in the lateral cross-sectional view, the longitudinal extension of the connecting area is in any case greater than its extension in height. The connecting area is preferably oval or rectangular.

The connecting area preferably has a length of 1 mm to 6 mm, even more preferably from 1.5 mm to 4 mm. Furthermore, the connection area preferably has a height of 0.2 mm to 1.2 mm, more preferably from 0.4 mm to 0.8 mm.

The ratio of length to height is between 15:1 and 2:1, preferably between 7:1 and 3:1.

The distance between the applicator devices in the connecting area is preferably from 0.1 mm to 1 mm, even more preferably from 0.15 mm to 0.7 mm.

Measured from center to center (of the holding sections), the distance between the adjacent applicator devices is from 5 mm to 15 mm, preferably from 7.5 mm to 9.5 mm.

Combs from Applicator Devices

The applicator devices can be manufactured accordingly in combs, in which all applicator devices are identically designed or in combs in which there are variations between the individual products.

Thus, the individual applicator devices of a comb can differ in the shape of the working tip, the length of the working tip, as well as in the length of the entire product (i.e. one or more partial areas (working tip, neck section, holding section) of the applicator devices in a comb can have different dimensions). In addition, the individual applicator devices of a comb can have different colors (because, for example, the soft component is applied via separate injection points). It is therefore possible to offer combs with different applicator devices, so that the user can find out the right size (test combs).

Sets of combs can be formed as sales units, whereby identical or different combs can be bundled in these sets to form a sales unit. In this way, products with different characteristics can be sold with one sales unit.

Special Variants of Applicator Devices:

The applicator devices are provided with a label in a particularly preferred embodiment.

The inscription can be created during injection molding, for example, either raised or recessed in the base body or in the injected-molded body. The lettering is directly legible in this way.

An additional option is injection-molding, i.e. a second component flows around the actual inscription (which was realized as a component of the base body or the injection-molded body), which improves legibility. The lettering can be raised, flush or embedded in the surface.

In addition, the inscription can also be lasered onto the product, both on the hard component and on the soft component.

Finally, the inscription can also be printed, for example, using inkjet or pad printing. The printing is preferably done on the hard component and/or soft component.

It is also possible to apply an embossing (by means of an appropriate cliché using heat and pressure). This can be done with or without color/image foil.

The position of the embossing on the product can include the holding section and/or the neck area, depending on the process on the hard and/or soft component.

The size of the inscription ranges from 5 mm to 20 mm in length, preferably from 7 mm to 12 mm, and from 2 mm to 15 mm in width, preferably from 3 mm to 8 mm (generally depending on the process used).

The integration of the inscription step into the manufacturing process can be done directly in or after injection molding, after injection molding and before packaging or directly on the packaging machine (or during packaging). Preferably, the inscription is cycle-bound with the injection molding process (linked processes).

When printing, a color pattern can also be applied to the soft component (for example, on the working tip and/or the holding section). In this way, a visual effect can be achieved, for example by highlighting certain elements in the working tip (otherwise the tip would preferably consist of one component). Thus, visually, a further component is virtually created. A special function of a zone can thus be displayed.

An indicator can also be applied to the working tip to show the degree of wear (or, in the case of single use, that the product has already been used) of the device. The indicator dissolves with water during use and/or is rubbed off mechanically, i.e. when it is no longer present, the device has reached the end of its recommended service life.

Generally, products with several components can also be printed. This creates an optic with several components, for example in the holding section.

Preferably, the printing medium is provided with an additional function besides the color. For example, the printing medium can have a taste and/or smell.

In a further variant, the device can have a high-quality holding section (for multiple use) and the working tip together with the cleaning elements and, if necessary, also the neck section are all designed as interchangeable parts (refill).

In another variant, the device may have an extension of the holding section. In particular, a larger, more comfortable holding section can be provided. This is achieved, for example, by inserting the applicator device in a handle extension part/holding section extension. A preferred ratio of the length $l_4$ of the working tip to the length of the extended holding section $l_{2'}$ is between 1:13 and 2:7. The starting point for the calculation is a length of the working tip $l_4$ between 1 cm and 2 cm and a length of the holding section $l_{2'}$ between 7 cm and 13 cm. It is also possible to create an extension of the holding section (for multiple use), which in addition to the extension of the holding section also gives a larger holding surface, besides which the extension of the handle is rather unimportant. The handle extension part is equipped with a receiving area, into which the applicator device is inserted. The applicator device is guided with its working tip through a feed-through opening and then held in the area of the free end of the holding section of the applicator device with a fixing element or between the fixing element and a surface of the receiving area. An access opening is provided for forming the fixing element in the injection molding process. The handle extension part can be formed from either hard or soft components. However, the soft component design requires that the shape of the handle extension part together with the selected component form a stable support for the applicator device. Of course, other holding devices in the handle extension part for the applicator device are also conceivable. However, the secure engagement of the holding section on the base body and the exposed working tip are the prerequisites for all solutions.

In this second embodiment variant of the handle extension part, a preferred ratio of the length $l_4$ of the working tip to the length of the extended holding section $l_{2'}$, is between 1:6 and 2:4. The starting point for then calculation is a length of the working tip $l_4$ between 1 cm and 2 cm and a length of the holding section $l_{2'}$, between 3 cm and 7 cm.

As described, for example, an applicator device can be inserted into the holding section extension. The extension can also simply be a cover/protection device to the applicator device, into which the applicator device is inserted either with the working tip or with the holding section in front. Other functions can also be integrated into the holding section extension (e.g. a toothpick, toothbrush and/or tongue cleaner).

The cover/protection device protects at least the working tip. The cover/protection device can be injection molded in the same operation with the applicator device and be separated by the user before the use of the applicator device. The cover/protection device may be connected to the applicator device. They may be injection molded from hard and/or soft components in the same operation with the applicator device.

In another preferred embodiment, the holding section can also be designed as a mechanical part (e.g. extending the working tip by turning, pushing, flapping, whereby the holding section simultaneously fulfils a protective function).

The device can also have a multi-part structure, whereby the products can be separated. For example, a bayonet lock mechanism may be provided to connect the different parts, i.e. the individual parts are placed on top of each other at an angle and turned until the connection is made (similar to military cutlery).

A preferred combination consists of a flosser (tooth cleaning device with a piece of dental floss clamped between two hard material clasps) and an interdental brush. Either the flosser or the interdental brush is connected to the neck section.

More preferably, the applicator device comprises a stand or a suction cup, which is preferably attached to the end opposite the working tip.

The stand is a pure element for setting up the applicator device and can be formed from a hard and/or soft component.

The suction cup is an element for fixing the applicator device to a surface. The benefit of the above-mentioned additional functions is better drying and more hygienic storage (i.e. in comparison to a lying position).

In another preferred embodiment, fillers (e.g. in the form of additives) may be contained in or applied to the soft component, such as abrasive grains, flavorings, antibacterial substances (e.g. (e.g. silver elements), detergents (which are released during use), microspheres which burst during use (such as gelatin beads which dissolve with liquid and contain an active fluid in the core and are attached to the holding section or handle of an applicator device), blood stoppers, caries inhibitors and/or natural substances (such as chamomile).

The soft component can also be appropriately coated or printed or scented.

Injection Molding/Repositioning

For injection molding, a mold modularity can be provided, i.e. the injection mold can be designed interchangeably in the front (in the area of the working tip of the applicator device) both in the first and in the second cavity (resulting in different working tips for identical holding sections and/or different holding sections for identical working tips). In addition, the injection mold can also be designed so that it can be changed at the rear (this results in different holding sections for the same working tips).

The applicator devices can be manufactured as single pieces or as a comb (several pieces directly next to each other, connected), whereby the comb production is the preferred variant.

The injection points for comb production are described below.

For the hard component, there is preferably one injection point per comb, which is positioned in the holding section area at the rear end. The hard component forms the connection between the individual parts (or the individual applicator devices). The injection point of the hard component is preferably later covered by the soft component.

For the soft component, there is preferably one injection point per individual applicator device, whose position is in the holding section area at the rear end. The soft component preferably covers the injection point of the hard component. As a rule, the soft component does not extend beyond the connection of the individual parts.

With regard to the repositioning of the base body, the recess in the neck section is essentially U-shaped and undercut (so that applicator devices are fixed to the tool repositioning device). The geometry is injection molded in the first step and the undercut holds the body to the molded part and can be repositioned into the next cavity, for example. The undercut geometry has to be demolded at the end.

Packaging

The usual sales unit is based on a comb with 6 individual applicator devices, but it can also include 12, 24, 30, 36, 48, 60 or 72 pieces (or 2, 4, 5, 6, 8, 10 or 12 combs).

The combs are preferably packed in a box. The combs are preferably stacked. Preferably, a box contains 1 to 4 combs, further preferably 2 or 3 combs.

As a special feature, a mirror can be integrated in the box (e.g. in the form of a label). A shiny area can also be provided in the box, over which a transparent label is placed.

The label can also have a mirror on the first side and an advertising space on the second side and be placed in a transparent box.

However, the box can also simultaneously form the holding section or an extension of the holding section. This means that a single piece can be inserted into the box accordingly. In one variant, the holding section extension can be formed as a blister (visible packaging).

The box can also function as a dispenser, from which a single piece can be taken. In one variant, the applicator devices can be rolled up like a glue roller and pulled out piece by piece. The applicator devices can also be placed flat side by side in the box.

In another variant, the applicator devices are arranged in a fan-like manner in the box, whereby the fan opens when the box is opened and exposes the interdental cleaners (comparable to a drill packaging).

However, the individual interdental cleaners can also be packed in a pouch bag (i.e. loose in a bag).

In a further variant, a blister (visible packaging) instead of a box can be provided. In this case, a hard shell blister serves as a box (ecoblister). The blister can also be made up of several parts, so that only a single part can be taken along.

It is also possible to use a smaller box by folding the 6-piece strips once, i.e. the comb is not arranged flat in the box but folded up.

A resealable blister is also conceivable. A recess is formed in the blister and the back of the blister completely covers the blister. After opening the blister, the recess is exposed and a tab is provided on the box, which is still fixed in one piece, which can be inserted into the recess.

A medium, such as an interdental paste, can be provided as a further feature. The medium is preferably integrated directly into the packaging as a compartment, so that the cleaner can be dipped into the medium.

The medium can also be provided as an insert, such as in the form of a toothpaste tube. The medium can also be integrated into the product, e.g. in the protective cap. In addition, the product may also be packaged in such a way that the working tip is always in the corresponding medium when it is packed.

In another variant, a small travel case (for single pieces or a comb) is provided for easy carrying of the interdental cleaners.

In addition, swatch and/or haptic labels (e.g. rubberized) can be applied to the blister—for example to imitate the brush.

Furthermore, a forming tool can also be included in the box. In this case, the shape is created from straight bursts onwards, i.e. bent by the user himself.

Areas of Application

Areas of application for the present applicator devices generally include brush products for medical technology (applicators), cosmetics (mascara applicators, applicators) and oral hygiene.

For oral hygiene, a distinction is made between manual toothbrushes, interdental cleaners and a combination with flossers or with interdental brushes. The manual toothbrushes include reusable toothbrushes or replaceable toothbrushes, disposable toothbrushes and single tuft brushes.

Interdental cleaners include interdental brushes with twisted bristles, interdental brushes with injection molded cleaning elements as well as interdental cleaners with dental floss (flosser).

Cleaning Elements/Massage Elements/Polishing Elements

Cleaning and/or massage elements can be attached to the work tip and/or holding section. Cleaning and/or massage elements can be part of the working tip and/or the holding section.

As cleaning and/or massaging elements for the applicator devices at hand, conventional, extruded bristles are generally suitable at first. These are made of hard and/or soft components, pointed or cylindrical and preferably made of polyamide (PA) or polyester (PBT).

One component is produced by extrusion or, in the case of more than one component, by co-extrusion. In contrast to injection-molded bristles or rubber-elastic massage and cleaning elements, which are manufactured by injection molding, conventional bristles are extruded, cut, machined (e.g. rounded or pointed) and inserted at the holding section by means of adapted processes, such as anchor punching, Anchor Free Tufting (AFT), PTt or In Mold Tufting (IMT).

The longitudinal shape of conventional bristles can be cylindrical, pointed (i.e. chemically sharpened, especially for polyester bristles), corrugated or twisted or helical.

The cross-sectional shape of conventional bristles can be (circular) round, triangular, rectangular, square, elliptical, polygonal, trapezoidal, parallelogram-shaped or rhombus-shaped.

The dimensions for oral hygiene bristles preferably include a diameter of 0.075 mm to 0.25 mm and a surface area of 0.002 $mm^2$ to 0.2 $mm^2$.

The dimensions for cosmetic bristles preferably include a diameter of 0.025 mm to 0.2 mm and a surface area of 0.001 $mm^2$ to 0.15 $mm^2$.

The surface of conventional bristles can be smooth or textured.

The conventional bristles are usually grouped in bundles.

A tongue cleaner can be provided as a further element. This is preferably formed from a hard component and/or from a soft component and/or a combination of hard component and soft component and/or a component for injection-molded bristles.

The production of tongue cleaners is regularly carried out by injection molding.

Cleaning/massage elements can be provided as further elements. These are preferably produced by injection molding from a soft component.

Finally, injection-molded bristles can also be provided. These are injection molded from a component for injection molded bristles (examples are given below) (space brush).

Components

As preferred hard components (or hard material) styrene polymers such as styrene acrylonitrile (SAN), styrene polymers polystyrene (PS), acrylonitrile butadiene styrene (ABS), styrene methyl methacrylate (SMMA) or styrene butadiene (SB) are used here; or polyolefins such as polypropylene (PP) or polyethylene (PE) (for example, also in the form of high density polyethylene (HDPE) or low density polyethylene (LDPE)); or else polyesters such as polyethylene terephthalate (PET) in the form of acid-modified polyethylene terephthalate (PETA) or glycol-modified polyethylene terephthalate (PETG), polybutylene terephthalate (PBT), acid-modified polycyclohexylenedimethylene terephthalate (PCT-A) or glycol-modified polycyclohexylenedimethylene terephthalate (PCT-G); or else cellulose derivatives such as cellulose acetate (CA), cellulose acetate butyrate (CAB), cellulose propionate (CP), cellulose acetate phthalate (CAP) or cellulose butyrate (CB); or else polyamides (PA) such as PA 6.6, PA 6.10 or PA 6.12; or polymethyl methacrylate (PMMA); or polycarbonate (PC); or polyoxymethylene (POM); or else polyvinyl chloride (PVC); or polyurethane (PUR); or else polyamide (PA).

It should be noted that polyethylene (PE) can be used both as a hard component and a soft component. Similarly, polyurethane (PU) can be used both as a hard component and as a soft component.

Polypropylene (PP) is preferably used with an E-module, which is preferably between 1000 $N/mm^2$ and 2400 $N/mm^2$, and particularly preferably between 1300 $N/mm^2$ and 1800 $N/mm^2$.

The hard component is preferably used for/in stable, structure-supporting elements, for example in the base body holding section, in the base body neck section and/or in the base body tip.

If several hard components are used, they can be joined by two or multiple-component injection molding or by ultrasonic welding, in which case the hard components used preferably form a material bond with each other.

Alternatively, several hard components can be used, which do not form a material bond in two- or multi-component injection molding. In these pairings, a form fit is provided (for example, by means of undercuts and/or breakthroughs and/or partial and/or complete injection-molding, etc.). The second injection-molded hard component then shrinks onto the first injection-molded hard component as it cools, thus forming a shrinkage joint. Examples of possible hard component pairings which do not form a material bond are polypropylene-polyester, polypropylene-styrene-acrylonitrile, etc.

The soft components used preferably form a material bond with the hard components by means of injection molding in a two- or multi-component injection molding process. In this respect, thermoplastic styrene elastomers (TPE-S) are preferably used, such as a styrene-ethylene-butylene-styrene copolymer (SEPS) or styrene-butadiene-styrene copolymer (SBS).

Other preferred soft components are thermoplastic polyurethane elastomers (TPE-U), thermoplastic polyamide elastomers (TPE-A), thermoplastic polyolefin elastomers (TPE-O), thermoplastic polyester elastomers (TPE-E) or silicones.

It should be noted that polyethylene (PE) can be used both as a hard component and a soft component. Similarly, polyurethane (PU) can be used both as a hard component and as a soft component.

The soft components (or soft materials) preferably comprise thermoplastic elastomers (TPEs) with a Shore A hardness of less than 90, preferably less than 50, particularly preferably less than 30. Injection-molded bristles are produced by injection molding, unlike conventional extruded bristles.

The preferred component for injection-molded bristles (or bristle material) is a thermoplastic polyurethane elastomer (TPE-U). Compared to the standard TPE-U, this material has in particular better flow properties and faster solidification (i.e. faster crystallization and molecular chains connect already at high temperatures).

Thermoplastic polyester elastomers (TPE-E) or thermoplastic polyamide elastomers (TPE-A) are considered as alternative materials.

The components for the injection-molded bristles are preferably thermoplastic elastomers which have a Shore D hardness of 0 to 100, preferably 30 to 80. For injection-molded bristles, special forms of soft components are used, which usually have higher Shore hardnesses than soft components from which soft elastic cleaning/massage elements or holding covers or tongue cleaners are made.

During the injection molding process (two- or multi-component injection molding), the components for the injected bristles do not normally form a material bond with the other soft and/or hard components used. Consequently, a form fit is provided for possible connections with other hard and/or soft components (for example, through undercuts and/or openings and/or partial and/or complete injection molding, etc.), which as a second injection-molded component for the injected bristles shrinks on cooling to the first injection-molded hard or soft component, thus forming a shrinkage connection.

Abrasive particles can be added to the soft component or the component for the injection-molded bristles. For example, chalk or diamond dust can be used. The soft component or the component for the injected bristles can also contain an anti-grip or non-stick additive, such as antistatic agents, Teflon or silicone. This additive is intended to improve demolding in the injection mold. Furthermore, this additive should also be effective against the adhesion of toothpaste.

However, bioplastics can also be used in the production of the applicator devices, i.e. plastics that consist of or are formed from renewable raw materials, such as corn, hemp, sugar, castor oil, palm oil, potatoes, wheat, sugar cane, rubber, wood and/or castor plant/wonder tree.

These raw materials consist at least partially of the basic materials cellulose, starch, lactic acid (PLA), glucose, chitin or chitosan.

The use of waterless polymers is also conceivable in principle.

The soft component can be provided with a filler or an additive, which has a cooling effect. The filler preferably has a low volatility and is not menthol-based. Furthermore, of course, it must be food grade, so that it can be applied in oral hygiene without any problems.

The filler itself with a cooling effect is preferably tasteless and only has a cooling effect. This filler can be used together with other fillers with taste to achieve the desired effect in combination. The cooling effect supports the further taste.

In terms of application, the filler is compounded and used like a masterbatch as an additive during the injection molding process. This means that the filler is added in a carrier plastic to make it ready for processing. This carrier plastic is then dosed according to the desired effect. The carrier plastic can also directly be the plastic to which the additive is added.

The prerequisite for processing in this way is that the filler is thermally stable and does not suffer any damage during processing in the compounding and injection molding process or that no fission products are produced that would be critical.

In the compound, the proportion of filler is between 3% and 50%, preferably between 5% and 30%.

The filler with a cooling effect can, for example, be a cooling agent such as WS 3, WS 5, WS 23 or even WS 32. Extensive tests have shown that these fillers have a positive effect on the user and that he uses the applicator devices more often.

Fillers differ, for example, in the place of action (for example, sensation only at the front of the tongue).

In principle, the filler with a cooling effect can also have an indicator function, so that it is dosed in such a way that its effect diminishes after a certain time. This time is set in such a way that it indicates the change of the applicator device or toothbrush, i.e. the release of the filling material takes place over a defined period of time, e.g. 2 to 3 months for a toothbrush. The reduction of the effect is not linear, i.e. uniform over time. The effect is stronger at the beginning of use and then weakens over time. This reduction is graphically imagined similar to an asymptote.

The filler dissolves from the material and/or from the edge of the material when touched or in contact with water. The filler is quickly available, because it is at least partially on the surface.

By applying the filler in the soft component, it is possible to achieve a refreshing effect with a disposable product, both with an applicator device and without additional oral care products such as toothpaste or mouthwash.

In principle, the filler can also be added to the hard component. The position on the product containing the material component (hard and/or soft component) with the filler can vary. The preferred application is in the area used for cleaning, i.e. the neck or head area. In the grip area, an application can also be made, but the effect is then different or will act on a different part of the body.

The applicator devices, in particular a toothbrush, can have several soft components, whereby only one of the several soft components is provided with the above-mentioned filler. In particular, it is suggested that the filler should not be applied to the soft components in the handle area, as contact with the mucous membranes outside the oral cavity could cause contact with the filler.

Several soft materials can also be used in the area of the working tip of the application device or in the area of the brush head of the toothbrush. It is possible to use only one soft material with the filler. For example, a tongue cleaner on the applicator device or on the back side of the bristle head of a toothbrush can be provided with the filler, whereby soft elastic cleaning elements made of soft material in the bristle area are free of the filler. Of course, several soft materials in the area of the working tip of the applicator device or in the area of the bristle head of the toothbrush can also be provided with the filler.

The filler can also be used in one of the described additional functions of the application device or toothbrush.

As mentioned for the toothbrush, the filler can also be used in a pure tongue cleaner.

It is also possible to incorporate the filler separately or additionally into the bristle material for injected bristles.

The filler can have an additional effect or indication with the intended toothpaste.

Processes/Manufacturing Process

Injection Molding

Injection molding is preferably carried out in multi-component injection molding, whereby the components either join together in the form of a material or material bond, or a form closure is produced (for example in the form of a shrinkage connection, possibly with the possibility of movement by means of a joint), so that the components do not join together.

Injection molding can be carried out in a hot runner or cold runner system. Furthermore, injection molding can be carried out as co-injection.

Bristelinq

Bristles are used in the form of an additional feature/function here as part of the working tip and/or at the rear end of the applicator device.

The bristles can be fixed once in the anchor punching process, which includes the following steps: (1) injection molding the base body with blind holes and (2) folding bristles and (3) securing with an anchor.

In the so-called anchorless process, the bristles are not folded and are only half the length of the bristles compared to the bristles of the anchor-punch process. In principle, different anchorless methods can be used here. Four different anchorless method types A, B, C and D are described below.

Process type A comprises the following steps: (1) Separating bristle bundles, (2) fusing bristle ends, (3) direct injection-molding of bristle ends. In this process, bristle bundles can be joined together for fixing. Well-known processes from practice are the In Mold Tufting (IMT process) of Zahoransky, in which the injection-molding also includes the injection-molding of the holding section, and the Aero process (Integrated Anchorless Production) of Zahoransky, in which the bristles are injection-molded first with the plate and then the plate is injection-molded with the holding section.

Process type B comprises the steps of (1) injection molding the bristle plate with through-holes, (2) providing bristles and passing through the bristle plate, (3) fusing bristles on the back side and fusing them to the bristle plate, (4) ultrasonically welding the bristle plate with a separately produced holding section.

Well-known processes from practice are the V-Air and Z. Vamp 1 of Zahoransky, in which bundling of bundles is not possible, and on the other hand the AFT process (Anchor Fee Tufting) of Boucherie and the Z. Vamp 3 process of Boucherie, in which bundling of bristles is possible.

Process type C comprises the steps of (1) injection molding the holding section with through-holes for the bristles in the head area, (2) providing bristles and passing them through the through-holes in the holding section, (3) fusing bristles on the back side, (4) overmolding the bristle melt with soft component.

Well-known processes in practice are the AMR process of Boucherie, in which bundling is not possible, and the AMR+ process of Boucherie, in which bundling is possible.

Finally, process type D comprises the following steps: (1) injection molding a holding section with blind holes for bristles in the head area, (2) providing bristles in bundles, (3) fusing bristles in bundles, (4) heating holding section body in the head region at glass temperature, (5) insert bristles into blind holes and anchor them with pressure on the brush head (i.e. reduce the size of the blind holes or deform the body to anchor the bristles).

A well-known method from practice is the PTt method of Boucherie.

Finally, the so-called twisting in is also mentioned as an anchoring method. Here, the bristles are twisted in between two pieces of wire, creating a twisted bristle.

Production Concept

The aim is to integrate the manufacturing process into the production with a system that can be used initially for certain manual links of the plant as well as for an in-line link. The process is preferably divided into the following steps:

(1) Injection molding of the applicator devices: takes place in the injection mold as described above.

(2) Removal by robot: a robot removes the finished products from the injection mold, preferably in each case in combs (preferably eight combs at a time).

(3) Placement on the conveyor system: a robot places the combs on a conveyor system (preferably a conveyor belt), all combs being oriented in the same way one behind the other.

Preferably, one comb per shuttle of the conveyor system is provided. The distances between the shuttles are adjusted to the placement from the injection molding as well as to the transfer to the conveyor system. In this way, an optimal gripping/placing by the robots is made possible. The combs continue to run parallel in line on the conveyor system, whereby the further run is clocked in the conveyor system.

Additional treatment possibilities during the run on the conveyor system can be: dipping of the applicator devices into certain ingredients such as flavors, etc. (see above) or laser (laser marking) on the hard component and/or the soft component.

Furthermore, a Vision Control can also be performed to check whether the working tip has been manufactured correctly. With a corresponding 100% inspection, several camera types are preferably used. If a working tip is not correctly manufactured, it is preferably fed into a reject container at the end of the conveyor belt.

Preferably, eight combs are always passed on from the feeding device at a time, i.e. eight combs come onto the conveyor system and eight combs go away again. Between them, a maximum of one reserve place is provided.

(4) Removal from the conveyor system and placement in the means of transport: carried out by robots, whereby one robot can take four combs at a time. The combs are placed in stacks in a conveyor (tray). The stacks preferably contain six combs. In principle, however, the stacks are designed with regard to the tray size and the desired packaging size.

(5) Transfer of the conveyor system: the trays can be transferred directly to the packaging plant. It is also possible, however, to transfer the products directly from the conveyor system to the packaging plant.

But here is also an interface for manual processes. For example, products can be manually removed from the conveyor system/tray and placed in a package (such as a blister).

For the sake of clarity, exemplary embodiments of the present invention will be illustrated.

Figure 2:
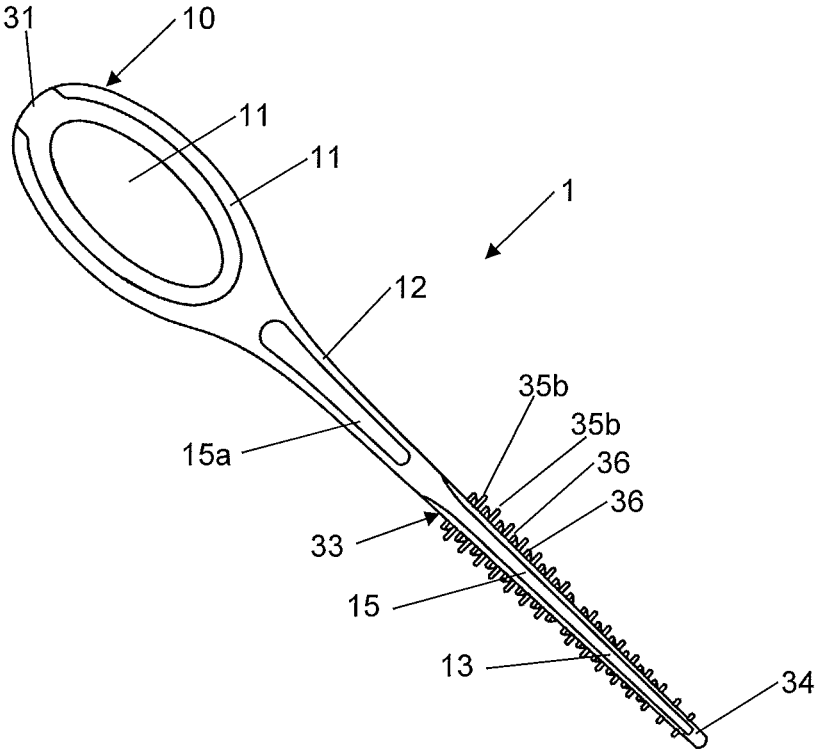
Figure 3:
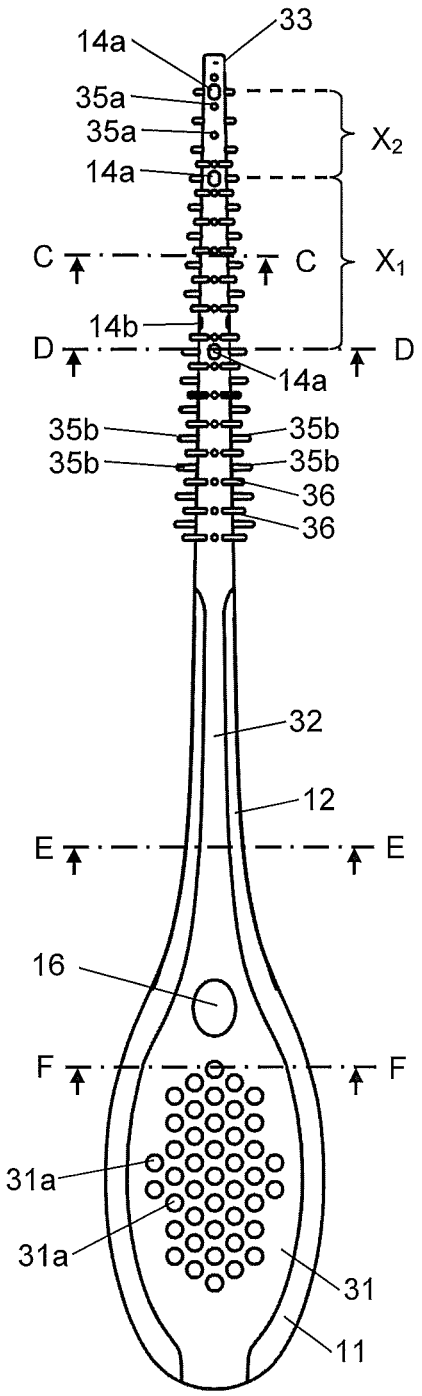
Figure 4:
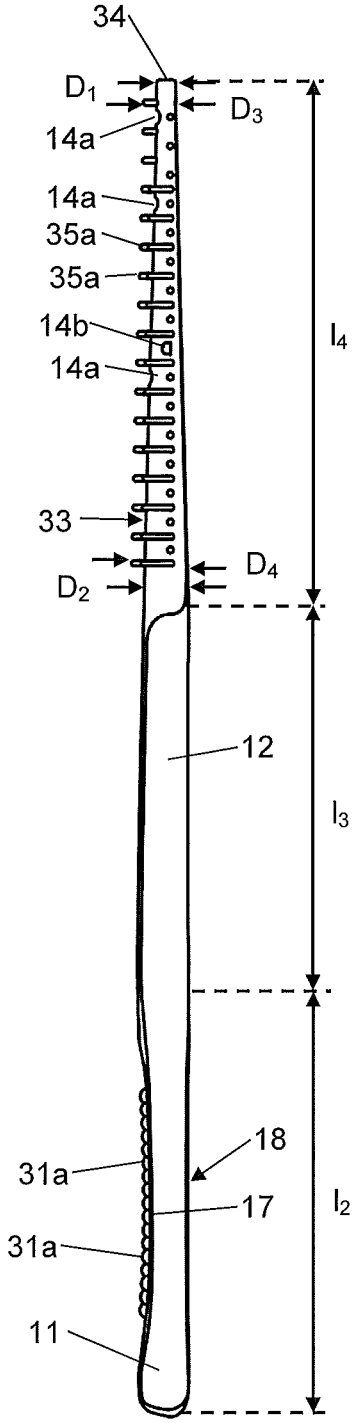
Figure 5:
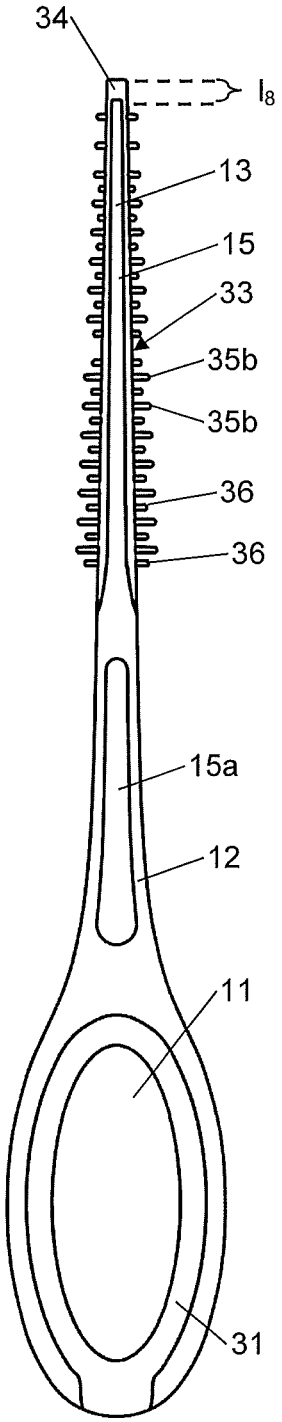
Figure 6:
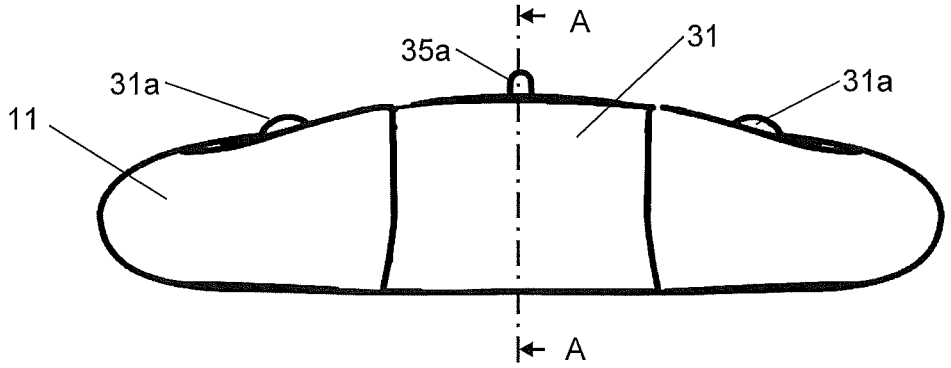
Figure 7:
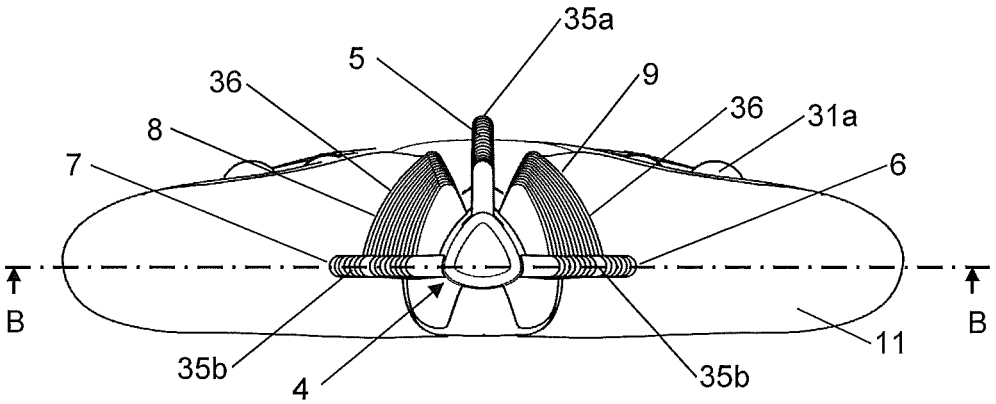
Figure 8:
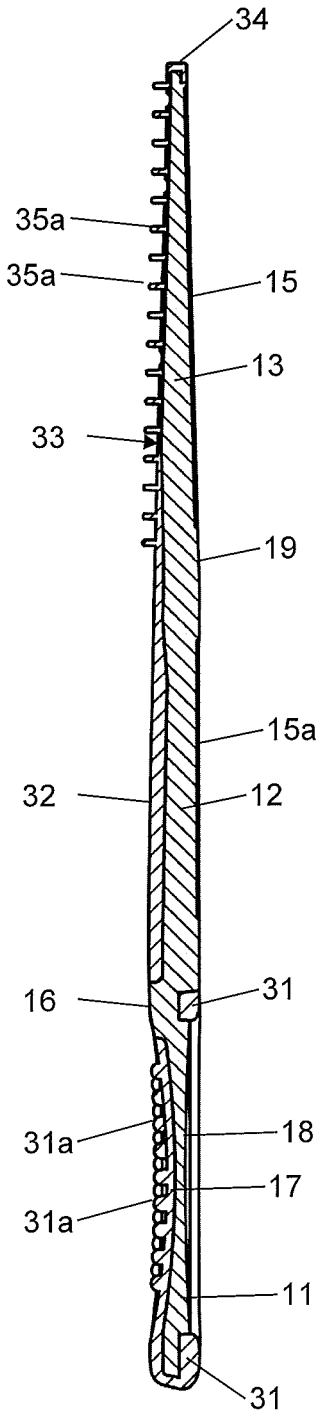
Figure 9:
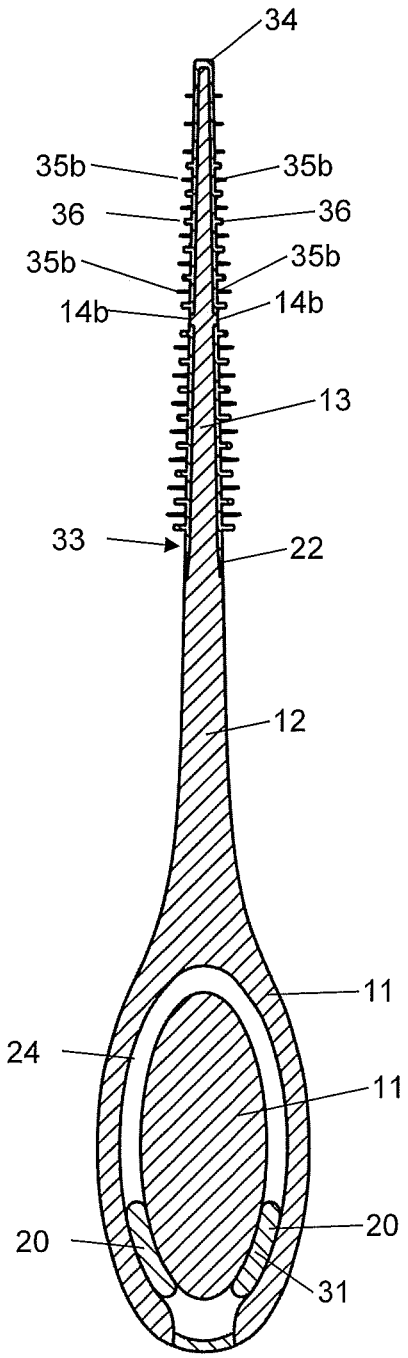
Figure 10:
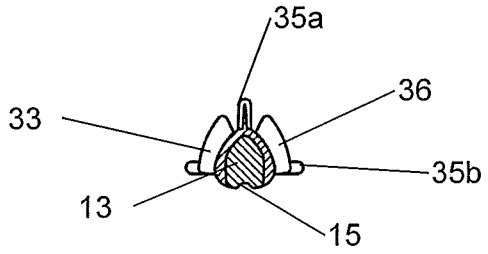
Figure 11:
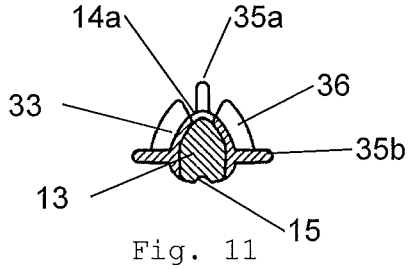
Figure 12:
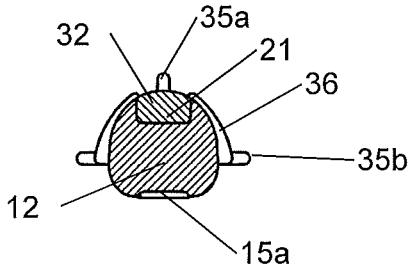
Figure 13:
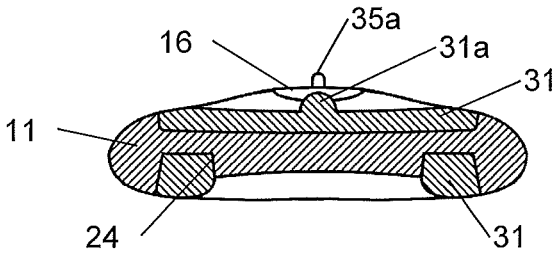
Figure 14:
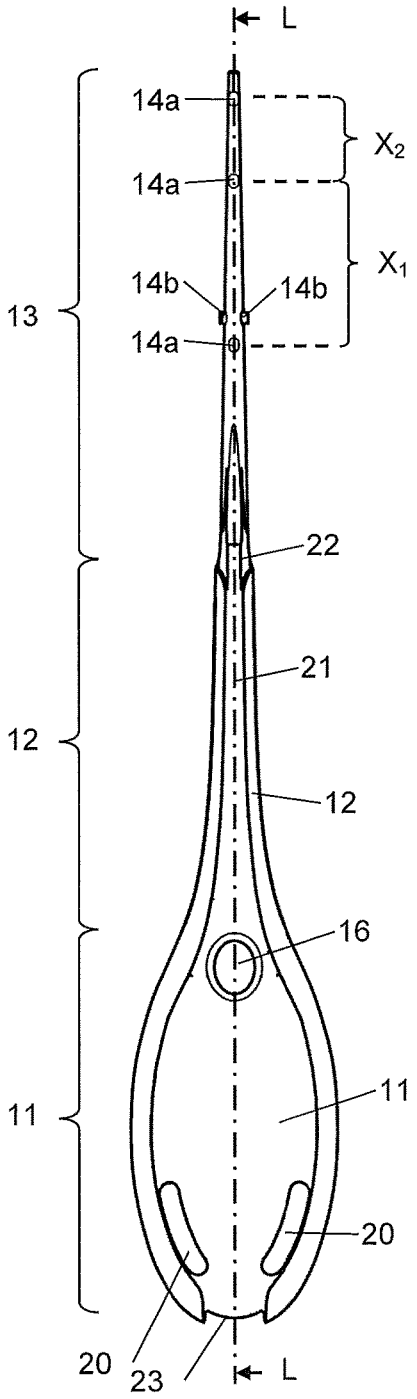
Figure 15:
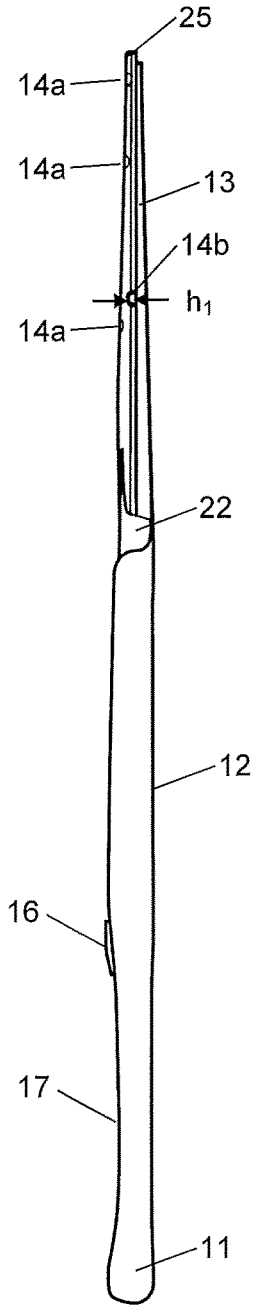
Figure 16:
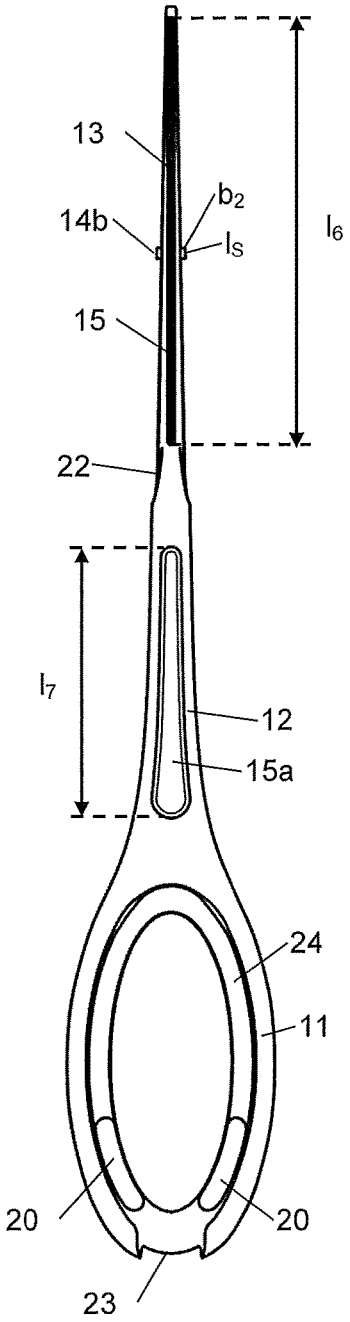
Figure 17:
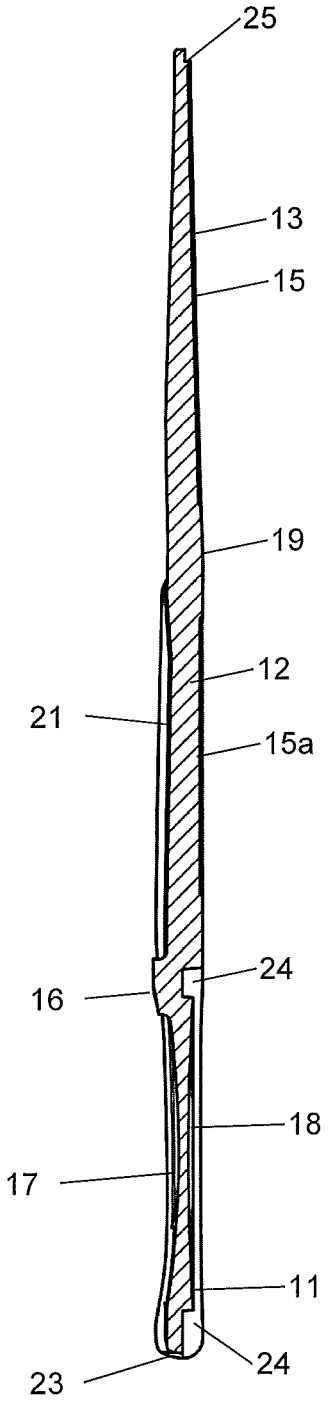
Figure 18:
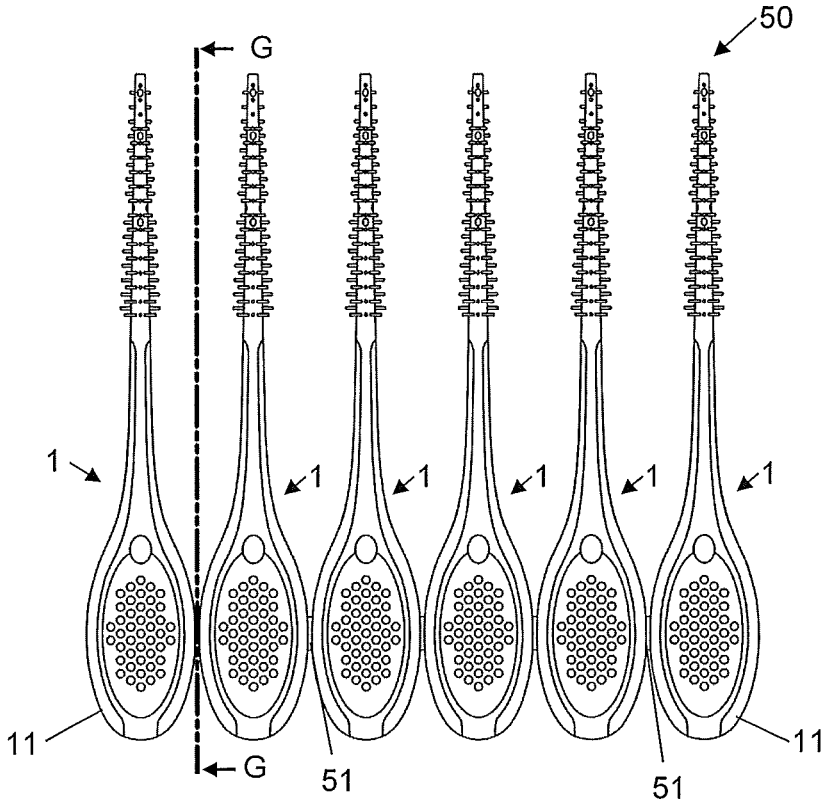
Figure 19:
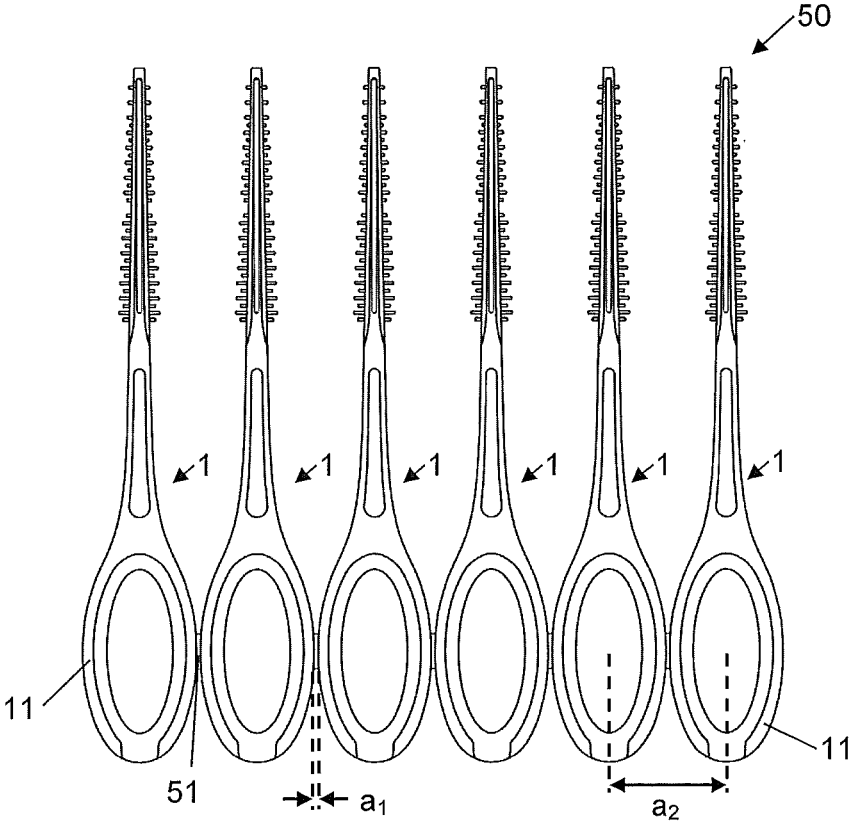
Figure 20:
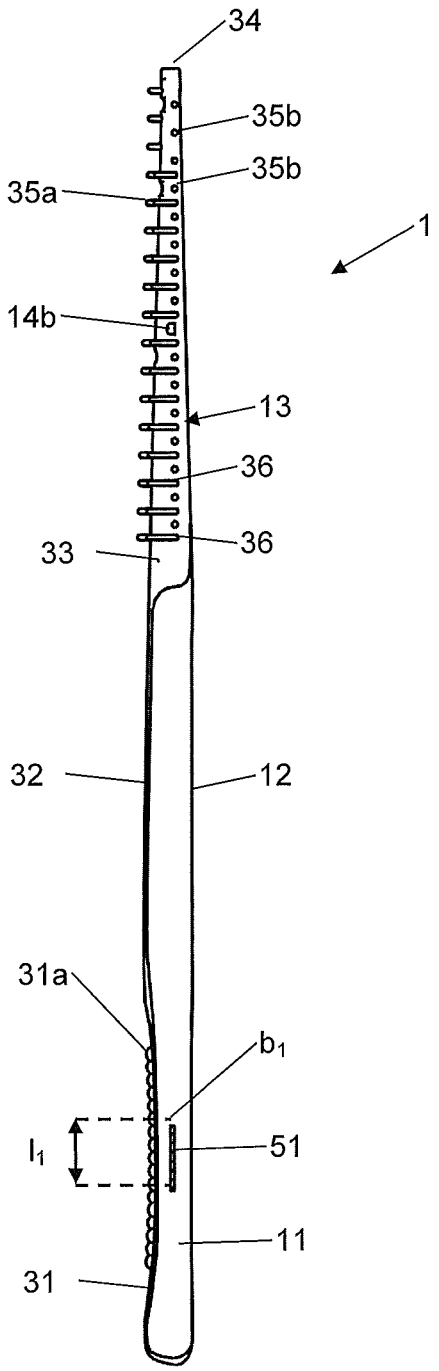
Figure 21:
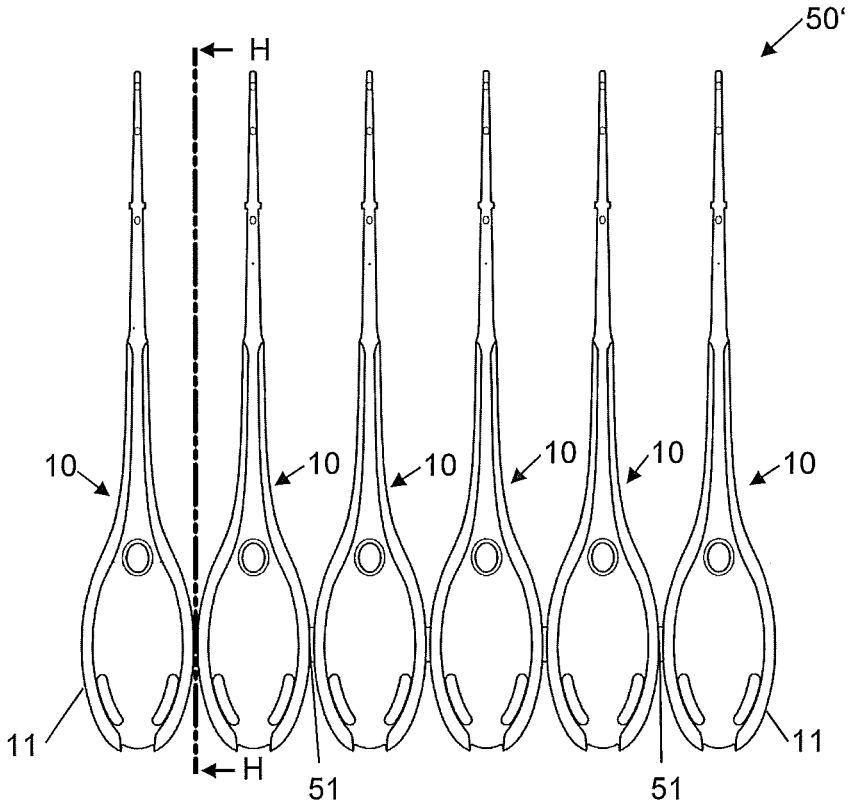
Figure 22:
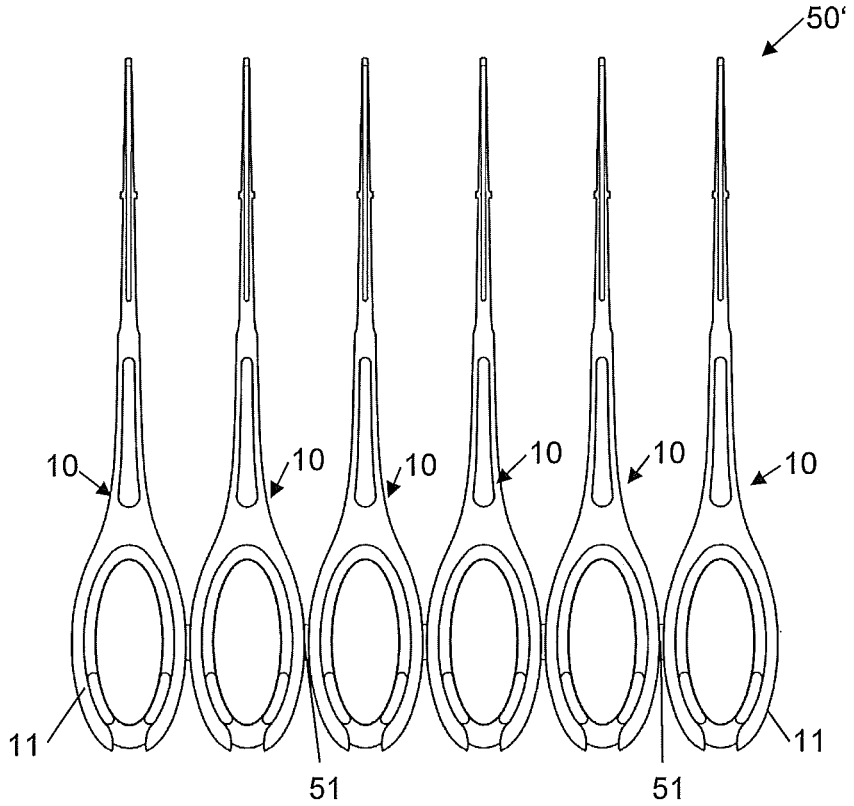
Figure 23:
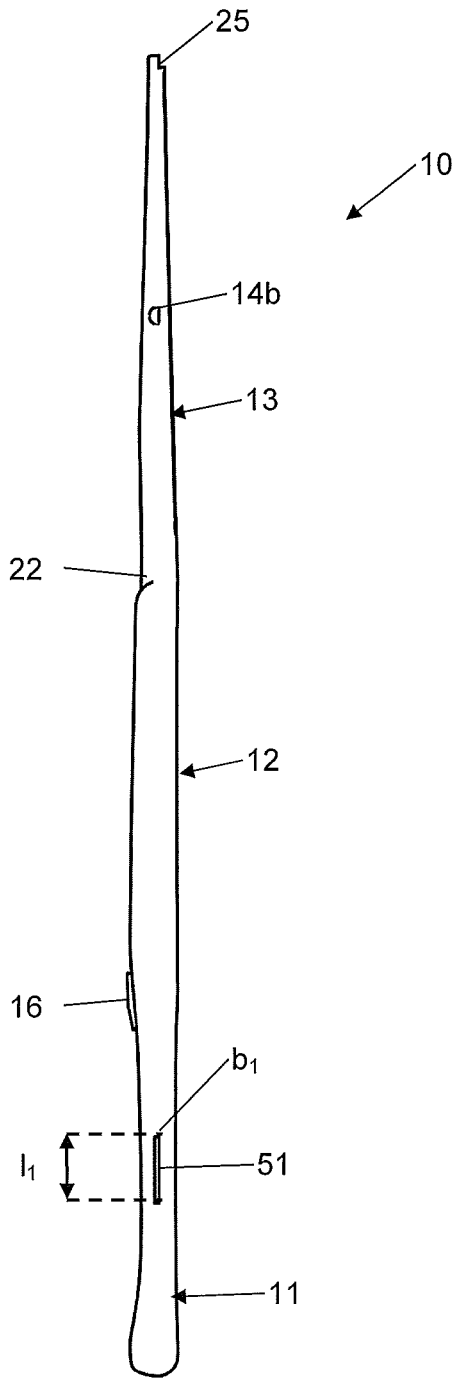
Figure 24:
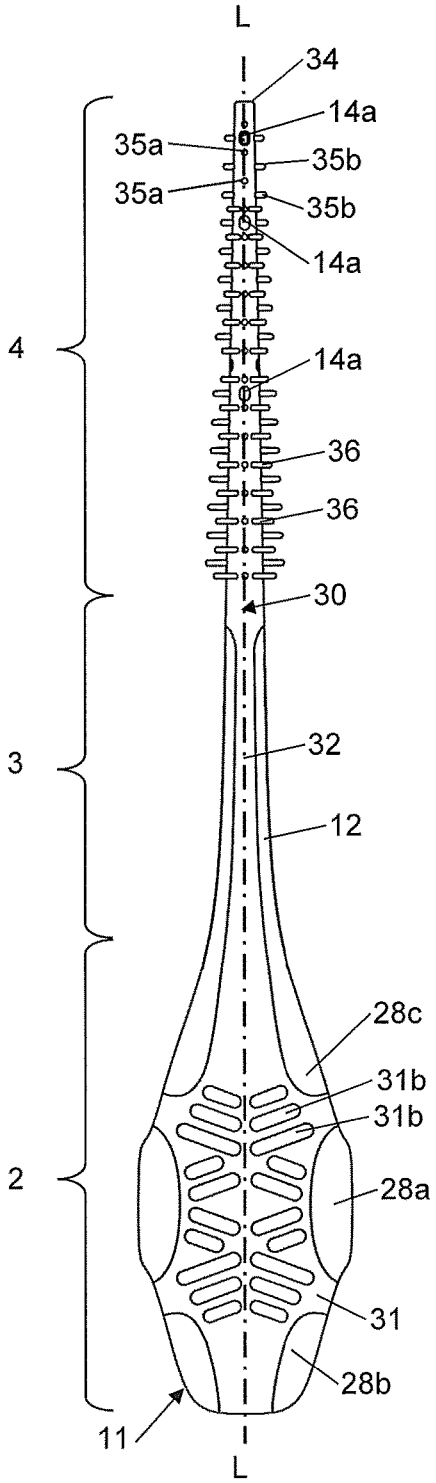
Figure 25:
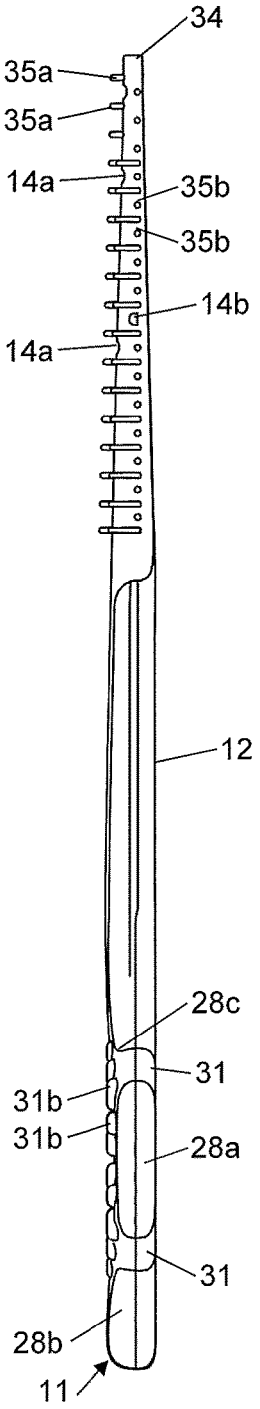
Figure 26:
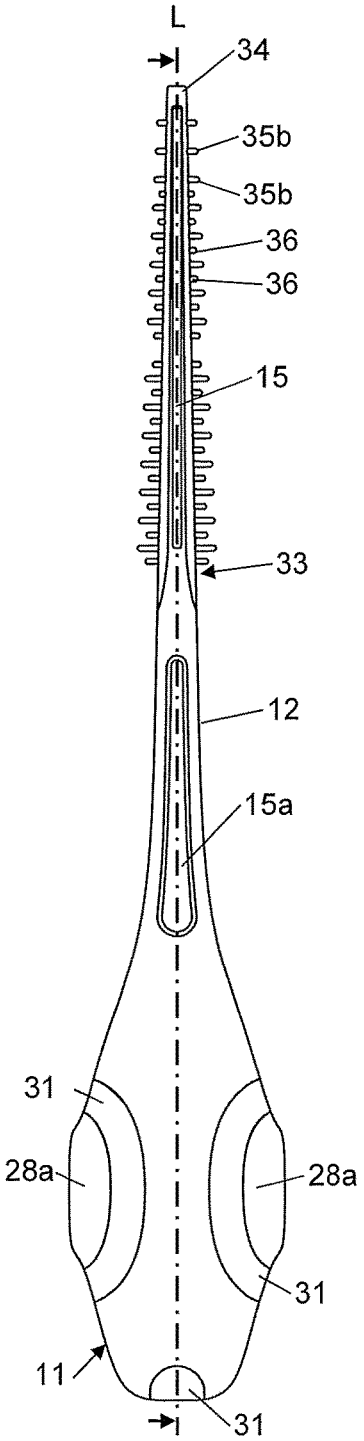
Figure 27:
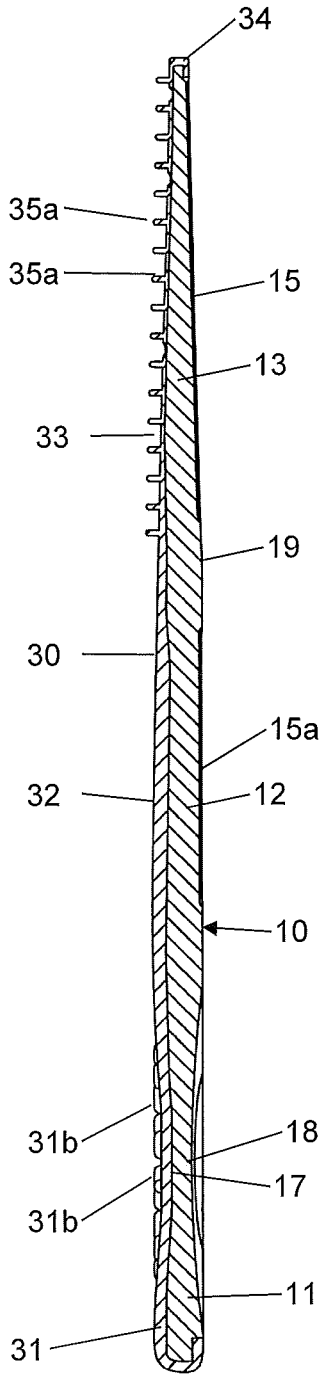
Figure 28:
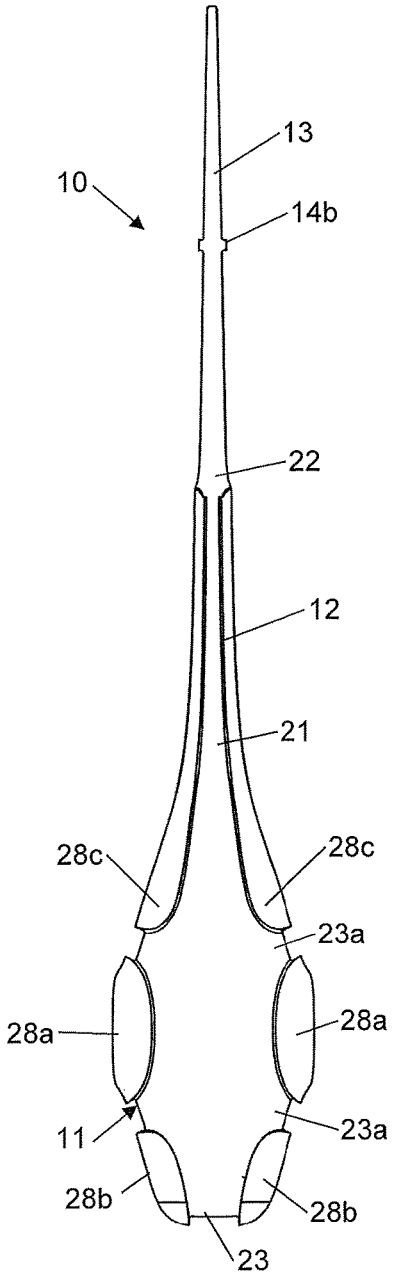
Figure 29:
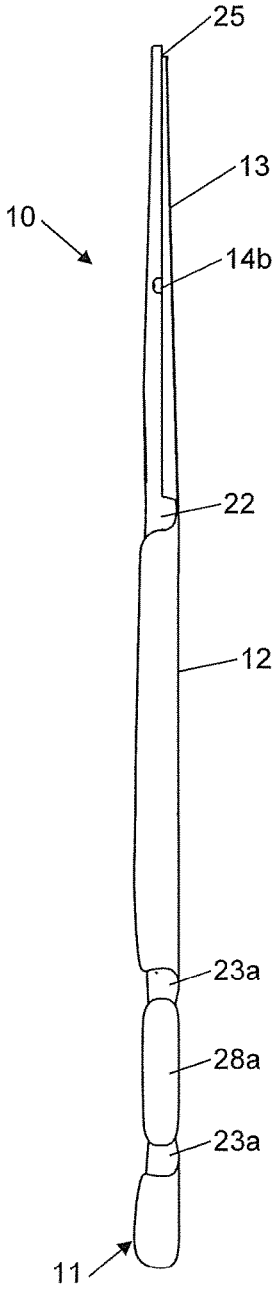
Figure 30:
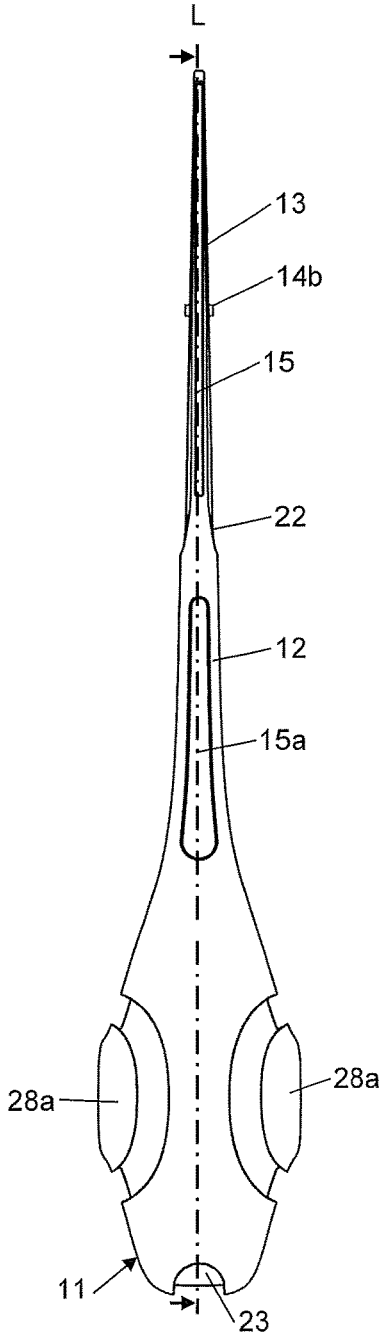
Figure 31:
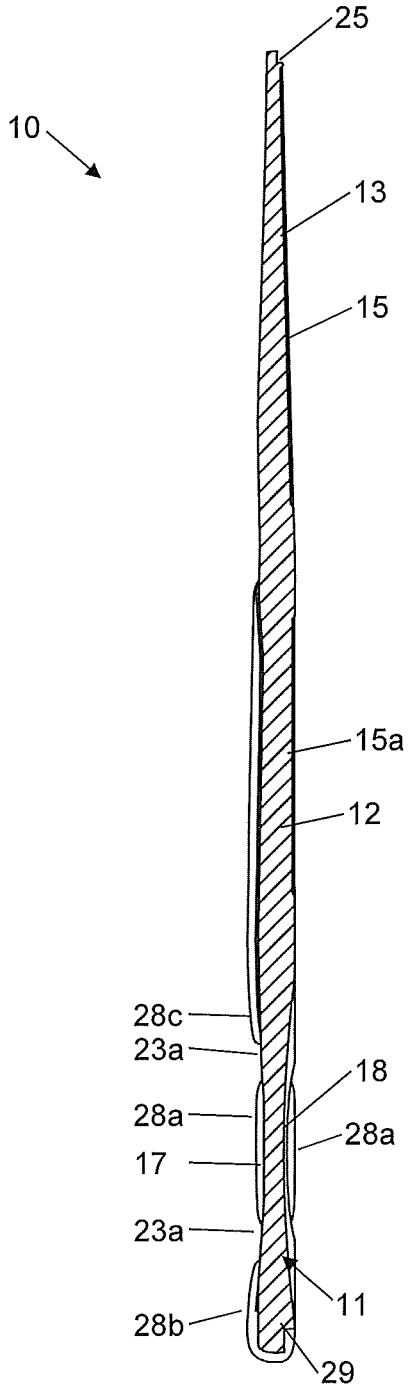
Figure 32:
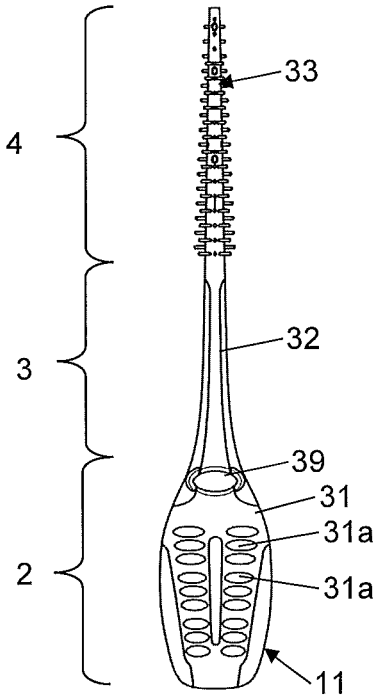
Figure 33:
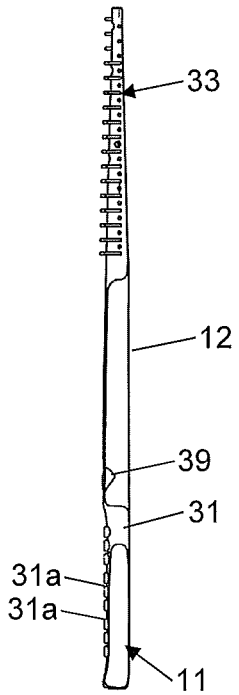
Figure 34:
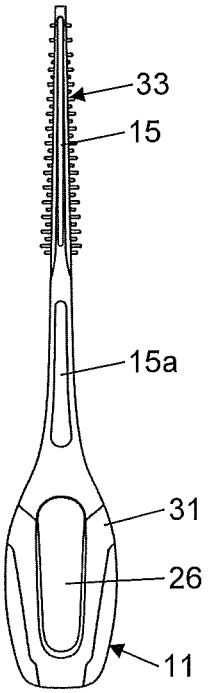
Figure 35:
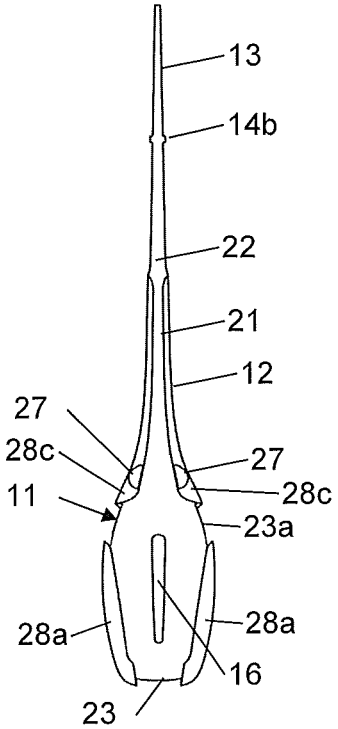
Figure 36:
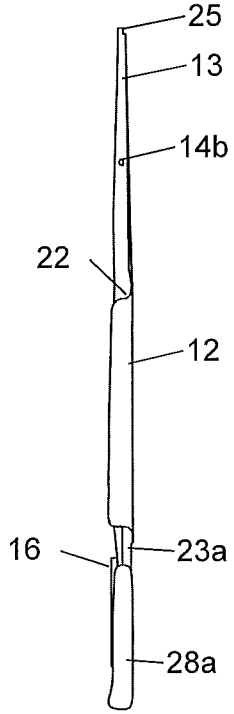
Figure 37:
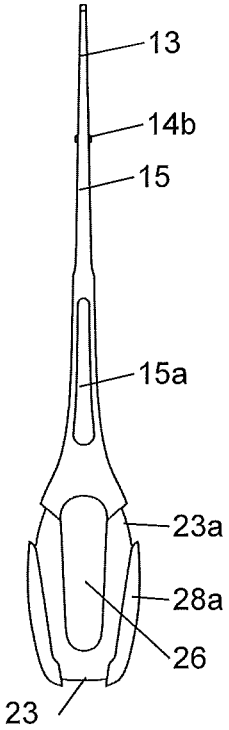
Figure 38A:
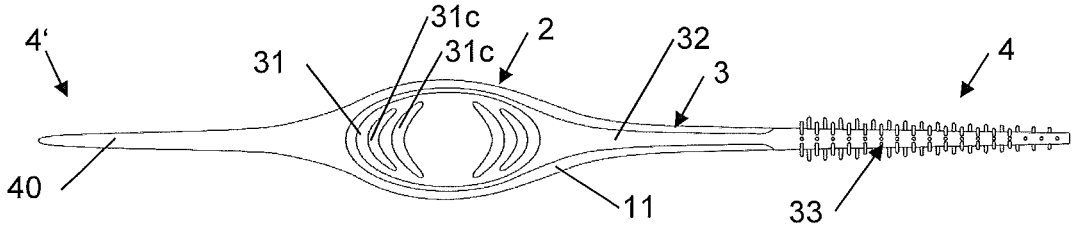
Figure 38B:
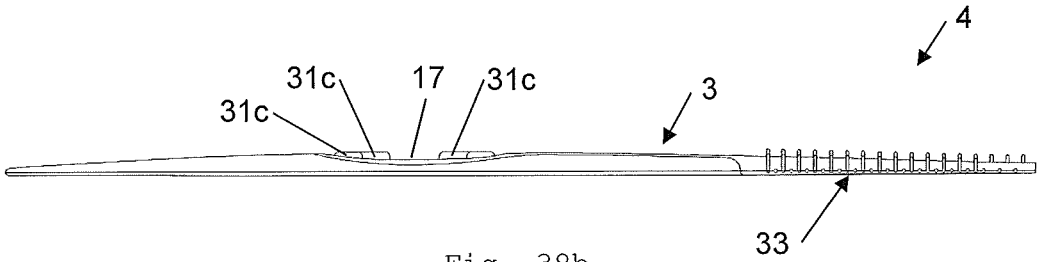

It shows:

FIG. 1: a perspective view of a single applicator device according to a first embodiment of the invention (from the top);

FIG. 2: a perspective view of a single applicator device according to a first embodiment of the invention (from the bottom);

FIG. 3: a top view of the applicator device according to FIG. 1;

FIG. 4: a side view of the applicator device according to FIG. 1;

FIG. 5: a top view of the applicator device according to FIG. 1;

FIG. 6: a rear view of the applicator device according to FIG. 1;

FIG. 7: a front view of the applicator device according to FIG. 1;

FIG. 8: a sectional view along line A-A of the applicator device according to FIG. 6;

FIG. 9: a sectional view along line B-B of the applicator device according to FIG. 7;

FIG. 10: a cross section through the working tip along line C-C in FIG. 3 (without support);

FIG. 11: a cross section through the working tip along the line D-D in FIG. 3 (with support);

FIG. 12: a cross section through the neck section along the line E-E in FIG. 3;

FIG. 13: a cross section through the holding section along line F-F in FIG. 3;

FIG. 14: a top view of the base body of an applicator device according to the first embodiment of the invention;

FIG. 15: a side view of the base body according to FIG. 14;

FIG. 16: a bottom view of the base body according to FIG. 14;

FIG. 17: a sectional view through the base body along the longitudinal axis L according to FIG. 14;

FIG. 18: a top view of a comb of six applicator devices according to the first embodiment of the invention;

FIG. 19: a bottom view of the comb according to FIG. 18;

FIG. 20: a cut in the area of the connection between two applicator devices along the line G-G according to FIG. 18;

FIG. 21: a top view of a comb of six base bodies according to the first embodiment of the invention;

FIG. 22: a bottom view of the comb according to FIG. 21;

FIG. 23: a cut in the area of the connection between two applicator devices along the line H-H according to FIG. 21;

FIG. 24: a top view of a single applicator device according to a second embodiment of the invention;

FIG. 25: a side view of the applicator device according to FIG. 24;

FIG. 26: a bottom view of the applicator device according to FIG. 24;

FIG. 27: a sectional view through the applicator device along the longitudinal axis L according to FIG. 26;

FIG. 28: a top view of the base body of an applicator device according to the second embodiment of the invention;

FIG. 29: a side view of the base body according to FIG. 28;

FIG. 30: a bottom view of the base body according to FIG. 28;

FIG. 31: a longitudinal section through the base body along the longitudinal axis L according to FIG. 30;

FIG. 32: a top view of a single applicator device according to a third embodiment of the invention;

FIG. 33: a side view of the applicator device according to FIG. 32;

FIG. 34: a bottom view of the applicator device according to FIG. 32;

FIG. 35: a top view of the base body of an applicator device according to the third embodiment of the invention;

FIG. 36: a side view of the base body according to FIG. 35;

FIG. 37: a bottom view of the base body according to FIG. 35;

FIG. 38*a*: a top view of an applicator device according to a fourth embodiment, which has two sides with a working tip;

FIG. 38*b*: a side view of the applicator device according to FIG. 38*a;*

Figure 39A:
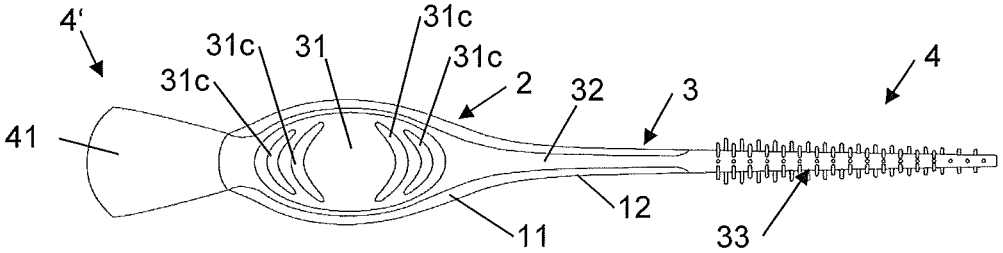
Figure 39B:
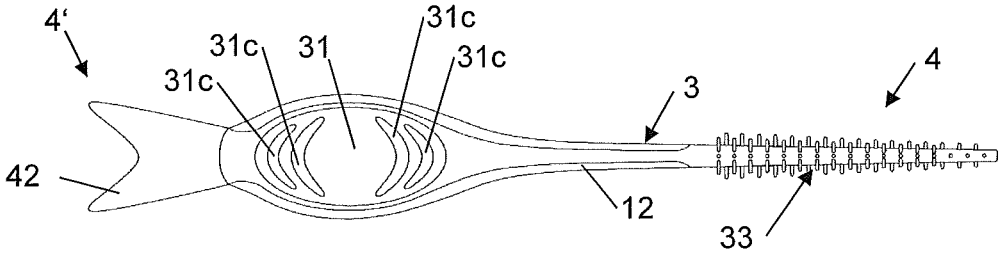
Figure 39C:
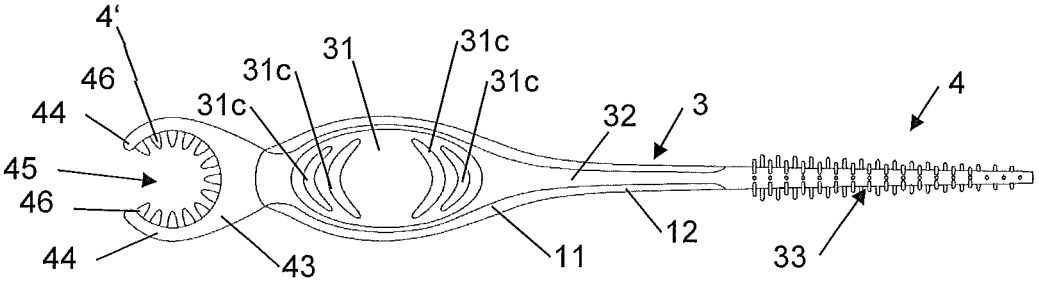
Figure 40A:
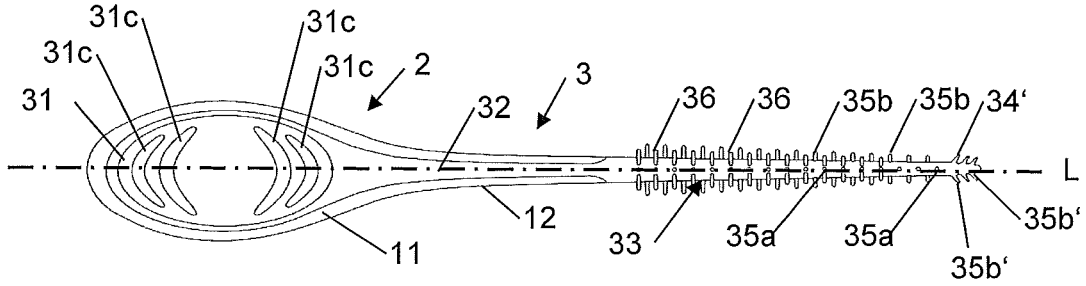
Figure 40B:
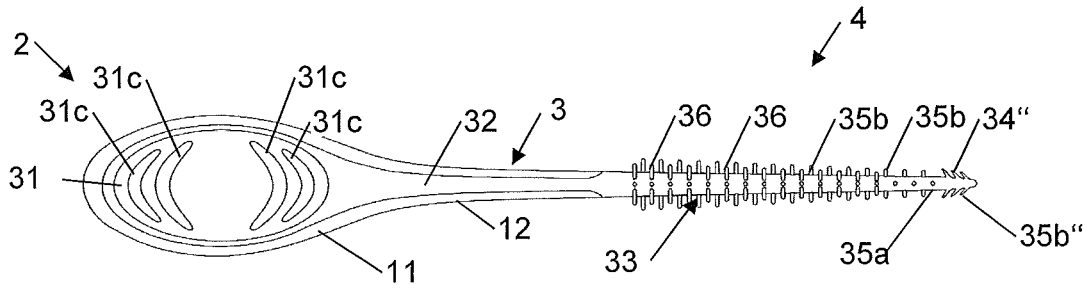
Figure 41A:
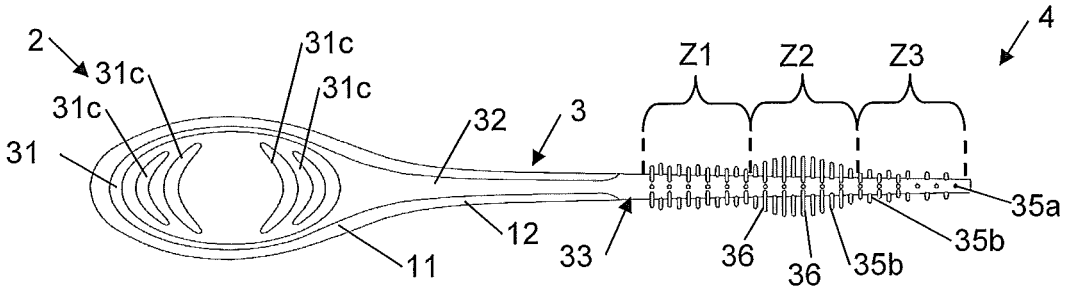
Figure 41B:
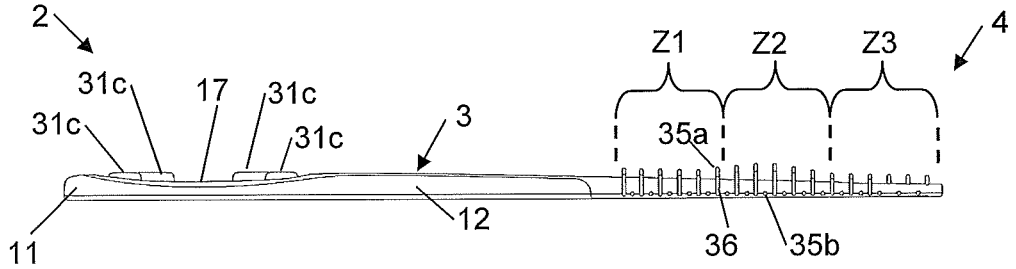

FIG. 39*a*: a top view of an applicator device according to a fifth embodiment of the invention which has two sides with a working tip;

FIG. 39*b*: a top view of an applicator device according to a sixth embodiment of the invention which has two sides with a working tip;

FIG. 39*c*: a top view of an applicator device according to a seventh embodiment of the invention which has two sides with a working tip;

FIG. 40*a*: a top view of an applicator device according to an eighth version of the invention with a screen tip (foremost cleaning elements longer and at an angle, flaps back in use);

FIG. 40*b*: a top view of an applicator device with a modified umbrella tip;

FIG. 41*a*: a top view of an applicator device according to a ninth embodiment of the invention which has a multi-zone working tip (three or more zones in the working tip);

FIG. 41*b*: a side view of the applicator device according to FIG. 41*a;*

Figure 41C:
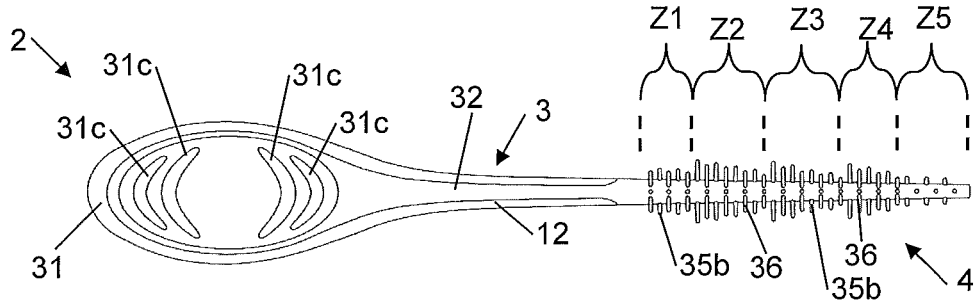
Figure 41D:
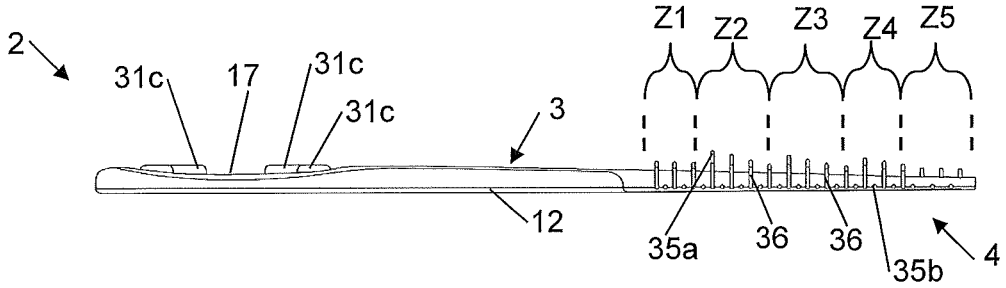

FIG. 41*c*: a top view of an applicator device with another multi-zone working tip;

FIG. 41*d*: a side view of the applicator device according to FIG. 41*c;*

Figure 42A:
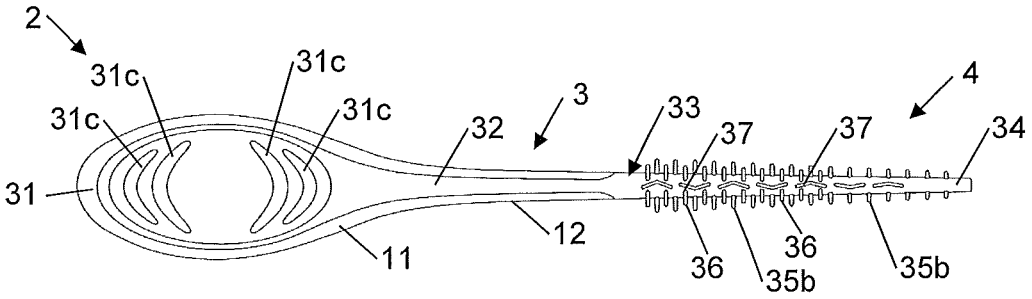
Figure 42B:
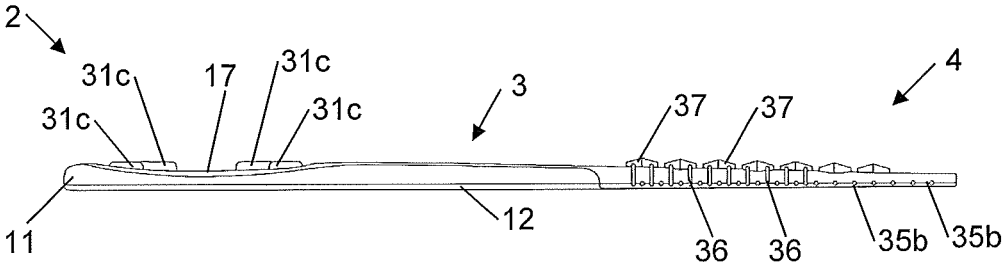

FIG. 42*a*: a top view of an applicator device according to a tenth embodiment of the invention with a combined working tip (bristles and abrasive elements);

FIG. 42*b*: a side view of the applicator device according to FIG. 42*a;*

Figure 42C:
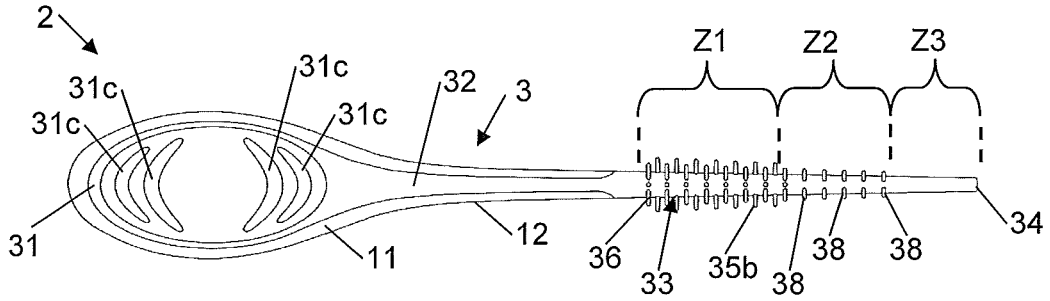
Figure 42D:
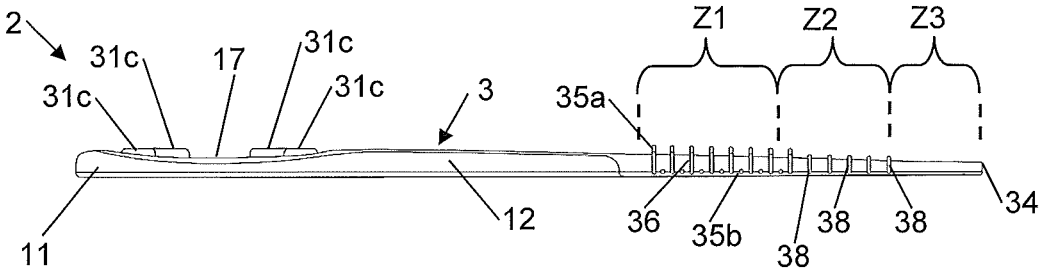

FIG. 42*c*: a top view of an applicator device having a further multi-zone working tip (bristles and abrasive elements);

FIG. 42*d*: a side view of the applicator device according to FIG. 42*c;*

Figure 43A:
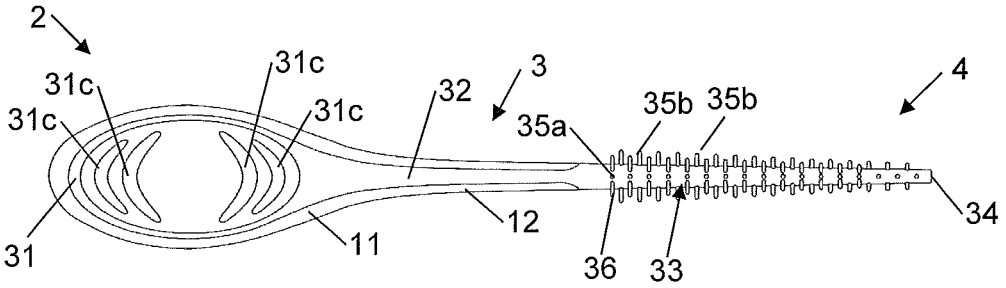
Figure 43B:
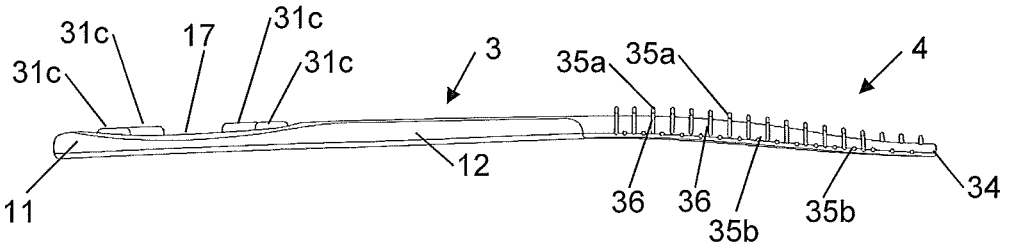

FIG. 43*a*: a top view of an applicator device according to an eleventh embodiment of the invention with an uneven working tip;

FIG. 43*b*: a side view of the applicator device according to FIG. 43*a;*

Figure 43C:
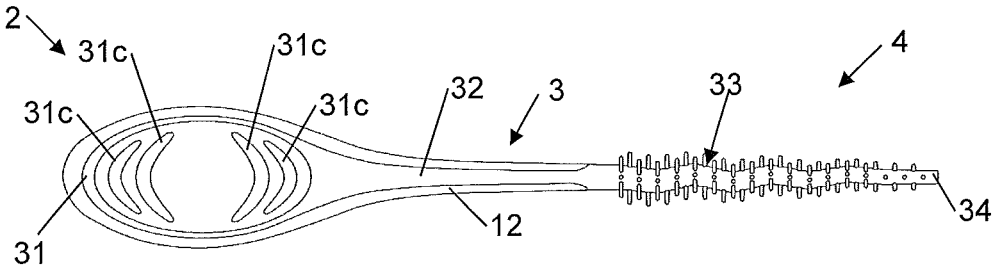
Figure 43D:
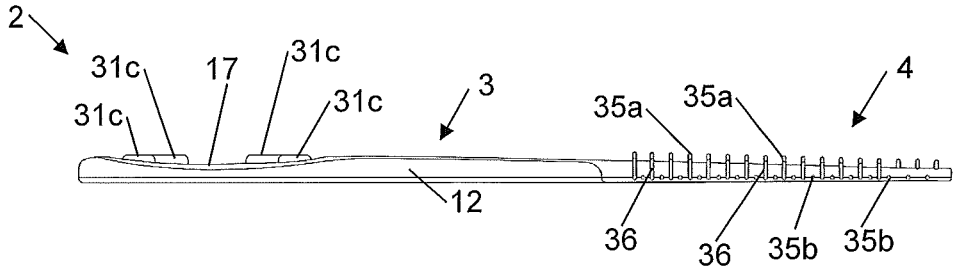

FIG. 43*c*: a top view of an applicator device with a further uneven working tip (waveform);

FIG. 43*d*: a side view of the applicator device according to FIG. 43*c;*

Figure 44A:
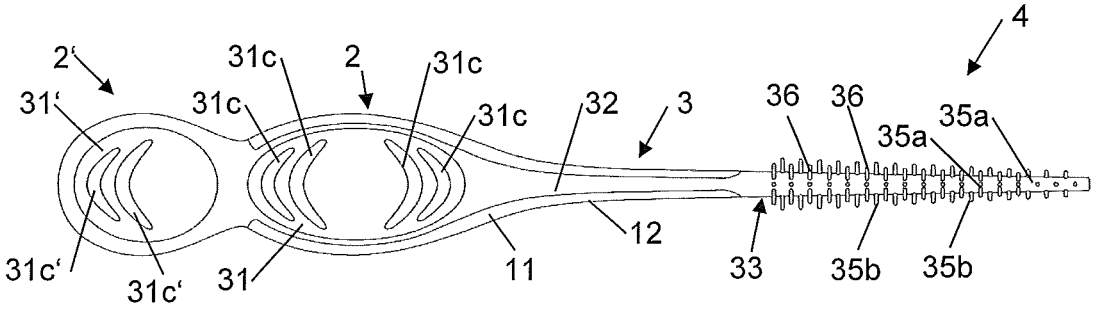
Figure 44B:
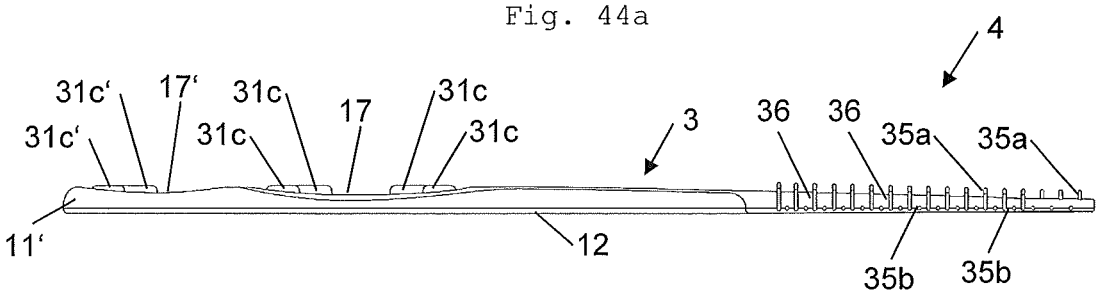

FIG. 44*a*: a top view of an applicator device according to a twelfth embodiment of the invention having an elongated holding portion (better holding);

FIG. 44*b*: a side view of the applicator device as shown in FIG. 44*a;*

Figure 44C:
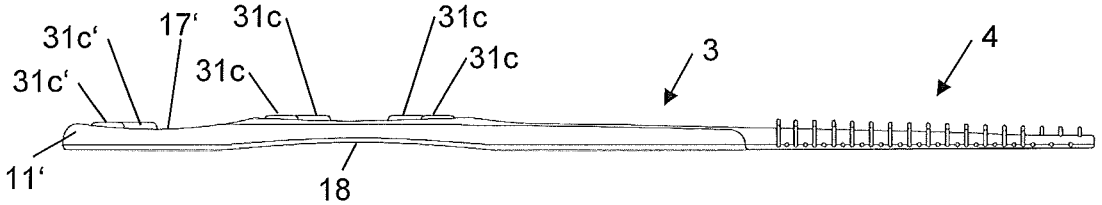
Figure 45A:
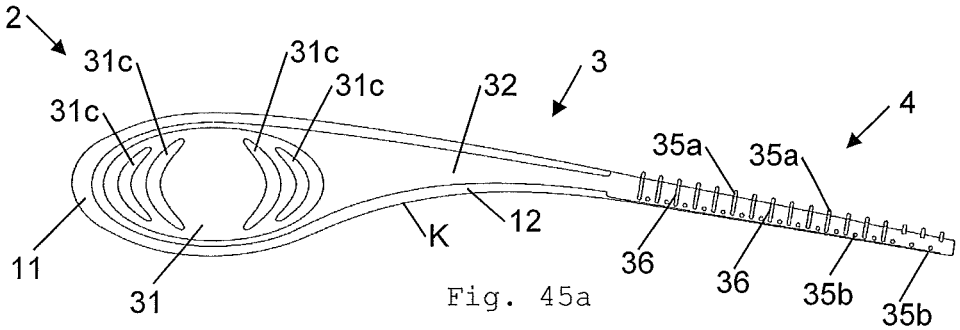
Figure 45B:
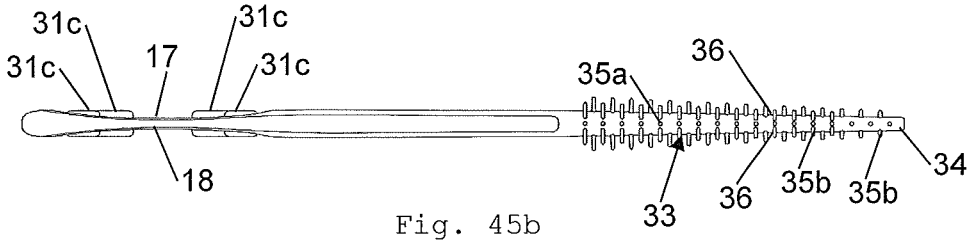

FIG. 44*c*: a side view of another applicator device with an extended holding section;

FIG. 45*a*: a top view of an applicator device according to a thirteenth embodiment of the invention with a modified base body;

FIG. 45*b*: a side view of the applicator device according to FIG. 45*a;*

Figure 46A:
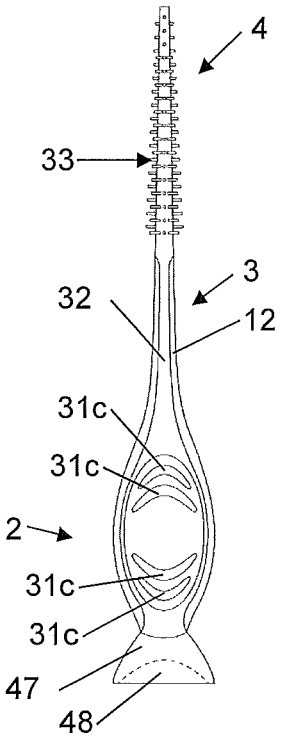
Figure 46B:
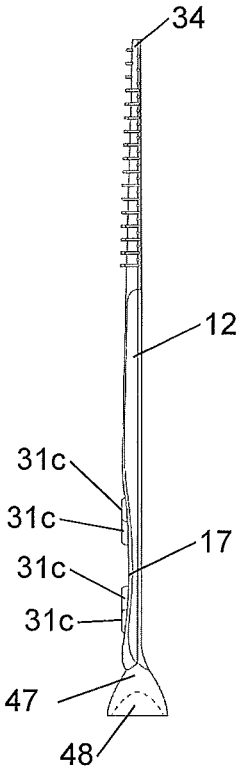

FIG. 46*a*: a side view of an applicator device according to a fourteenth embodiment of the invention;

FIG. 46*b*: a top view of the applicator device according to FIG. 46*a;*

Figure 47A:
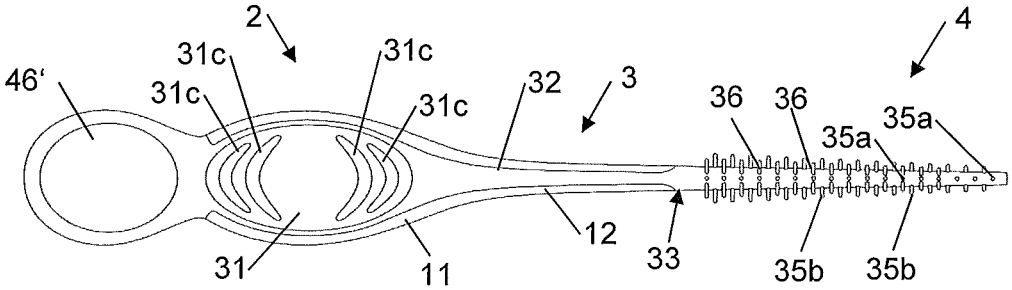
Figure 47B:
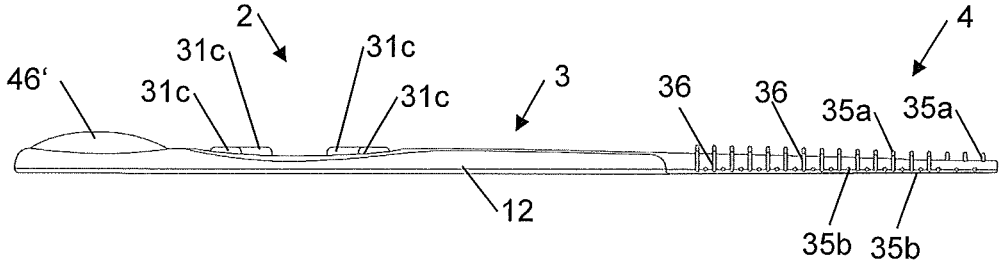
Figure 47C:
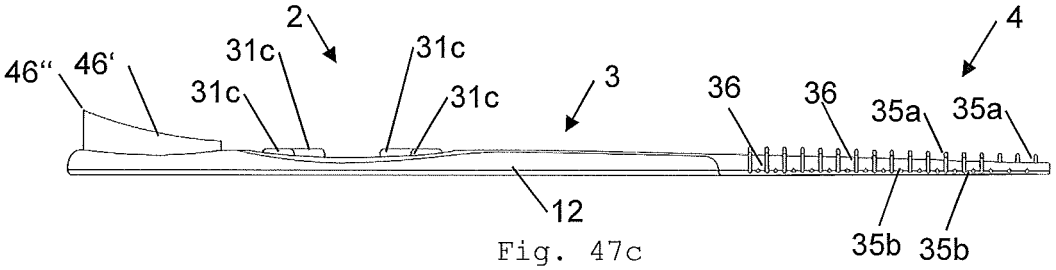
Figure 48:
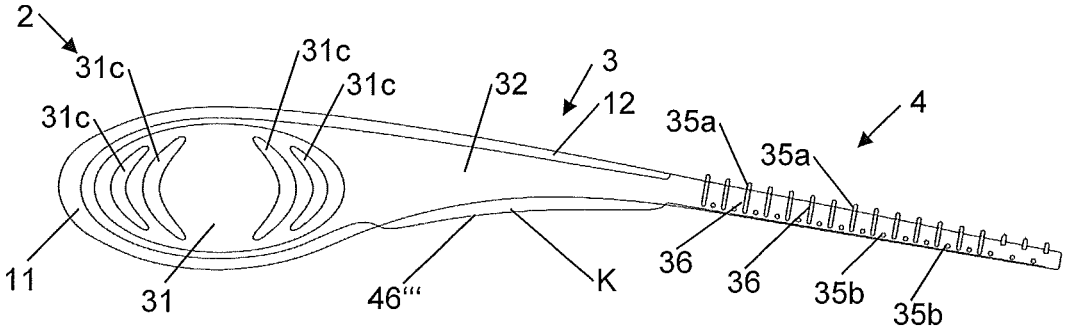
Figure 49A:
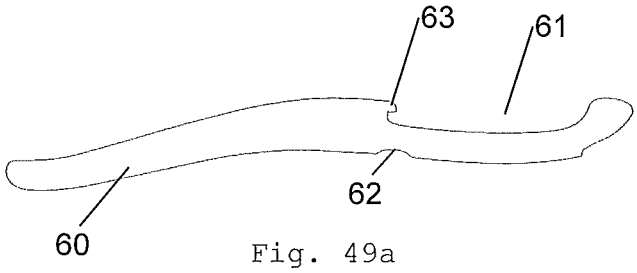
Figure 49B:
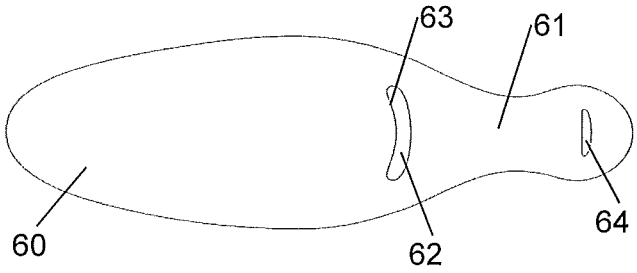

FIG. 47*a*: a top view of an applicator device according to a fifteenth embodiment of the invention, which has two sides with a working tip;

FIG. 47*b*: a side view of the applicator device according to FIG. 47*a* in a first variant;

FIG. 47*c*: a side view of the applicator device according to FIG. 47*a* in a second variant;

FIG. 48: a top view of an applicator device according to a sixteenth embodiment of the invention with a modified base body and a further working element;

FIG. 49*a*: a side view of a handle extension part for an applicator device;

FIG. 49*b*: a top view of the handle extension part according to FIG. 49*a;*

Figure 49C:
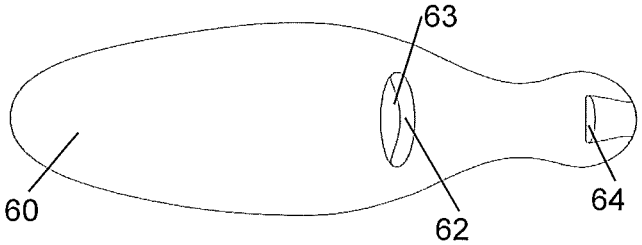

FIG. 49*c*: a rear view of the handle extension part according to FIG. 49*a;*

Figure 49D:
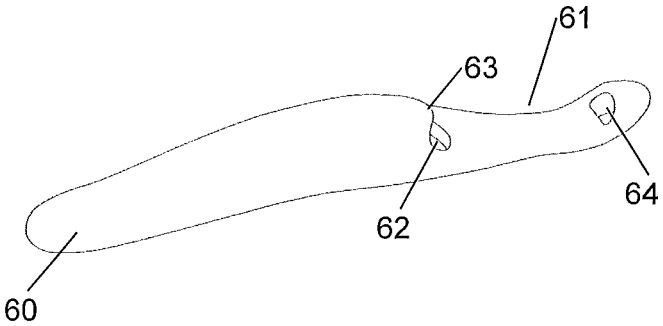

FIG. 49*d*: a 3D view of the handle extension part according to FIG. 49*a;*

Figure 50A:
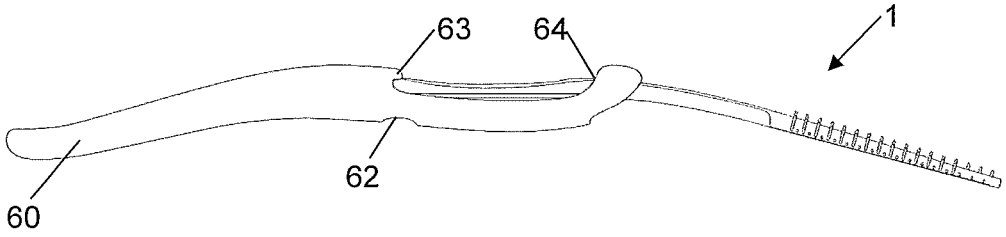
Figure 50B:
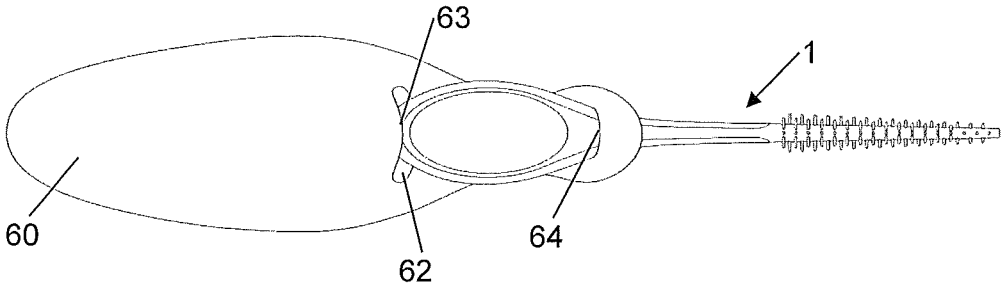

FIG. 50*a*: a side view of a handle extension part for an applicator device with an inserted applicator device;

FIG. 50*b*: a top view of the handle extension part for an applicator device with inserted applicator device according to FIG. 50*a;*

Figure 50C:
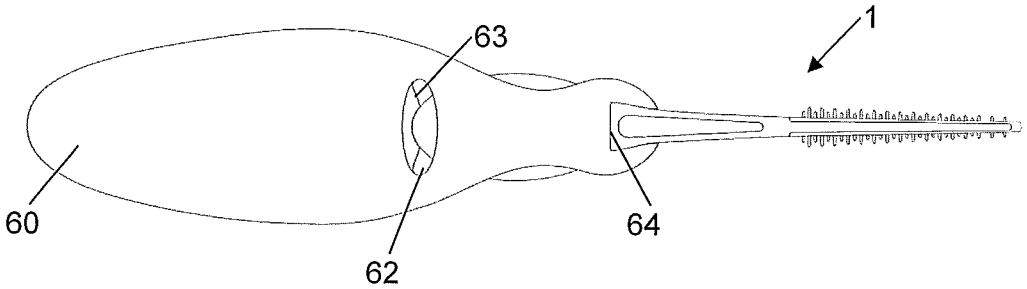

FIG. 50*c*: a rear view of the handle extension part for an applicator device with inserted applicator device according to FIG. 50*a;*

Figure 50D:
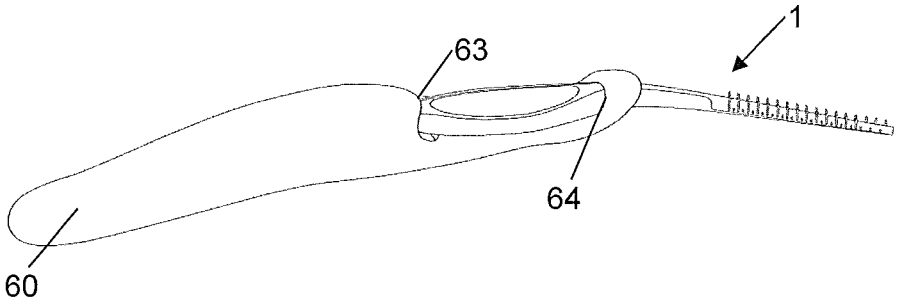

FIG. 50*d*: a 3D view of the handle extension part for an applicator device with inserted applicator device according to FIG. 50*a;*

Figure 51:
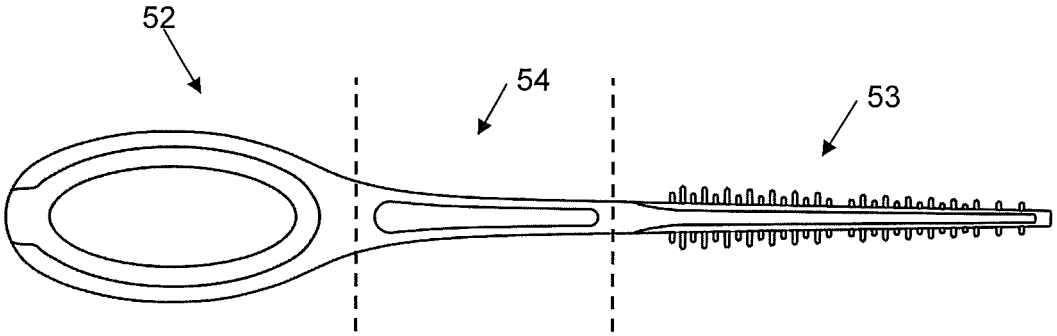
Figure 52:
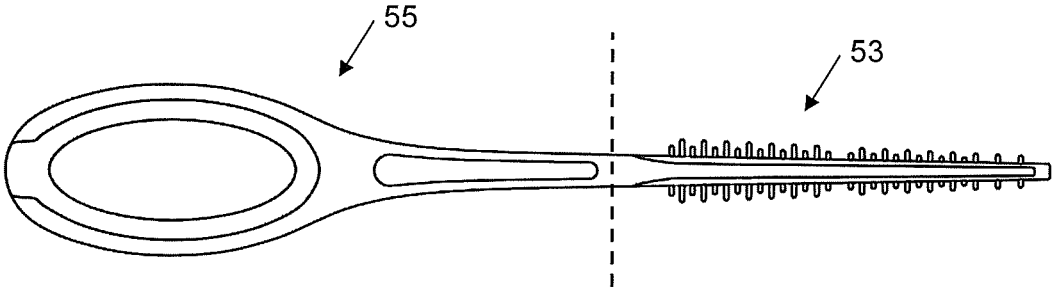
Figure 53:
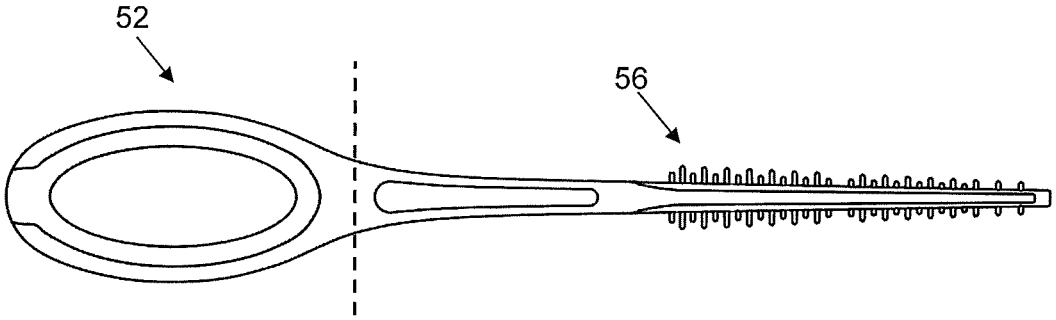

FIG. 51: schematically shown modularity of the injection mold in a rear view of the applicator device in a first variant;

FIG. 52: schematically shown modularity of the injection mold in a rear view of the applicator device in a first variant;

FIG. 53: Schematically shown modularity of the injection mold in a rear view of the applicator device in a second variant;

FIG. 1 shows a perspective view of the upper side of a first embodiment of the applicator device according to the invention.

The applicator device 1 is essentially divided into the holding section 2, the working tip 4 and the neck section 3 connecting the working tip 4 with the holding section 2. The working tip 4 comprises a coating 33 made of a soft component, wherein the coating 33 forms several cleaning and/or polishing elements in the form of vertical cleaning elements 35*a*, horizontal cleaning elements 35*b* and lamella-shaped cleaning elements 36 (polishing lamellae), which are arranged between the vertical and horizontal cleaning elements 35*a*, 35*b*.

The holding section 2 comprises a holding cover 31 made of soft component, which covers the major part of the holding section 2 and which forms several nubs 31*a*, which are intended to provide a better grip for the finger(s) which are supposed come into contact with the holding cover during use.

The part of the holding section 2 not covered by the soft component is formed of a hard component and is mainly referred to as the base body holding section 11. The base body holding section 11 merges into the base body neck section 12, which is at least partially covered by a neck cover 32 made of soft component. The base body neck section 12 then merges into the tip of the base body (not shown here), which is surrounded by the coating 33 of soft component.

In addition, a holding projection 16 made of hard component is provided at the end of the holding section 2 facing the neck section 3, which is injection-molded by the soft component.

In FIG. 1 and the other figures in which the different sections are shown, the separation seam is not shown, in each case. This would be formed in the area between the holding section 2 and the neck section 3 and between the neck section 3 and the working tip 4.

In FIG. 2, the bottom part of the applicator device 1 according to the first embodiment of the invention is now illustrated in perspective.

The support cover 31 can be seen, which runs around the rear end of the holding section 2 and forms an oval ring there. The inside of the oval ring and the outer edge of the holding section 2 is in turn formed by the base body holding section 11—i.e. except for the rear section around which the holding cover 31 is made of soft component. A recess 15*a* is made in the underside of the neck section 3, more precisely in the underside of the base body neck section 12. This recess 15*a* serves as a holding element when the base body 10 is repositioned from a first cavity of the injection mold to a second cavity of the injection mold. The recess 15*a* is preferably undercut in order to ensure a particularly secure hold, which results in forced demolding.

The neck section is followed by the working tip 4, which comprises the base body tip 13 and the coating 33, whereby the base body tip 13 is at least partially surrounded by the coating 33. However, the frontmost tip 34 of the coating 33 preferably completely surrounds the front part of the base body tip 13 in order to avoid possible injuries to the gums when threading in the applicator device 1. In addition, the underside of the working tip 4, more precisely the underside of the body tip 13, has a recess 15, which is intended for the insertion of a centering element, which interacts with the supports 14*a* and 14*b* to ensure a uniform injection-molding with the soft component of the coating 33 or the injection-molding body 30. The injection-molding body 30 comprises the entire soft component with which the base body 10 is injection-molded, i.e. it is formed by the holding cover 31, the neck cover 32 and the coating 33.

FIG. 3 shows a top view of the upper side of the applicator device 1 according to FIG. 1. In the area of the working tip 4, the design of the coating 33 can be seen more precisely. The coating 33 forms in particular two rows of horizontal cleaning elements 35*b*, which decrease in length slightly towards the free end of the working tip. In addition, on the top of the coating 33 or working tip 4, vertical cleaning elements 35*a* are formed, which stand vertically upwards. To the left and right of the vertical cleaning elements 35*a*, lamella-shaped cleaning elements 36 are arranged, which also decrease in length towards the free end of the working tip.

On the upper side of the working tip 4, three supports 14*a* can also be seen, which are generally flat and which serve as points of engagement for the corresponding holding pins of the injection mold when the soft component for the coating 33 or for the injection-molding body 30 is molded around the tip of the base body 13. In the case of the supports 14*a*, the hard component of the tip of the base body 13 is exposed and surrounded by the coating 33. The distance between the rear support 14*a* and the center support 14*a* is designated $X_1$. The distance between the center support 14*a* and the front support 14*a* is designated $X_2$. The distance ratio $X_1$ to $X_2$ is preferably between 1.5 to 1 and 2.5 to 1, the most preferred distance ratio is about 2 to 1. The neck cover 32 of the base body neck section 12 merges in the direction of the rear end into the holding cover 31, which surrounds the holding projection 16 of the base body holding section 11. The nubs 31*a* of the holding cover 31 are arranged in several rows of different row lengths, the center row running along the longitudinal axis L of the applicator device 1. The longitudinal rows are preferably arranged parallel to the longitudinal axis L.

FIG. 4 shows a side view of the applicator device 1 according to FIG. 3. In particular, it can be seen that the vertical cleaning elements 35*a* along the longitudinal axis L of the working tip 4 increase in length in the direction of the free end or the frontmost tip 34 of the working tip 4, with the base body tip 13 simultaneously tapering in the direction of the free end, so that a substantially horizontal height profile results for the vertical cleaning elements 35*a*. In a preferred embodiment, the height profile of the vertical cleaning elements 35*a* has a slight inclination towards the free end or the frontmost tip 34 of the working tip 4.

In the area of the base body holding section 11, which is covered with the nubs 31*a*, the base body holding section 11 has a concave bulge 17, 18 on both its upper and lower sides, which improves grip ergonomics.

In the area of working tip 4, one can also see the free spots in the coating 33, which result from the supports 14*a*. Finally, the reference mark 14*b* designates a lateral projection of the base body tip 13, which is surrounded flush by the coating and which serves as a lateral support in the injection mold during the injection of the soft component.

The holding section 2 has a length of $l_2$, the neck section 3 a length of $l_3$ and the working tip 4 a length of $l_4$. The lengths $l_2+l_3+l_4$ together make up the total length of the applicator device 1. Preferably, the length $l_4$ is slightly larger than length $l_2$ and the length $l_2$ is somewhat larger than the length $l_2$. With a total length of about 5 cm, for example, the length $l_2$ is about 1.7 cm, the length $l_3$ about 1.3 cm and the length $l_4$ about 2 cm.

FIG. 5 shows a top view of the underside of the applicator device 1 as shown in FIG. 2. The holding cover 31 in the form of an oval ring in the area of the base body holding section 11, as well as the recess 15*a* in the base body neck section 12, can be seen. At the frontmost tip 34 of the working tip 4 or the coating 33, the base body tip 13 is completely enclosed by the coating 33, as already explained above. The length $l_8$ of this frontmost tip 34, which completely encloses the front end of the base body tip 13, ranges from 0.1 mm to 3 mm, preferably from 0.2 mm to 1.5 mm.

The diameter of the working tip $D_1$ at the free end (measured on the soft component, without cleaning elements) is about 0.75 mm as an example for a smaller product; the diameter of the working tip $D_2$ in the area of the last neck-side cleaning elements is about 1.4 mm. The outside diameter of the working tip $D_3$ (with cleaning elements) at the free end is about 1.5 mm; the outside diameter of the working tip $D_4$ in the area of the last neck-side cleaning elements is about 3 mm.

A rear view of the inventive applicator device 1 according to FIG. 1 is illustrated in FIG. 6. The back of the base body holding section 11 and the holding cover 31, which surrounds the back of the base body holding section 11 in the form of a centrally arranged strip, can be seen. On the upper side of the base body holding section 11, the vertical cleaning elements 35*a* can be seen in the center, and on the left and right of them the nubs 31*a* of the holding cover 31 on the upper side of the base body holding section 11 can be seen.

A front view of the inventive applicator device 1 according to FIG. 1 is shown in FIG. 7. The working tip 4 has a triangular shape in front view (as well as in cross-section), the upper tip 5 of the triangular shape being aligned with the upper side of the applicator device 1 and formed by the vertical, preferably bristle-shaped, cleaning elements 35*a*. The lower tips of the triangular shape 6 and 7 are each formed by the horizontal, preferably bristle-shaped, cleaning elements 35*b*.

In each case, lamella-shaped cleaning elements 36 are clamped between the vertical cleaning elements 35*a* and the horizontal cleaning elements 35*b*, which preferably do not project as far outwards as the vertical and horizontal cleaning elements 35*a*, 35*b*. The lamella-shaped cleaning elements 36 thus form the right side 8 of the triangular form and the left side of the triangular form 9. On the upper side of the base body holding section 11, nubs 31*a* of the holding cover 31 can be seen on the left and right of the vertical cleaning elements 35*a*.

FIG. 8 illustrates a sectional view along the line A-A as shown in FIG. 6. In the area of the holding section 3, the base body holding section 11 has the concave bulge 17 on its upper side and the concave bulge 18 on its lower side. The retaining cover 31 has nubs 31*a* on the upper side and encloses the rear end of the base body holding section 11. At the end of the base body holding section 11 facing the base body neck section 12, an area with the soft component of the holding cover 31 is again visible on the underside, which is caused by the oval ring which the holding cover 31 forms on the underside of the base body holding section 11.

The base body neck section 12 is provided with the neck cover 32 and on the underside of the base body neck section 12, the recess 15*a* for the repositioning process can be seen schematically. In the area of the working tip 4, the coating 33 here covers the upper side of the base body tip 13. The vertical, preferably bristle-shaped, cleaning elements 35*a* are preferably equally spaced on the upper side of the base body tip 13.

The frontmost tip 34 completely encloses the base body tip 13 at the frontmost end, which, as already mentioned, serves to protect against injuries when inserting the applicator device 1.

On the underside of the base body tip 13, the recess 15 can be seen schematically, which serves as a centering aid during injection molding of the soft component. Between the neck section 12 and the body tip 13, there is a transition area 19 which has no recess. The tip of the base body 13 tapers towards the frontmost end 34.

FIG. 9 shows a cross-sectional view along the lines B-B as shown in FIG. 7. In the area of the holding section 2, the bottom of the oval groove 24 in the base body retaining section 11 can be seen, which has two through holes 20 in the rear area that are filled with the soft component of the holding cover 31. Another soft component of the holding cover 31 is located at the rear end of the base body support section 11.

At the transition from the neck section 12 to the tip 13 of the base body, a taper 22 is provided in the hard component of the base body 10, which is injection-molded flush with the coating 33. In the area of the working tip 4, one can also see the pairwise opposite arrangement of lateral projections 14*b* of the base body tip 13 as well as the pairwise opposite-facing arrangement of the horizontal cleaning elements 35*b*, which are arranged alternately with the lamella-shaped cleaning elements 36. Only in the area between the front three pairs of horizontal cleaning elements 35*b* are no lamella-shaped cleaning elements 36 provided. The frontmost tip 34 completely encloses the base body tip 13 at the front.

FIG. 10 shows a cross-section through the working tip along the line C-C according to FIG. 3. The horizontal cleaning elements 35*b* and the vertical 30 cleaning elements 35*a* can be seen together with the base body tip 13, the coatings 33 which partially surround the base body tip 13 and the lamella-shaped cleaning elements 36. The horizontal cleaning elements 35*b*, the vertical cleaning elements 35*a* and the lamella-shaped cleaning elements 36 together form a triangular shape, which is modelled on the natural interdental shape and thus allows a very targeted cleaning of the problem zones in the interdental spaces. The vertical cleaning elements 35*a* clean in the proximal area. The horizontal cleaning elements 35*b* clean along the gum line and thus prevent gingivitis. The lamella-shaped cleaning elements 36 help to thoroughly remove food residues as well as discolorations. The underside of the base body tip 13 is free of coating and thus forms a gliding zone, by means of which the gums are gently massaged and stimulated during cleaning. The recess 15 in the underside of the base body tip 13 is clearly visible.

FIG. 11 shows a cross-section through the working tip along the line D-D in FIG. 3. Again, the triangular shape spanned by the vertical cleaning elements 35*a*, the horizontal cleaning elements 35*b* and the lamella-shaped cleaning elements 36 can be seen, whereby the lamella-shaped cleaning elements 36 are in one plane with the vertical cleaning elements 35*a*, i.e. in this view behind the horizontal cleaning elements 35*b*. On its upper side, the base body tip 13 is free of coating 33, since one of the supports 14*a* is arranged here. On the underside of the base body tip 13, the recess 15 is again visible. The glide zone on the underside of the triangular shape is even more pronounced here, which is due to the conical shape of the basic body tip 13 and the working tip 4.

FIG. 12 illustrates a cross-section through the neck section along the line E-E in FIG. 3. The neck cover 32, which fills a corresponding channel 21 on the upper side of the base body neck section 12, can be seen. On the underside of the base body neck section 12, the recess 15*a* for the repositioning step from the first cavity of the tool to the second cavity of the tool is visible.

Behind the cutting plane are the vertical cleaning elements 35*a*, the lamella-shaped cleaning elements 36 and the horizontal cleaning elements 35*b*.

FIG. 13 illustrates a cross-section through the holding section along the line F-F in FIG. 3, i.e. at the front end of holding section 2. The holding cover 31 with a nub 31*a* can be seen on the upper side of the base body holding section 11, which extends from the left to the right edge of the base body retaining section 11 as well as on the underside of the base body holding section 11 in the area of the oval groove 24. Above the nub 31*a*, the holding projection 16 can still be seen, as well as a vertical cleaning element 35*a*.

FIG. 14 shows a top view of the base body 10 of an inventive applicator device 1 according to the first embodiment of the invention, i.e. without the injection-molded body. In the area of the base body holding section 11, a recess 23 is provided at the rear end for the soft component of the holding cover 31, which is directed to the back side at this point, among other things. On the right and left side at the back, oblong through holes 20 are made in the base body holding section 11, which serve to allow the soft component of the holding cover 31 to flow onto the underside of the base body holding section 11 in order to fill the oval groove on the underside of the base body holding section 11. The holding projection 16 serves as a contact point for the user's thumb, as a further anchorage for the soft component and as a support in the injection mold. The channel 21 is inserted in the base body neck section 12, which extends to the taper 22 in the transition area to the base body tip 13.

On the upper side of the base body tip, the three supports 14*a* are shown schematically (these are actually not visible in the base body, as the supports lie flat on the base body and are only effective in the second injection molding step, the injection-molding, anyway), whereby the distance from the rear support to the center support is marked $X_1$ and the distance from the center support to the front support is marked $X_2$. The distance ratio $X_1$ to $X_2$ is preferably between 1.5 to 1 and 2.5 to 1; preferably, it is about 2 to 1. In general, it can be said that, even in the case of more than three supports, the distances between the individual supports decrease towards the foremost end of the base body tip 13. In this way, a particularly secure centering of the base body tip during injection molding with the soft component in the second tool cavity can be guaranteed.

It can be seen again that the base body 10, i.e. especially the tip of the base body 13, tapers along the longitudinal axis L of the base body 10. In addition, the opposite supports 14*b* in the form of lateral projections are arranged approximately in the center of the tip of the base body 13, which also serve as a centering aid during injection molding with the soft component. The lateral projections 14*b* are supported on the side wall of the cavity.

FIG. 15 shows a side view of the base body 10 according to FIG. 14. The base body holding section 11 has the concave bulge 17, which reaches approximately to the holding projection 16 on the upper side. The base body neck section 12 has a substantially constant diameter up to the taper 22 in the transition area to the base body tip 13. The supports 14*a* are shown as flat areas on the top of the base body tip 13 (although, as already mentioned, they are not visible). The lateral projection/support 14*b* is also shown, the height is indicated by $h_1$. The frontmost end of the base body tip 13 has a gradation 25 for complete coating by the soft component in this area.

FIG. 16 illustrates an underside view of the base body 10 as shown in FIG. 14. In the area of the underside of the base body holding section 11, the oval groove 24 with the slot-like through holes 20 can be seen, which is surrounded by the edge of the base body holding section 11. At the rear end of the base body section 11, a recess 23 is also provided which, like the oval groove 24 and the through holes 20, is filled with soft component. Furthermore, the width $b_1$ and the length $1_s$ (in the direction of the longitudinal axis) of the lateral projection/lateral support 14*b* is shown.

The base body neck section 12 includes the recess 15*a* for the repositioning process. In the transition area of the base body neck section 12 to the tip of the base body 13, the taper 22 is again visible. The taper 22 is followed by the underside of the tip of the base body 13, into which the recess 15 is inserted. The recess 15 is preferably designed in a continuous groove; however, it can also be formed by several groove-shaped recesses separated from each other by webs. The lateral supports or projections 14*b* are again located approximately in the center of the tip of the base body 13.

FIG. 17 illustrates a sectional view through the base body 10 along the longitudinal axis L in FIG. 14. The base body section 11 has a concave bulge 17, 18 on both its upper and lower sides, whereby the concave bulge 17 runs on the upper side approximately from the rear inner edge of the base body holding section to the holding projection 16 and whereby the lower concave bulge runs between the front and rear end of the oval groove in the lower side of the base body holding section 11. The recess 23 at the rear end of the base body holding section is connected to the rear end of the oval groove 24 or merges into the rear end of the oval groove 24.

The channel 21 of the base body neck section 12 runs approximately from the front side of the holding projection 16, through the recess 15*a* on the underside of the base body neck section 12 to the transition area 19, which has no recess. The recess 15 is provided on the underside of the base body tip 13, which extends approximately up to the gradation at the foremost tip 25 or the free end of the base body tip 13.

FIG. 18 now shows a top view of a comb 50, which consists of six individual applicator devices 1 according to the first embodiment of the invention. The individual applicator devices 1 are connected to each other via connections 51 on the outside of the base body holding sections 11. The further embodiment of the individual applicator devices 1 corresponds to that described in connection with the preceding FIGS. 1 to 17.

With a view to producing the base body 10 or the whole comb 50, an injection point for the hard component is provided in the injection mold, preferably in the rear area of the cavity (or the base body holding section 11), preferably chosen so that the soft component covers the injection point of the hard component. In contrast, in connection with the injection of the soft component, one injection point is provided for each individual applicator device 1.

FIG. 19 shows an underside view of comb 50 as shown in FIG. 18. The embodiment of the underside of the individual applicator devices 1 again corresponds to the preceding FIGS. 1 to 17. As can be seen, the connection 51 between the individual applicator devices 1 is formed in the form of an elongated (possibly also oval) web made of hard component. It preferably has a thickness that allows the user to easily remove a single applicator device 1 from the comb 50 by bending and/or turning it. The distance $a_1$ of the applicator devices in the connecting area is preferably from 0.1 mm to 1 mm, and even more preferably from 0.15 mm to 0.7 mm. Measured from the center to the center of the holding sections, the distance $a_2$ between adjacent applicator devices 1 is from 5 mm to 15 mm, preferably from 7.5 mm to 9.5 mm.

FIG. 20 shows a section in the area of connection 51 between two applicator devices 1 along the line G-G in FIG. 18. The connection preferably has a length $l_1$ of 1 mm to 6 mm, preferably 1.5 mm to 4 mm, and a height $b_1$ of 0.2 mm to 1.2 mm, preferably 0.4 mm to 0.8 mm.

FIGS. 21 and 22 each show a top view and a bottom view of a comb consisting of six base bodies 10 according to the first embodiment of the invention, which in turn are connected to each other by joints 51 on the outer sides of the base body holding sections 11. The embodiment of the individual base bodies 10 otherwise corresponds to the preceding FIGS. 1 to 17.

FIG. 23 illustrates a section in the area of connection 51 between two applicator devices 1 along the line H-H in FIG. 21. Connection 51 is again in the form of the long web with the length $l_1$ mm and a width $b_1$. Otherwise, the embodiment of the individual base bodies corresponds to the preceding FIGS. 1 to 17.

FIG. 24 illustrates a top view of a single applicator device 1 according to a second embodiment of the invention. The embodiment of the neck section 3 and the working tip 4 corresponds to that described in the preceding FIGS. 1 to 17.

In other words, the differences in the present case are concentrated on the holding section 2, which, unlike the first embodiment of the invention, is not oval in shape but has a substantially octagonal shape, which merges into the neck section 3.

The base body holding section 11 has two opposing lateral holding projections 28*a* and two opposing rear holding projections 28*b*. The holding cover 31 is accordingly molded around the lateral holding projections 28*a* and around the rear holding projections 28*b*, so that it encompasses the base body holding section 11 at five points (twice at the sides and once at the rear). The holding cover 31 has a corrugation which is formed from individual ribs 31*b*, which are preferably arranged symmetrically to one another in the form of arrow patterns. Since the base body holding section 11 does not have a holding projection 16 in this embodiment, the neck cover 32 passes directly over into the holding cover 31. In other words, the holding cover 31 is only limited in the front area of the base body support section 11 by the front holding projections 28*c*, which in turn transition into the base body neck section 12.

In FIG. 25, a side view of the applicator device is illustrated as shown in FIG. 24. The holding cover 31 encloses the lateral holding projection 28*a* on both sides of the base body holding section 11. On the upper side of the base body holding section 11, the ribbed structure 31*b* of the holding cover 31 extends between the rear holding projections 28*b* and the front holding projections 28*c* in the direction of the longitudinal axis L.

FIG. 26 shows a bottom view of the applicator device 1 as shown in FIG. 24, showing how the holding cover 31 also encloses the lateral holding projections 28*a* on the underside, which thus ensure secure anchoring for the holding cover 31. In addition, the holding cover 31 is also injection-molded around the rear end of the base body holding section 11, which provides a further support.

FIG. 27 is a sectional view through the applicator device 1 along the longitudinal axis L according to FIG. 26. It can be seen that also in this embodiment the base body holding section 11 has a concave bulge 17, 18 on both the upper and lower sides, which improves the ergonomics of the grip area.

The injection-molding body 30, consisting of the holding cover 31, the neck cover 32 and the coating 33 with the frontmost tip 34 runs in cross-section continuously from the front to the rear end of the applicator device 1, with the holding cover 31 around the rear end. In contrast to the cross-section of the first embodiment of the invention shown in FIG. 8, no holding projection 16 is arranged here in the area of the longitudinal axis L.

FIGS. 28 to 30 show a top view, a side view and a bottom view of the base body 10 of an applicator device 1 according to the second embodiment of the invention. It can be seen that the lateral recesses 23*a* on the upper and lower side of the base body holding section 11 run around the lateral holding projections 28*a* and virtually constrict them. The recess 23 at the rear end of the base body holding section 11 separates the two rear holding projections 28*b* from each other. The front holding projections 28*c* pass over into the base body neck section 12, where the channel 21 is formed for the neck cover 32. This structure also allows a very good holding of the soft component on the base body 10.

FIG. 31 illustrates a longitudinal section through the base body 10 along the longitudinal axis L according to FIG. 30. It can be seen here that, due to the concave bulges 17, 18 on the upper and lower sides of the base body support section 11, as well as due to the lateral notches 23*a*, the lateral support projections 28*a* protrude over the correspondingly slimmed area of the base body support section 11.

The front holding projections 28*c* extend into the channel 21 of the neck section 12. The rear holding projection 28*b* protrudes from the cut surface of the base body holding section on the upper side and at the rear end. The rear end of the base body holding section 11 has a gradation 29 analogous to the tip of the base body, which serves to better hold the soft component.

FIG. 32 shows a top view of a single applicator device 1 according to a third embodiment of the present invention. Here, too, the neck section 3 and the working tip 4 are identical with the first and the second embodiment of the invention, which were described in the preceding FIGS. 1 to 31. The differences are rather in the area of the holding section 2, which will be explained in more detail in the following.

The holding section 2 comprises the base body holding section 11 and the holding cover 31 with nubs 31*a*, which are preferably oval. In the front area of the base body support section 11, the holding cover 31 forms a soft component holding point 39, which forms the transition to neck section 3. The holding point 39 is formed in the direction of the longitudinal axis L together with the holding cover 31, while the lateral edge holding point 39 is formed from the hard component of the base body support section 11.

FIG. 33 shows a corresponding side view of the applicator device 1 as shown in FIG. 32, in which in particular the lateral extension of the holding cover 31 or holding point 39 is shown. Parts of the holding point 39, which are made of hard components, extend only approximately to the center of the side wall of the holding section 2, whereas the holding cover 31 completely covers the side wall.

FIG. 34 also shows a bottom view of the applicator device 1 as shown in FIG. 32. Here, it can be seen that the holding cover 31 on the underside encloses a central recess 26 of the underside of the base body holding section 11 on the sides and at the rear end, whereby the holding cover 31 substantially forms a V-shape. The central recess 26 is designed as a projection in the base body holding section 11, a recess is formed around this element, which is filled with soft component, so that the central recess 26 only becomes visible as such in the end product. The central recess 26 on the underside of the base body holding section 11 is designed in the form of an elongated oval, which may taper slightly towards the rear end of the base body holding section 11. This in turn creates a geometry for the thumb support, namely in the form of a concave bulge.

FIGS. 35 to 37 show a top view, a side view and a bottom view of the base body of the applicator device as shown in FIGS. 32 to 34. On the top side, the base body holding section 11 has a centrally arranged holding projection 16 and two lateral holding projections 28*a*, which also partly surround the rear part of the base body holding section. At the end of the base body holding section 11 facing the base body neck section 12, front holding projections 28*c* are provided, in the area of which a lateral indentation 27 is provided, in each case, which serves to accommodate soft components. The lateral bulges filled with the soft component then form the holding point 39.

Between the lateral holding projections 28*a* and the front holding projection 28*c*, there are lateral recesses 23*a* provided, around which the soft component is injected. A further recess 23 is provided in the rear area of the base body holding section 11, around which the soft component is also injected to ensure good anchoring. In other words, in the present embodiment the rear and lateral recesses 23, 23*a*, the holding projection 16 on the upper side and the central projection 26 on the underside of the base body holding section 11 serve as anchoring structures for the soft component, or as support structures when the base body is injection-molded.

FIGS. 38*a* and 38*b* show a top view and a side view of an applicator device 1 according to a fourth embodiment of the invention. In this embodiment, the applicator device 1 has one working tip each at both ends. The right or front end of the applicator device 1 has a neck section 3 and a working tip 4, as already described for the previous embodiments.

On the left or rear side, the applicator device 1 has an additional working tip 4' in the form of a toothpick 40. The toothpick 40 is formed from the hard component in this case, but it can also be completely or only partially covered with a soft component. The holding cover 31 has curved ribs 31*c*, each of which are aligned towards working tip 4 and working tip 4' respectively, so that a secure hold can be guaranteed when using the two working tips 4, 4'.

Two curved ribs 31*c* for each side are shown. There may also be three, four or five ribs, depending on the length of the holding section 2 and the size of the individual ribs 31*c*. The ribs 31*c* are formed in one piece with the soft component of the holding cover 31, the neck cover 32 and the coat 33. As shown in the side view according on FIG. 38*b*, the holding section 2 has a concave bulge 17, which in turn is intended for the finger rest for ergonomic reasons.

FIGS. 39*a* to *c* show a fifth, sixth and seventh embodiment of the present invention, whereby these differ from FIGS. 38*a* to *b* only with regard to the second working tip 4'. FIG. 39*a* illustrates a brush-like or fan-like element 41 as the second working tip 4', which serves in particular to clean the gum line. This can be formed from one or more bundles of conventional, extruded bristles or injected bristles. It is also possible that the element 41 is made of a thermoplastic elastomer (i.e. full flat or one piece).

FIG. 39*b* shows a similar second working tip 4', whereby element 42 has a notch to allow it to work a little into the interdental spaces, if necessary. Here too, as already described for FIG. 39*a*, conventional, extruded bristles or injection-molded bristles can be used. Furthermore, it is also possible that element 42 is made of a thermoplastic elastomer (i.e. full flat or one piece).

As shown in FIG. 39*c*, the additional working tip 4' comprises a pincer-shaped plastic element 43 with two gripper jaws 44 and an opening 45, with cleaning elements 46 projecting inwardly from the gripper jaws 44. The cleaning elements 46 preferably project radially inwards in order to achieve the best possible cleaning effect. This applicator device 1 is preferably used for implant cleaning.

FIG. 40*a* shows a top view of an applicator device 1 according to an eighth embodiment of the invention. The working tip 4 has here as the frontmost tip an umbrella tip 34', which has several cleaning elements 35*b*' arranged at an angle to the longitudinal axis L. The cleaning elements 35*b*' are preferably directed forward at an angle of about 45° and are slightly longer than the other horizontal cleaning elements 35*b*. During use, especially when entering an interdental space, these cleaning elements 35*b*' fold back and thus develop an additional cleaning effect.

According to FIG. 40*b*, the frontmost tip is in the form of an umbrella tip 34", which has several cleaning elements 35*b*", which are arranged at an angle to the longitudinal axis L, and in fact exactly the opposite way round as with the umbrella tip 34', according to FIG. 40*a*. The cleaning elements 35*b*" are oriented to the rear and are preferably arranged at an angle of about 45° to the longitudinal axis L of the applicator device 1. Here, the cleaning elements 35*b*" fold back, especially when pulled out of an interdental space and thus develop an additional cleaning effect.

FIGS. 41*a* and 41*b* show a top view and a side view of an applicator device 1 according to a ninth embodiment of the present invention. Here, the working tip 4 has a multi-zone structure. The working tip 4 is divided into three zones Z1, Z2 and Z3. The zones Z1 and Z3 correspond to the usual described structure. In zone Z2, however, the horizontal cleaning elements 35*b* each have a convex curved profile in the horizontal plane, which results in a bulge-like shape for zone Z2 in the top view. The vertical cleaning elements 35*a* and the lamella-shaped cleaning elements 36 also form a convex profile, which completes the bulge-shaped horizontal profile of the horizontal cleaning elements 35*b* and also completes a convex profile in the vertical plane. In this way, a particularly strong cleaning effect can be achieved in the middle zone Z2.

However, the bulge-shaped zone Z2 can also be arranged in the front or rear area of the working tip, i.e. in the position of zone Z1 or Z3. Furthermore, two or three bulge-shaped zones Z2 are also provided, which replace zones Z1 and Z3, if necessary.

FIGS. 41*c* and 41*d* show a top view and a side view of an applicator device 1 with another multi-zone working tip 4.

Here. the working tip 4 has five zones Z1, Z2, Z3, Z4 and Z5, whereby zones Z1 and Z5 have the usual structure described above. The middle zones Z2, Z3 and Z4, on the other hand, each have an arrow-shaped profile of the horizontal cleaning elements 35*b* and the lamella-shaped cleaning elements 36, i.e. they are shorter when viewed from the rear to the front. Furthermore, in side view, the cleaning elements 35*a* and the lamella-shaped cleaning elements 36 have an arrow-shaped vertical profile, i.e. they become shorter when viewed from the rear to the front. Again, a particularly powerful cleaning effect is provided in the middle of the working tip 4. Here too, however, zones Z1 and/or Z5 can be designed like zones Z2 to Z4 and the positions of the zones can change. For example, "normal" zones Z1, Z5 can be arranged between the arrow-shaped profiles.

FIGS. 42*a* and 42*b* show a top view and a side view, respectively, of an applicator device 1 according to a tenth embodiment of the present invention. Here, the working tip has a combination of the usual horizontal cleaning elements 35*b*, the usual lamella-shaped cleaning elements 36 and—instead of the usual vertical cleaning elements 35*a*—longitudinal vertical abrasive elements 37. The longitudinal vertical abrasive elements 37 are bent and point alternately to the left and right side. The longitudinal vertical abrasive elements 37 can also all point in the same direction or in any order, sometimes to the left and sometimes to the right. In side view, the long vertical abrasive elements 37 have a roof or triangular design. The longitudinal vertical abrasive elements 37 preferably do not reach to the frontmost tip 34, but leave a free space for threading. With the longitudinal vertical abrasive elements 37, a particularly efficient cleaning of the proximal area can be achieved.

FIGS. 42*c* and 42*d* show a top view and a side view of an applicator device 1 with abrasive elements 38, which has a multi-zone structure. The working tip 4 comprises three zones Z1, Z2 and Z3, whereby zone Z1 has the usual structure described above. Zone Z2 has lateral abrasive elements 38, which extend from the bottom of the working tip to the top of the tip. Between the lateral abrasive elements 38 there are (preferably) no vertical cleaning elements 35*a*.

The lateral abrasive elements 38 have approximately the same extension as the lamella-shaped cleaning elements 36. Zone Z3, which extends to the penultimate tip 34, is free of cleaning elements. In principle, it is conceivable that zone Z3 also has abrasive elements 38. The abrasive elements are preferably similar to the lamella-shaped cleaning elements 36, but are thicker. It is also conceivable that the lamella-shaped cleaning elements 36 in zone Z1 are replaced by lateral abrasive elements 38.

FIGS. 43*a* to *d* show a top view and a side view of two applicator devices with an uneven working tip 4. The working tips 4 otherwise have the usual structure described above.

The working tip 4 as shown in FIG. 43 *a* and *b* has a slightly curved shape when viewed from the side and may also be inclined downwards at the same time. This means that the thickness of the working tip 4 does not decrease linearly in the direction of the frontmost end 34, but shows a stronger decrease in the middle area, which then becomes linear again in the area in front of the frontmost tip 34. Correspondingly, the underside of the working tip is not straight, but shows a similar vibration as the top side (which however is somewhat less strong).

In FIGS. 43*c* and *d*, working tip 4 has a wavy or serpentine shape in top view, whereas otherwise the cleaning elements 35*a*, 35*b* and the cleaning elements 36 have the design described above. In the side view, the working tip 4 does not have a curved or wave-shaped geometry, but is designed with a linearly decreasing thickness (i.e. conical) as usual.

FIGS. 44*a* and 44*b* show a top view and a side view of an applicator device 1 according to a twelfth embodiment of the invention. This applicator device 1 has an extension 2' of the holding section 2 compared to the applicator devices described above, which is connected to the rear end of the holding section 2. The holding cover 31' of the extension 2' again has several, preferably two, curved ribs 31*c'*, which are preferably directed outwards. The holding section 2 and the extension of the holding section 2' each have a concave bulge 17 and 17' respectively on the upper side.

In an alternative embodiment shown in FIG. 44*c*, the extension 2' of the holding section 2 has a concave bulge 17' at the top, whereas the holding section 2 is straight at the top, but has a concave bulge 18 at the bottom (and the extension 2' does not). However, it is also conceivable that the underside of the holding section extension 2' has a concave bulge and the upper side of the holding section extension 2' either also has a bulge 17' or is straight.

FIGS. 45*a* and 45*b* show a side view and a top view, respectively, of an applicator device 1 according to a thirteenth embodiment of the present invention. This applicator device 1 has a modified basic shape, whereby the neck section 3 and the working tip 4 do not project straight from the holding section 2. In comparison to the embodiments shown so far, the neck section 3 is not symmetrically designed here, but has a straight form on one side and a curvature K on the other side.

The working tip 4 has the usual design (i.e. as described in FIGS. 1 to 17), but is arranged so that it is rotated by 90° in relation to the neck and holding section 3, 2 compared to the previous embodiments. This is due to the fact that this applicator device 1 is held vertically between thumb and index finger during use. Therefore, the applicator device 1 has a concave bulge 17, 18 on both sides of the holding section 2, as shown in the top view in FIG. 45*b*. In this way, an ergonomically favorable hold can be provided.

Finally, FIGS. 46 and 46*b* show a top and side view of an applicator device 1 according to a fourteenth embodiment of the invention. Here, the holding section 2 has a suction cup 47 at its rear end, which serves to place the applicator device 1 vertically. The suction cup 47 is preferably made of soft component and has a cavity 48 (dotted line), by means of which the required negative pressure can be generated. Instead of the suction cup 47, however, a normal stand without suction effect can also be provided. Such a stand is preferably made of a hard component.

FIGS. 47*a*, 47*b* and 47*c* show a top view and a side view of a first and a second variant of an applicator device 1 according to a fifteenth embodiment of the invention. Compared to the previously described applicator devices, this applicator device 1 has an extension of the holding section 2, which is connected to the rear end of the holding section 2. A polishing element 46' is formed on the extension. This polishing element can, for example, be designed as convex curvature as shown in variant 1 in FIG. 47*b*, or as shown in variant 2 in FIG. 47*c*, as an element with a polishing element edge 46". The base shape is identical for both variants, so that the top view in FIG. 47*a* applies to both.

FIG. 48 shows a top view of an applicator device 1 according to a sixteenth embodiment of the present invention. This applicator device 1 has a modified base shape, with the neck section 3 and the working tip 4 not protruding straight from the holding section 2. The neck section 3 is not symmetrically designed here, but has a straight shape on one side and a curvature K on the other side.

The working tip 4 has the usual design (i.e. as described in FIGS. 1 to 17), but compared to the previous embodiments, it is rotated by 90° in relation to the neck and holding section 3, 2. This is due to the fact that this applicator device 1 is held vertically between thumb and index finger during use. In this way an ergonomically favorable hold can be provided. A tongue cleaner edge 46''', which is formed from soft components, is designed as a further functional element and is arranged in the bulge K.

FIGS. 49*a* to 49*d* show a handle extension part 60 in different views, without inserted applicator device 1. In addition to the receiving area 61, an access opening 62 is shown, which is required for the manufacture of the fixing element 63. The feed-through opening 64 is also shaped and serves to hold the applicator device together with the fixing element 63.

FIGS. 50*a* to 50*d* show the handle extension part 60 from FIGS. 49*a* to 49*d* with the applicator device 1 inserted. For mounting in the handle extension part 60, the applicator device 1 is guided with the working tip through the feed-through opening 64 and then clamped with the free end of the holding section between the fixing element 63 and a surface of the receiving area 61. This allows the use of the applicator device 1 with handle extension part 60.

FIGS. 51, 52 and 53 schematically show the modularity of the injection molding tool. In the rear view an applicator device is shown, which is manufactured in two cavities, whereby the different sections of the injection molding cavity are shown schematically with dotted lines.

FIG. 51 shows a first variant of the modular design of the injection molding tool. The variant consists of three sections of the injection molding cavity. The rear section 52 of the injection molding cavity forms the base body holding section in a first form in the first cavity and the holding cover in a second mold in the second cavity. The front section 53 of the injection molding cavity forms in a first form in the first cavity the base body tip and in a second form in the second cavity the coating. Between them, the fixed neck section 54 is arranged as the middle section. This serves to move the base body of the applicator device from the first to the second cavity. From the first to the second cavity only the front side changes here. This fixed neck section 54 is designed as a repositioning device.

The modularity is designed in such a way that the rear and front sections of the injection molding cavities 52, 53 are interchangeable and the fixed neck section 54 does not change. A simple model change is possible, since only non-moving cavities are replaced. The interchangeability offers the possibility to design applicator fixtures with different holding sections and with different working tips, whereby the neck section remains the same in each case.

FIG. 52 shows a second variant of the modular design of the injection molding tool. The variant consists of two sections of an injection molding cavity. The rear section 55 of the injection molding cavity forms in a first form in the first cavity the base body holding section and the neck section and in a second form in the second cavity the holding cover and the neck section. The front section 53 of the injection molding cavity forms the base body tip in a first form in the first cavity and the coating in a second form in the second cavity.

The repositioning device is integrated in the area of the rear section 55 of the injection molding cavity. This allows the base body of the application device to be moved from the first to the second cavity. The only advantage of the modularity here is the interchangeability of the front section 53 of the injection molding cavity, i.e. different working tips with the same holding and neck section can be formed.

FIG. 53 shows a third variant of the modular design of the injection mold tool. The variant consists of two sections of an injection molding cavity. The rear section 52 of the injection molding cavity forms the base body holding section in a first form in the first cavity and the holding cover in a second form in the second cavity. The front section 56 of the injection molding cavity forms the neck section in a first form in the first cavity and the base body tip and the neck section and the coating in a second mold in the second cavity.

The repositioning device is integrated in the area of the front section 56 of the injection molding cavity. This allows the base body of the applicator device to be moved from the first to the second cavity. The only advantage of the modularity here is the interchangeability of the rear section 52 of the injection molding cavity, i.e. different holding sections can be formed with the same neck section and the same working tips.

It goes without saying that the design variants described and shown here serve only as examples of applicator devices within the meaning of the present invention. Within the scope of the present invention, in particular the individual described and shown holding sections, neck sections, working tips, additional working tips and extensions can be combined with each other without leaving the subject matter of the invention.

The feature descriptions for specific figures can of course be transferred to other figures that show the same or similar features and where the features may not be described in the same detail.

LIST OF REFERENCE SIGNS

1 Applicator device
2 Holding section
2' Extension holding section
3 Neck section
4 Working tip
4' Additional working tip
5 Upper tip of the triangular shape
6 Lower tip of the triangular shape (left)
7 Lower tip of the triangular shape (right)
8 Right side of the triangular shape
9 Left side of the triangular shape
10 Base body
11 Base body holding section
11' Extension base body holding section
12 Base body neck section
13 Base body tip
14*a* Supports (free spots)
14*b* Supports (lateral projections)
15 Recess(es) underside of the base body tip
15*a* Recess underside of the base body neck section
16 Holding projection
17 Concave bulge upper side of the holding section
17' Concave bulge upper side of the extension
18 Concave bulge lower side of the holding section
19 Transition area (without recess)
20 Through holes in the base body holding section
21 Channel base body neck section (upper side)
22 Taper/transition
23 Recess at the rear end of the base body holding section
23*a* Lateral recesses at the base body holding section

24 Oval groove at the lower side of the base body holding section
25 Gradation
26 Central recess (lower side of the base body holding section)
27 Lateral indentations in the base body holding section
28*a* Lateral projections
28*b* Rear holding projections
28*c* Front holding projections
29 Gradation (at the rear of the base body holding section)
30 Injection-molding body
31 Holding cover
31' Holding cover extension
31*a* Nubs of the holding cover
31*b* Ribbed structure/ribs of the holding cover
31*c* Curved ribs/ribs of the holding cover
31*c'* Curved ribs of the holding cover extension
32 Neck cover
33 Coating
34 Frontmost tip
34' Frontmost tip (umbrella form)
34" Frontmost tip (arrow form)
35*a* Vertical cleaning elements
35*b* Horizontal cleaning elements
35*b'* Cleaning elements umbrella tip
35*b"* Cleaning elements arrow tip
36 Lamella-shaped cleaning elements
37 Vertical abrasive elements
38 Lateral abrasive elements
39 Holding point
40 Toothpick-like element
41 Brush or fan-like element
42 Notched brush or fan-shaped cleaning element
43 Gripper-shaped element
44 Gripper jaws
45 Opening
46 Cleaning elements
46' Polishing element
46" Polishing element edge
46''' Tongue cleaner edge
47 Suction cup
48 Cavity
50 Comb made of individual applicator devices
50' Comb made of individual based bodies
51 Connection
52 Rear section of the injection molding cavity (in the first cavity for the base body holding section, in the second cavity for the holding cover)
53 Front section of the injection molding cavity (in the first cavity for the base body holding section, in the second cavity for the coating)
54 Fixed neck section of the injection molding cavity
55 Rear section of the injection molding cavity (in the first cavity for the base body holding section and neck section, in the second cavity for the holding cover and neck section)
56 Front section of the injection molding cavity (in the first cavity for the base body tip and neck section, in the second cavity for the coating and neck section)
60 Handle extension part
61 Receiving area
62 Access opening
63 Fixing element
64 Feed-through opening a1 distance in connecting area
a2 Distance center—center
$b_1$ Height connection
$b_2$ Width lateral projection
$D_1$ Diameter working tip (measured on soft component, at the free end)
$D_2$ Diameter working tip (measured on soft component, in the area of the last cleaning elements)
$D_3$ Diameter working tip (outer diameter with cleaning elements, at the free end)
$D_4$ Diameter working tip (outer diameter with cleaning elements, in the area of the last cleaning elements)
$h_1$ Height of the lateral protrusions
K Curvature neck section
$l_1$ Length connection
$l_2$ Length holding section
$l_{2'}$ Length extended holding section
$l_3$ Length neck section
$l_4$ Length working tip
$l_5$ Length lateral projection
$l_6$ Length recess underside base body tip
$l_7$ Length recess underside base body holding section
$l_8$ Length frontmost tip
$l_s$ Length of the supports (lateral projections) in longitudinal direction
L Longitudinal axis of the applicator device/working tip
$X_1$ Distance rear—center support (upper side)
$X_2$ Distance center—front support (upper side)
Z1-5 Zones of the working tip or the coating
A-A Intersection line
B-B Intersection line
C-C Intersection line
D-D Intersection line
E-E Intersection line
F-F Intersection line
G-G Intersection line
H-H Intersection line

The invention claimed is:

1. An applicator device with an upper side and an underside and comprising:
at least one holding section;
at least one working tip;
a neck section connecting the holding section and the working tip; and
a base body at least partially formed from a first plastic component, the base body being at least partially overmolded with at least one second plastic component, the at least one second plastic component being softer than the first plastic component, wherein:
in the working tip the at least one second plastic component partially coats the base body as a coating,
the coating comprises outwardly projecting cleaning elements, and
a recess is provided only in the underside, wherein:
the recess is provided in the working tip along the longitudinal axis of the base body, and
the recess includes an edge closest to an end of the at least one working tip and the edge is spaced away in a longitudinal direction from the end of the at least one working tip.

2. The applicator device according to claim 1, wherein:
the working tip is triangular in shape, an upper tip of the triangular shape being aligned with the upper side of the applicator device,
the upper tip of the triangular shape is formed by a series of vertical cleaning elements, and
lower tips of the triangular shape are formed by a series of horizontal cleaning elements.

3. The applicator device according to claim 2, wherein:
seen in a front view, on the left and right sides of the triangular shape of the working tip, lamellar-shaped cleaning elements are arranged between the vertical and horizontal cleaning elements, and the vertical and horizontal cleaning elements project further outwards than the lamellar-shaped cleaning elements.

4. The applicator device according to claim 3, wherein:

along a direction of the longitudinal axis of the working tip, the vertical and horizontal cleaning elements are arranged offset relative to one another, the lamellar-shaped cleaning elements are arranged in a cross-sectional plane with the vertical cleaning elements, and the horizontal cleaning elements are arranged in pairs opposite one another.

5. The applicator device according to claim 1, wherein a plurality of supports are provided in the working tip, the supports being provided in the form of free spots on the upper side of the base body and in the form of lateral projections of the base body, the lateral projections being enclosed by the coating in a flush manner.

6. The applicator device according to claim 1, wherein an additional working tip is arranged at the end of the holding section opposite the working tip.

7. The applicator device according to claim 6, wherein the additional working tip comprises a pincer-shaped plastic element with two gripping jaws and an opening, wherein the gripping jaws have inwardly directed cleaning elements.

8. The applicator device according to claim 6, wherein the additional working tip comprises a brush-shaped or fan-shaped cleaning element made of a thermoplastic elastomer or one or more bundles of bristles.

9. The applicator device according to claim 1, wherein an inscription is applied to the holding section and/or the neck portion.

10. The applicator device according to claim 9, wherein the inscription is raised or recessed in the base body and/or in the area around which the second plastic component is injection-molded (injection-molded body).

11. The applicator device according to claim 9, wherein a color pattern is printed on the area around which the second plastic component is injection-molded (injection-molded body).

12. The applicator device according to claim 1, wherein the working tip has indicator substances, which are detachable during use.

13. The applicator device according to claim 1, wherein the working tip has a multi-zone structure.

14. The applicator device according to claim 1, wherein the working tip has an uneven shape.

15. The applicator device according to claim 1, wherein the first and/or the second plastic component comprises a filler with a cooling effect.

16. The applicator device according to claim 15, wherein the filler with the cooling effect is applied together with further fillers with taste.

17. The applicator device according to claim 15, wherein the filler with the cooling effect is a cooling agent such as WS 3, WS 5, WS 23 or WS 32.

18. The applicator device according to claim 15, wherein the filler has an indicator function, the filler being dosed such that the cooling effect diminishes after a predefined time.

19. The applicator device according to claim 1, wherein the length of the recess is between 10 mm to 25 mm, the depth of the recess is from 0.03 mm to 0.8 mm, and the width of the recess ranges from 0.1 mm to 1 mm.

20. The applicator device according to claim 1, wherein the recess provided in the working tip is a first recess, and a second recess is provided in the neck section, the first recess and the second recess being aligned along the longitudinal axis of the base body.

21. A method for producing an applicator device or a comb of applicator devices by injection molding, wherein:

the applicator device has at least one holding section, at least one working tip and a neck section connecting the holding section and the working tip, in a first step a base body is injection molded at least partially from a first plastic component, after a repositioning process, in a second step the base body is partially overmolded with at least one second plastic component as a coating, the at least one second plastic component being softer than the first plastic component, the at least one second plastic component partially coats the base body of the working tip and the coating forms outwardly projecting cleaning elements, a respective repositioning element of an injection molding tool is provided so as to engage in a recess of the neck section of the base body during the repositioning process, after repositioning, during overmolding of the second component, the tip of the base body is held in a centered manner by means of a recess provided only in an underside of the applicator device, the recess being provided in the working tip along the longitudinal axis of the base body, wherein the recess includes an edge closest to an end of the at least one working tip and the edge is spaced away in a longitudinal direction from the end of the at least one working tip.

22. The method according to claim 21, wherein the base body is held on the upper side and on the lower side by means of one or more holding elements of the injection molding tool when the second plastic component is injected, and the base body being additionally held in each case by lateral projections of the base body relative to the injection molding tool.

23. The method according to claim 21, wherein a filler with a cooling effect is added to the first and/or the second plastic component.

24. The method according to claim 23, wherein the proportion of filler in the compound is between 3% and 50%.

25. The method according to claim 21, wherein the recess provided in the working tip is a first recess, and a second recess is provided in the neck section, the first recess and the second recess being aligned along the longitudinal axis of the base body.

26. A tool for producing a comb of an applicator device by injection molding with at least a first cavity for injection molding a first plastic component for a base body and a second cavity for injection molding a second plastic component around the base body, wherein the first cavity for the first plastic component is modularly constructed from at least one rear section for at least the base body holding section and at least one front section for at least the base body tip, and the second cavity for the second plastic component is modularly constructed from at least one rear section for at least a holding cover and at least one front section for at least a coating, wherein by means of the modular design the first cavity is configured to be assembled from geometrically differently formed rear sections and from geometrically differently formed front sections, so that different embodiments of the base body holding section can be combined with different embodiments of base body tips.

27. The tool according to claim 26, wherein by means of the modular design the second cavity can be assembled from geometrically differently formed rear sections and from geometrically differently formed front sections, so that different designs of the holding cover can be combined with different designs of the coating.

* * * * *